US006939080B2

(12) United States Patent
Wokas

(10) Patent No.: US 6,939,080 B2
(45) Date of Patent: Sep. 6, 2005

(54) TANK FOR SERVICE STATIONS

(75) Inventor: Albert L. Wokas, P.O. Box 11477, Zephyr Cove, NV (US) 89448

(73) Assignee: Albert L. Wokas, Lincoln, CA (US)

( * ) Notice: Subject to any disclaimer, the term of this patent is extended or adjusted under 35 U.S.C. 154(b) by 0 days.

(21) Appl. No.: 10/742,671

(22) Filed: Dec. 19, 2003

(65) Prior Publication Data

US 2004/0175236 A1 Sep. 9, 2004

Related U.S. Application Data

(63) Continuation-in-part of application No. 09/592,348, filed on Jun. 12, 2000, now Pat. No. 6,685,392, which is a continuation-in-part of application No. 09/328,239, filed on Jun. 8, 1999, now Pat. No. 6,270,285, which is a continuation-in-part of application No. 08/822,312, filed on Mar. 21, 1997, now Pat. No. 5,921,712.

(51) Int. Cl.[7] ..... E02D 3/00; E02D 3/16

(52) U.S. Cl. ..... 405/52; 405/128; 405/154; 141/59

(58) Field of Search ..... 405/52, 53, 128, 405/154; 141/7, 59, 65, 98

(56) References Cited

U.S. PATENT DOCUMENTS

| | | | | | |
|---|---|---|---|---|---|
| 1,954,581 | A | * | 4/1934 | Wortmann | 220/567.1 |
| 2,853,149 | A | | 9/1958 | Gosselin | |
| 3,193,990 | A | | 7/1965 | Smith | |
| 3,672,180 | A | | 6/1972 | Davis | |
| 3,848,765 | A | | 11/1974 | Duerkop | |
| 3,926,230 | A | | 12/1975 | Stary et al. | |
| 4,010,779 | A | | 3/1977 | Pollock et al. | |
| 4,095,626 | A | | 6/1978 | Healy | |
| 4,110,947 | A | | 9/1978 | Murray et al. | |
| 4,561,292 | A | * | 12/1985 | Pugnale et al. | 73/49.2 |
| 4,580,925 | A | | 4/1986 | Matich et al. | |
| 4,589,798 | A | | 5/1986 | Milly | |
| 4,638,920 | A | | 1/1987 | Goodhues, Jr. | |
| 4,676,093 | A | * | 6/1987 | Pugnale et al. | 73/49.2 |
| 4,739,659 | A | * | 4/1988 | Sharp | 73/49.2 |
| 4,778,310 | A | | 10/1988 | Moreland | |
| 4,781,777 | A | * | 11/1988 | Pugnale et al. | 156/187 |
| 4,787,772 | A | | 11/1988 | Wagner | |
| 4,875,361 | A | * | 10/1989 | Sharp | 73/49.2 |
| 4,885,931 | A | | 12/1989 | Horner | |
| 4,925,046 | A | * | 5/1990 | Sharp | 220/4.12 |
| 4,936,705 | A | * | 6/1990 | Schneider | 405/54 |
| 4,968,179 | A | | 11/1990 | Frahm | |
| 4,974,739 | A | * | 12/1990 | Gelin | 73/49.2 |
| 4,978,249 | A | | 12/1990 | Killman | |
| 4,989,447 | A | * | 2/1991 | Gelin | 73/49.2 |

(Continued)

*Primary Examiner*—Thomas B. Will
*Assistant Examiner*—Alexandra K. Pechhold
(74) *Attorney, Agent, or Firm*—Harness, Dickey & Pierce, P.L.C.

(57) ABSTRACT

An improved storage reservoir assembly has increased resistance to leakage of fluid from the assembly into the ground. The assembly comprises a storage reservoir suitable for being buried beneath ground level and suitable for containing a fluid and at least one support unit attached to or disposed adjacent to the reservoir and suitable for attachment to an above-ground canopy. The assembly also provides for substantially surrounding the reservoir with a hydrostatic head of a second fluid for detecting reservoir leaks by infiltration of the second fluid within the reservoir. This may be accomplished through an enclosure suitable for substantially surrounding the reservoir or through the use of a double-walled reservoir, with the second fluid contained within the enclosure or between the walls of a double-walled reservoir. In addition, the assembly provides for a piping network of the distribution system for supplying remote service islands to be located within a primary above-ground canopy.

48 Claims, 36 Drawing Sheets

U.S. PATENT DOCUMENTS 5,017,044 A * 5/1991 Sharp ..... 405/53
5,020,358 A * 6/1991 Sharp ..... 73/49.2
5,037,239 A 8/1991 Olsen et al.
5,072,623 A * 12/1991 Hendershot ..... 73/49.2
5,220,823 A * 6/1993 Berg et al. ..... 73/49.2
5,244,307 A 9/1993 Wokas
5,301,721 A 4/1994 Hartmann
5,325,896 A 7/1994 Koch et al.
5,390,713 A 2/1995 Fiech
5,526,964 A 6/1996 Moore et al.
5,575,585 A 11/1996 Kovarik
5,586,586 A 12/1996 Fiech
5,589,631 A * 12/1996 Spring et al. ..... 73/49.2
5,597,948 A * 1/1997 Sharp ..... 73/49.2
5,695,089 A * 12/1997 Reese et al. ..... 220/560.03
5,720,404 A * 2/1998 Berg et al. ..... 220/4.13
5,803,304 A * 9/1998 Berg ..... 220/565
5,833,390 A * 11/1998 Lovett ..... 405/52
5,921,712 A 7/1999 Wokas
5,954,085 A 9/1999 Moore et al.
6,270,285 B1 8/2001 Wokas
6,551,024 B1 * 4/2003 Berg et al. ..... 405/54
6,685,392 B1 2/2004 Wokas

* cited by examiner

TANK FOR SERVICE STATIONS

RELATED APPLICATIONS

This application is a continuation-in-part of U.S. patent application Ser. No. 09/592,348, filed Jun. 12, 2000 now U.S. Pat. No. 6,685,392 and entitled "Tank for Service Stations," which is a continuation-in-part of U.S. patent application Ser. No. 09/328,239, filed Jun. 8, 1999, now U.S. Pat. No. 6,270,285 issued Aug. 7, 2001 and entitled "Integrated Underground Storage Reservoir and Above-Ground Canopy and Dispensing System," which is a continuation-in-part of U.S. patent application Ser. No. 08/822,312, filed Mar. 21, 1997, now U.S. Pat. No. 5,921,712 issued Jul. 13, 1999 and entitled "Integrated Underground Storage Reservoir and Above-Ground Canopy and Dispensing System."

BACKGROUND OF THE INVENTION

This invention relates generally to underground storage reservoirs in combination with above-ground shelters for accessing such reservoirs, and more particularly relates to an integrated underground fluid storage reservoir and above-ground canopy support system.

Various types of materials are stored beneath the surface of the ground for access through above-ground dispensing and/or distribution facilities. One class of such materials includes fluids such as fuels for automotive and heating uses. Typically, these storage installations include a fluid reservoir that is buried beneath ground level within an excavated pit. A backfill material is typically used to surround the storage tank to achieve a buried condition for the reservoir. Pea gravel is a standard backfill material in the industry because of its ability to quickly achieve a substantially settled condition. Sand has also been used as a backfill material.

In the case of underground storage reservoirs at automobile service stations, one or more reservoirs containing automobile fuel are typically located upon the service station premises at a location some distance away from the pumps used for dispensing the fuel to automobiles. In such an arrangement, the underground storage tanks can be filled, such as by tanker trucks, without impeding the ability of the service station to continue operating. This is because the tanker trucks can access ports or manholes for filling the underground storage tanks in the remote area of the service premises away from the dispensing units.

However, locating underground storage tanks for fluids such as automobile and heating fuels at a distance away from the dispensing location requires a significant amount of underground piping for connecting the dispensing units to the underground storage tanks. These pipes sometimes require maintenance and/or service operations. Therefore, these pipes must be accessible to service and maintenance personnel at times. A typical automobile service station, however, includes one or more sections of concrete driveway covering a substantial portion of the service station premises, in order to provide customers with sufficient maneuvering access to the typical several dispensing units. This substantial concrete driveway also provides sufficient access to the underground storage reservoir filling ports by tanker trucks. This type of arrangement, however, makes accessing the underground piping network connecting the storage tanks with the dispensing pumps expensive, difficult and time consuming.

Automobile service stations are often designed to include multiple dispensing units, commonly referred to as "pumps," "multiple pump dispensers" or "MPDs", from which multiple customers can access the underground storage reservoir or reservoirs at the same time. These dispensing units are often located at multiple service islands located upon the service station premises. Since automobile fuel is commonly sold in multiple grades, the different fuel grades can be stored within a single partitioned reservoir or within multiple reservoirs. Extensive underground piping is therefore typically required in order to distribute different grades of fuel to the different dispensing units located at the various service islands.

In addition, the increasingly popular recovery of fuel vapors from automobile fuel tanks upon filling involves the transport of these vapors to the underground storage reservoir (Phase II recovery). These vapors are subsequently transported to a tanker truck during the next filling of the underground storage reservoir (Phase I recovery). Thus, additional extensive piping would need to be located underground for vapor recovery from the dispensing units located at multiple service islands.

It is also desirable for automobile service stations to provide customers with at least some limited form of shelter from the weather, especially from precipitation. Service stations commonly provide one or more large canopies that extend over a substantial portion of the service station premises, covering the multiple service island locations as well as an extended amount of area surrounding the dispensing pumps. In this manner, service station customers are provided with the convenience of being able to stay dry while fueling, as well as while entering and exiting vehicles. Often, the canopy extends to provide a covered walkway to the service station attendant, who is commonly located within an adjacent service building, such as an automobile service garage or convenience store.

The canopies are typically suspended in place at some distance above the ground through the use of multiple support columns. These columns are often positioned adjacent the dispensing units upon one or more service islands upon the service station premises. Positioning the canopy support columns in this manner allows maximum maneuverability for automobiles upon the service station premises.

Further, the recent increased emphasis on environmental concerns has focused attention on the nature of, and environment surrounding, the underground storage reservoirs to minimize the leaking of fluids stored therein. A majority of conventional steel underground storage tanks are believed to leak due to electrolysis along the bottom of the tank. This is caused at least in part because the ground at the bottom of the tank is often wet and the weight of the tank and its contents cause solid contact with the soil, resulting in a condition that is favorable to the flow of electric current. Also, during such environmental events such as earthquakes and hurricanes, shifting of the underground storage reservoir, the pea gravel, sand or other fill material surrounding the tank, or introduction of excessive amounts of water to the area surrounding the tank, can each have negative effects on the tank, including leakage of the tank itself and leakage from the fluid delivery system due to disruption of the alignment of the delivery system relative to the reservoir.

A need therefore exists for an improved system whereby the need for extensive underground piping connecting underground fluid storage tanks and dispensing units can be eliminated. A need also exists for a simpler vapor recovery system for use in automobile service stations. A need also exists for an improved, simpler, less expensive system for constructing service station premises. A need further exists for an improved underground storage reservoir system having increased leak resistance, as well as increased resistance to the effects of earthquakes and hurricanes.

SUMMARY OF THE INVENTION

The present invention therefore provides an integrated underground storage reservoir and above-ground canopy system. The system includes a storage reservoir suitable for being buried beneath ground level and suitable for containing a fluid. The system also includes a support system including at least one support member that is disposed in communication with, or adjacent to, the reservoir and projects above ground level. Each support member is operable to support one or more canopies for providing shelter from the weather while accessing the reservoir.

More specifically, the integrated system of the present invention comprises an underground storage reservoir for the storage of fuel, such as automobile fuel or heating fuel. The integrated system further includes a support system including at least one support unit disposed in communication with the underground storage tank. In one preferred embodiment, a plurality of support units are disposed in contact with the underground storage reservoir and extend above ground level in a substantially vertical orientation. The present invention may include one or more underground storage reservoirs, any of which may be partitioned to hold more than one type or grade of fluid. In another preferred embodiment, the support system includes multiple support units disposed adjacent to the underground storage tank. The support units are preferably oriented in a generally vertical direction and protrude above the ground level. Thus, the support units are able to support at least one canopy for sheltering the dispensing unit area from weather while accessing the underground storage reservoir or reservoirs.

The present invention also includes a delivery system for delivery of the fluid from within the underground reservoir to above-ground level. Preferably, this includes one or more pipes disposed within the reservoir, which extend in a substantially vertical orientation to an above-ground location directly above the reservoir. The delivery system may also include one or more submersible pumps for delivering fluid from the reservoir to an above-ground location.

The present invention further includes a distribution system for the distribution of fluid from the delivery system. The distribution system may preferably include one or more distribution heads, each located in above-ground communication with one of the submersible pumps. The distribution system also preferably includes a piping network that extends from the distribution heads to one or more dispensing units on an above-ground or below-ground basis. Most preferably, the piping network is constructed to connect the various distribution units among one or more service islands by being routed through one or more of the canopies, described in more detail below. This piping network may therefore travel vertically from the distribution head or heads to a canopy along the external surfaces of the dispensing units, along the internal surfaces of the dispensing units, or along the support units. The above-ground nature of the distribution system allows easy access for service and maintenance purposes.

The present invention also provides an improved storage reservoir assembly having increased resistance to leakage of fluid from the assembly into the ground. The assembly includes a reservoir suitable for being buried beneath ground level and for containing a fluid and an enclosure suitable for partially surrounding the reservoir and supporting the reservoir from beneath. The enclosure is spaced from the reservoir so as to define a void between the reservoir and the enclosure. The void is filled with a filling material suitable for decreasing leakage of fluid into the ground and/or assisting maintaining the buried condition of the reservoir within the ground. The improved storage reservoir assembly preferably further includes at least one support unit connected to the reservoir and suitable for attachment to an above-ground canopy.

It will be appreciated that the present invention is also intended to include those features commonly associated with automobile service stations and fuel delivery stations, as are required for convenience and/or safety. Many of these features, such as venting and vapor recovery provisions, are provided in improved form in accordance with the present invention. While the description herein is intended to emphasize those features of the present invention that are advantages over the prior art, it is not intended to exclude other convenience and/or safety features.

An advantage of the present invention is to provide an integrated system whereby one or more underground storage tanks are located directly beneath an associated delivery and distribution system, thereby minimizing the amount of underground piping network that must be accessed for service and/or maintenance.

Another advantage of the present invention is to provide a integrated system whereby a fluid distribution system is located above ground level, to allow servicing and/or maintenance of the distribution system.

Another advantage of the present invention is to provide a simpler, less expensive system for providing an underground storage reservoir that can be accessed for both delivery and withdrawal while being protected from the weather.

Another advantage of the present invention is to reduce pollution by providing for the recovery of vapors from automobile fuel tanks and from underground storage reservoirs in a manner that is convenient, less expensive, requires a minimum amount of associated underground piping and includes above-ground equipment.

Another advantage of the present invention is to provide an integrated support system for the support of one or more canopies to shelter the accessing of an underground storage reservoir from weather, wherein the support system is disposed in communication with, or adjacent to, the underground storage reservoir.

Another advantage of the present invention is to provide an improved storage reservoir assembly having increased resistance to leakage of fluid from the assembly into the ground, due to both the local environment of the storage reservoir and the effects of environmental events such as earthquakes and hurricanes.

BRIEF DESCRIPTION OF THE DRAWINGS

Other advantages of the present invention will become apparent to one skilled in the art upon reading the following specification and the following drawings.

DETAILED DESCRIPTION OF VARIOUS EMBODIMENTS

It should be understood that while this invention is described in connection with particular examples, the scope of the invention need not be so limited. Rather, those skilled in the art will appreciate that the following teachings can be used in a much wider variety of applications than the examples specifically mentioned herein.

Figure 1:
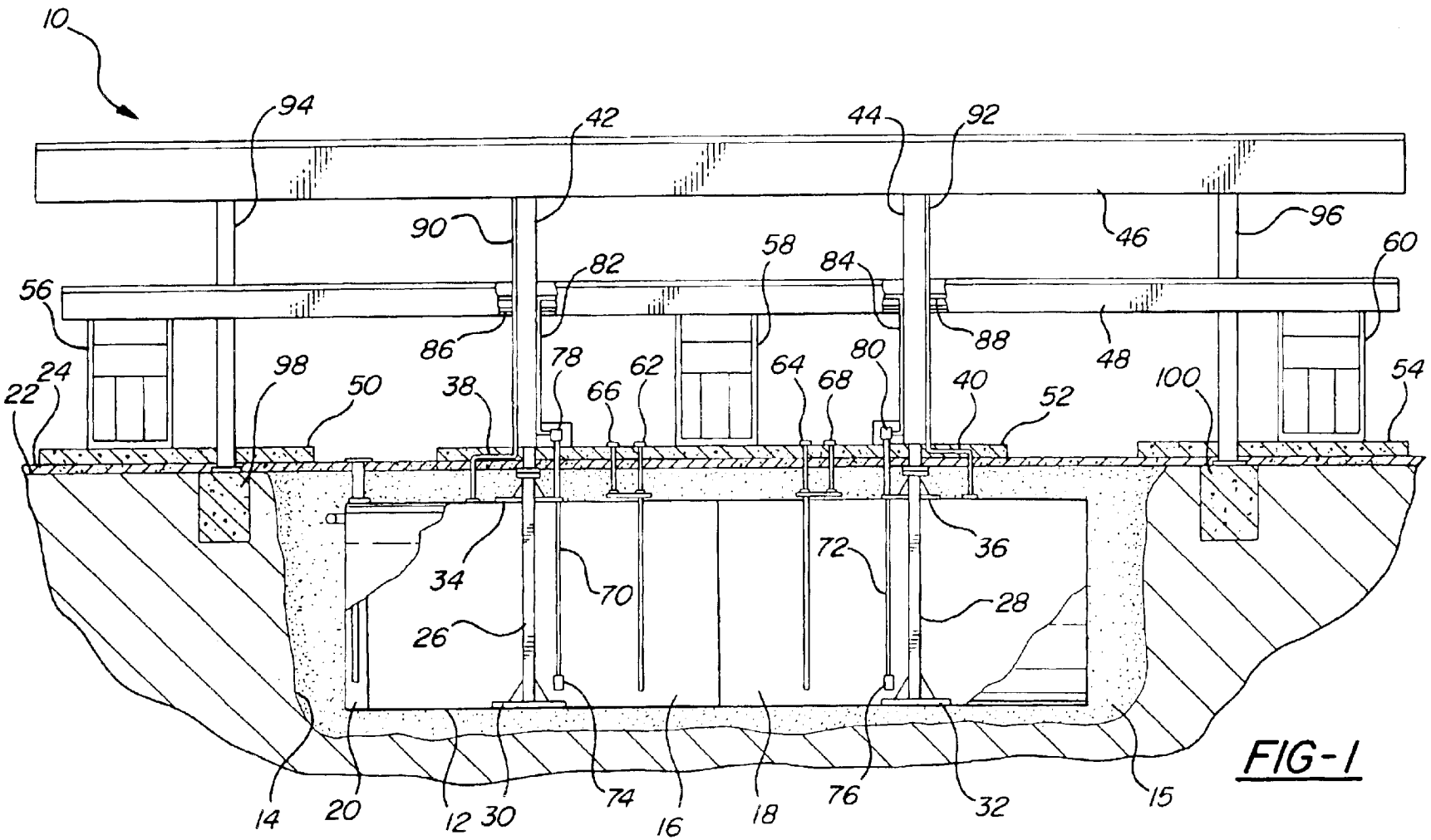
FIG. 1 is a partial cross-sectional view illustrating an integrated underground storage reservoir and canopy support system according to the teachings of a preferred embodiment of the present invention.

Referring now to FIG. 1, there is shown an integrated underground storage reservoir and above-ground canopy support system, generally at 10. The integrated system 10 includes a storage reservoir 12, of the type suitable for being buried below the ground surface, such as in an excavated pit 14. The storage reservoir 12 is suitable for the storage of a fluid, such as automobile fuel, heating fuel or any other type of fluid for which it is advantageous for the fluid to be located underground. The storage reservoir 12 may be of any suitable construction and may be of any suitable size and shape. The storage reservoir 12 shown in FIG. 1 is a 30,000 gallon tank, although it will be realized that any suitable size may be used without departing from the principles of the present invention.

The remainder of the volume within the excavated pit 14 that is not taken by the storage reservoir 12 is preferably filled with a material suitable for supporting the storage reservoir 12, while allowing for drainage around the storage reservoir 12 to occur. Preferably, the backfill material used is pea gravel 15, due to its ability to pack and exhibit a minimum of settling. It will be appreciated that other materials, such as sand, may also be used.

The storage reservoir 12 may be of a single-compartment or a multi-compartment design. In the embodiment shown in FIG. 1, the storage reservoir 12 is provided to include two compartments, namely, a first compartment 16 and a second compartment 18. These two compartments are disposed horizontally relative to each other, although it will be realized that any suitable compartment arrangement may also be used. Multi-compartment designs for the storage reservoir 12 may be utilized for the storage of multiple grades of automobile fuel, as is commonly done at gasoline service stations. The storage reservoir 12 may also typically include an oil-water separator 20, of a size and at a location suitable for achieving the desired separation effect.

The storage reservoir 12 is preferably located substantially completely beneath the ground surface, designated by the numeral 22. In the embodiment shown in FIG. 1, representative of a automobile service station, a concrete driveway 24 is commonly located upon the ground surface 22 over a substantial surface area of the service station premises.

The integrated system 10 also includes a support system that is disposed in communication with, or adjacent to, the storage reservoir 12. The support system is suitable for projecting above the ground level when the reservoir is in a buried condition within the ground. In the embodiment shown in FIG. 1, the support system includes a first support unit 26 and a second support unit 28. As shown in FIG. 1, the first and second support units 26 and 28 extend within, and are supported in part by, the storage reservoir 12. In one preferred embodiment, these support units are attached directly to the surfaces of the storage reservoir 12. As shown in FIG. 1, the first and second support units 26 and 28 are attached directly to the lower interior surface of the storage reservoir 12 through the use of bearing plates 30 and 32. The bearing plates 30 and 32 are attached to the surface of the storage reservoir 12 through a suitable method such as welding. In similar manner, the first and second support units 26 and 28 are also attached directly to the upper exterior surface of the storage reservoir 12, through the use of bearing plates 34 and 36. These bearing plates are also attached directly to the surface of the storage reservoir 12 by any suitable means, such as by welding. It will be appreciated that the first and second support units 26 and 28 may be attached to the surfaces of the storage reservoir 12 through any suitable means, and at locations other than those described in connection with FIG. 1.

The first and second support units 26 and 28 are also shown to include canopy support platforms 38 and 40 disposed at or about ground level. These canopy support platforms assist in stabilizing the upper portions of the first and second support units 26 and 28, as well as the canopy structure which will be described in greater detail below. As shown in FIG. 1, the first support unit 26 and the second support unit 28 extend above the ground surface 22 over a distance sufficient for supporting one or more canopy units at the desired height. Although the first and second support units 26 and 28 are shown to be of a generally vertical configuration, it will be realized that these support units may take on any suitable construction and configuration that may be suitable for achieving the desired support. The above-ground portions of the first and second support units 26 and 28 may optionally be covered in any suitable way, to provide an aesthetic appearance for the support units. As shown in FIG. 1, the first support shroud 42 and second support shroud 44 cover the first and second support units 26 and 28, respectively. These shrouds may also be suitable for concealing any piping networks or venting apparatus that accompany the components of the integrated system 10 as described herein. One example of such a piping system is shown in U.S. Pat. No. 5,244,307, entitled "Anti-pollution Piping and Dispensing System", issued to the present inventor, and incorporated by reference herein.

With reference still to FIG. 1, the first support unit 26 and second support unit 28 of the integrated system 10 are operable for supporting at least one canopy for providing shelter from the weather while accessing the storage reservoir 12. In the embodiment shown in FIG. 1, the support units 26 and 28 operate to support two canopies, namely, a primary canopy 46 and a secondary canopy 48. The primary canopy 46 is typically large enough to provide shelter for service station customers accessing the storage reservoir 12 from any of the service islands 50, 52 or 54. The primary canopy 46 is also typically large enough to shelter vehicles parked adjacent the service islands. In this arrangement, service station customers can exit and enter their vehicles within the protection of the canopy. Extended coverage for the primary canopy 46 is also advantageous because it still allows the primary canopy 46 to provide shelter from wind-blown precipitation. Further, the primary canopy 46 may extend to provide a covered walkway for customers from the service islands 50, 52 and 54 to the location of the service station attendant, which may be inside an adjacent service garage or convenience store located upon the service station premises. The primary canopy 46 is preferably located at a height above the ground surface 22 so as to allow tall vehicles, such as trucks, to be positioned beneath the primary canopy 46.

In the preferred embodiment shown in FIG. 1, a secondary canopy 48 is also provided. The secondary canopy 48 may preferably be of a size smaller than that of the primary canopy 46. As shown in FIG. 1, the secondary canopy 48 is of a length less than that of the primary canopy 46. In addition, the secondary canopy 48 is constructed of a width similar to that of any of the dispensing units 56, 58 and 60 located upon the service islands 50, 52 and 54. This positioning of the secondary canopy 48 allows the piping network associated with the distribution system to be located within the secondary canopy 48, as will be described in greater detail below. It will be appreciated that this arrangement for the primary canopy 46 and the secondary canopy 48 is only one of many suitable arrangements. For example, the primary canopy 46 can also contain piping associated with the distribution system.

The service islands 50, 52 and 54 are typically provided on service station premises as a raised surface for the protection of the dispensing units 56, 58 and 60 from damage and moisture. However, it will be appreciated that in other embodiments, the service islands 50, 52 and 54 may be located along the same level as the concrete driveway 24. The dispensing units 56, 58 and 60 may be of any suitable type for the dispensing of fluid from the storage reservoir 12. In the embodiment shown in FIG. 1, the dispensing units 56, 58 and 60 are of a type commonly seen at automobile service stations for the dispensing of multiple grades of automobile fuel. As such, the dispensing units may include pumps which dispense fuel from within the storage reservoir 12.

One advantage of the integrated system 10 involves access to the components of the system at a single, sheltered location. As previously mentioned, this type of arrangement eliminates the need for extensive underground piping systems which are subject to service and/or maintenance. No underground piping is thus required in this system for feeding the dispensing units. Also as part of this arrangement, the storage reservoir 12 is shown to include at least one filling line located within the protection of the canopy. In the embodiment shown in FIG. 1, the storage reservoir 12 includes two filling lines 62 and 64 for filling the first compartment 16 and the second compartment 18 of the storage reservoir 12. The storage reservoir 12 also includes vapor recovery ports 66 and 68, also associated with the first compartment 16 and the second compartment 18. The vapor recovery ports 66 and 68 are typical in the automobile fuel industry for allowing the recovery of fuel vapors (a Phase I recovery) from within the storage reservoir 12 when the storage reservoir 12 is filled. Thus, another advantage of the present invention is the ability of the integrated system 10 to provide enhanced pollution control through minimum piping for vapor recovery as well.

The integrated system 10 also includes a delivery system for the delivery of fluid from within the storage reservoir 12 to an above-ground location. In the embodiment shown in FIG. 1, the delivery system includes discharge lines 70 and 72 with associated submersible pumps 74 and 76. Automobile fuel stored within the first compartment 16 and the second compartment 18 is pumped by the submersible pumps 74 and 76 through the discharge lines 70 and 72 to the distribution heads 78 and 80. For convenience, the distribution heads 78 and 80 are shown to be located atop the service island 52, near the filling lines 62 and 64. In such an arrangement, the operating equipment of the integrated system 10 is centrally located for convenient access. Alternatively, it will be appreciated that any suitable location for the filling lines, the vapor recovery ports and the components of the delivery system may be used. For example, the distribution heads 78 and 80 may be located within the primary canopy 46 or the secondary canopy 48. This type of arrangement removes the distribution heads from upon the service islands, for enhancing appearance of the integrated system 10 as a whole. It will be appreciated that this, and any other alternate arrangements, are available for any of the embodiments described herein.

The integrated system 10 also includes a distribution system for the distribution of fluid from the storage reservoir 12 that is brought to the surface by the delivery system. The purpose of the distribution system, therefore, is to distribute fluid from the storage reservoir 12 as may be required through an above-ground arrangement. One advantage of the distribution system of the present invention is that it provides above-ground piping networks that can be easily serviced and maintained as necessary, without excavation of underground piping networks in previous systems. The distribution system is shown to include distribution lines 82, 84, 86 and 88. These distribution lines provide means for the transport of fuel from the distribution heads 78 and 80 to the dispensing units 56, 58 and 60. In the embodiment shown in FIG. 1, the distribution lines 82 and 84 travel in a generally vertical direction upon the first support unit 26 and second support unit 28 to the secondary canopy 48. The distribution lines 86 and 88 are connected to the distribution lines 82 and 84 and allow for the transport of fuel to the dispensing units 56, 58 and 60. As shown in FIG. 1, the distribution lines 86 and 88 are located within the secondary canopy 48. It will be realized that in alternative embodiments, any suitable above-ground arrangement for the distribution lines may be used, including locating these lines at least in part within the primary canopy. The secondary canopy 48 may be of sufficient size to allow the distribution system to reach other service islands. Alternatively, the secondary canopy may only be of a size sufficient for the distribution system to be routed to other service islands in a single row. In such a situation, the lines of the distribution system for feeding other service islands disposed in adjacent rows can be placed within the primary canopy 46. In yet another embodiment, where the secondary canopy is discontinuous along a single row of service islands, the piping of the distribution system is also routed through the primary canopy 46.

The distribution system also includes vents 90 and 92 which provide an air source for the storage tank 12 when fluid is withdrawn from the storage reservoir 12. The vents 90 and 92 typically each include a check valve (not shown) so that vapors from within the storage reservoir 12 are not vented to the atmosphere.

The integrated system 10 may also include additional support units for maintaining the support of large primary and/or secondary canopies relative to the ground. In the embodiment shown in FIG. 1, the integrated system 10 includes auxiliary support units 94 and 96 disposed adjacent the service islands 50 and 54. The auxiliary support units 94 and 96 are anchored by concrete footings 98 and 100 for stabilization purposes. It will be appreciated that the auxiliary support units may be disposed at any location suitable for supporting the primary and/or secondary canopies, and may also be anchored or otherwise supported in any suitable way for achieving the desired support.

Figure 2:
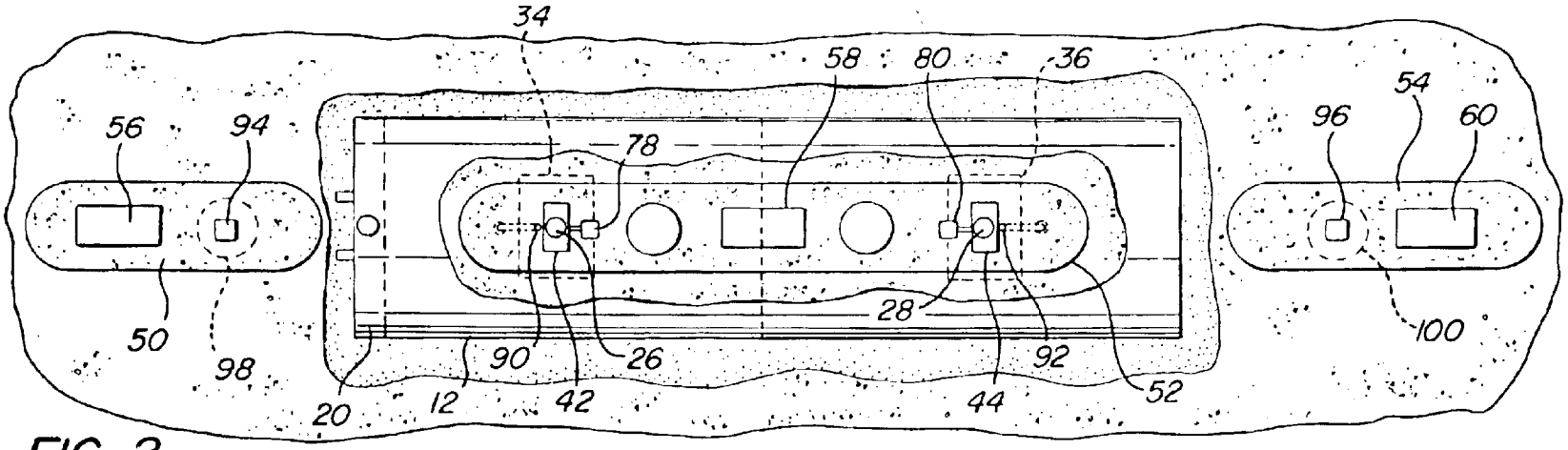
FIG. 2 is a plan view of the underground storage reservoir, and canopy support system shown in FIG. 1.

Referring now to FIG. 2, there is shown a plan view of the embodiment shown in FIG. 1. From this perspective, the relationship between the underground storage reservoir 12 and the service islands 50, 52 and 54 is shown. This view illustrates the convenience of the integrated system 10 of the present invention. As can be seen in FIG. 2, all of the primary components of the integrated system 10 are located in a convenient, central and sheltered location, with a minimum of piping located beneath ground level.

Figure 3:
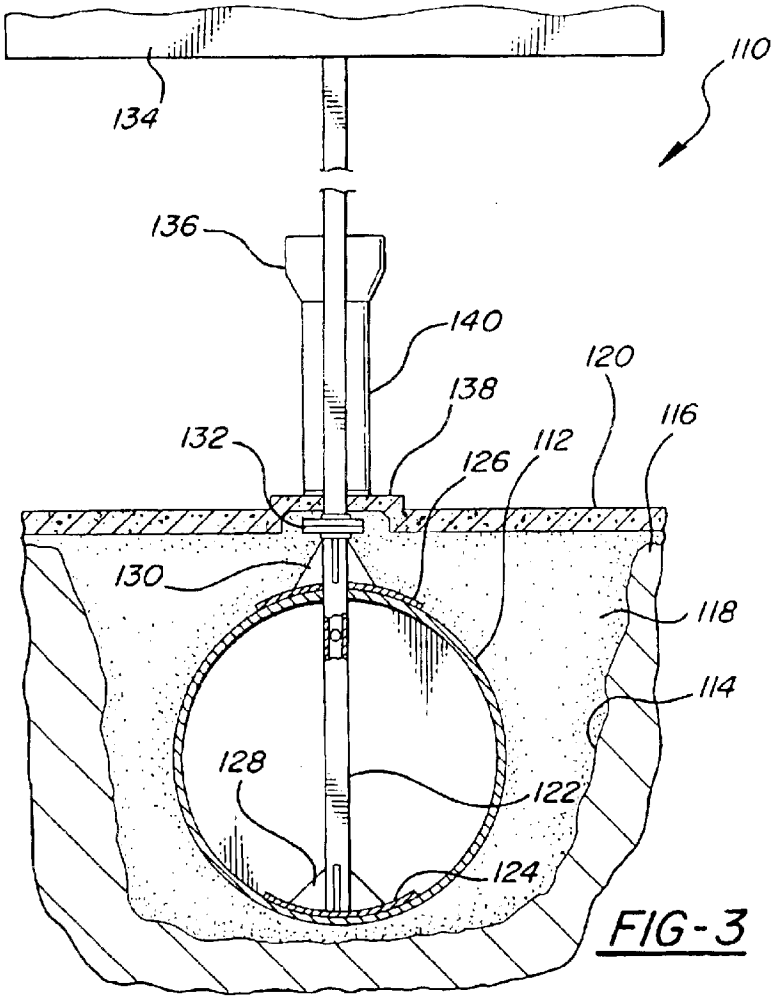
FIG. 3 is a cross-sectional view illustrating an underground storage reservoir having a support unit disposed therewithin for supporting a canopy, according to the teachings of a preferred embodiment of the present invention.

Referring now to FIG. 3, there is shown a cross-sectional view of an integrated system 110 according to a preferred embodiment of the present invention. The integrated system 110 is similar in many respects to the integrated system 10 shown in connection with FIGS. 1 and 2. The integrated system 110 is shown to include a storage reservoir 112. In this embodiment, the storage reservoir 112 is shown to be of a substantially circular cross-section, although it will be appreciated that any suitable shape or size may be used. The storage reservoir 112 is substantially buried within an excavated pit 114 located below the ground surface 116, in similar manner as before. The remainder of the volume within the excavated pit 114 that is not taken by the storage reservoir 112 is preferably filled with a material suitable for supporting the storage reservoir 112, while allowing for drainage around the storage reservoir 112 to occur. In the embodiment shown in FIG. 3, pea gravel 118 surrounds the storage reservoir 112 within the excavated pit 114. In similar manner as before, a concrete driveway 120 is disposed above the ground surface 116 in the embodiment shown in FIG. 3, indicative of a service station premises.

The integrated system 110 is shown to include a support unit 122, disposed in a substantially vertical direction, within the storage reservoir 112, and projecting above the ground surface 116, in similar manner as before. The support unit 122 includes means for engaging the storage reservoir 112. In the embodiment shown in FIG. 3, this is provided as a lower bearing plate 124 having a substantially circular cross-section to match the lower interior surface of the storage reservoir 112. Accordingly, the lower bearing plate 124 is preferably attached to the interior lower surface of the storage reservoir 112, through means such as welding. The support unit 122 is also shown to include an upper bearing plate 126, also having a substantially circular cross-section. The upper bearing plate 126 is attached to the upper exterior surface of the storage reservoir 112, such as by welding or the like. The lower bearing plate 124 and the upper bearing plate 126 are shown to include gussets 128 and 130 for providing reinforcement between the support unit 122 and the lower and upper bearing plates 124 and 126. It will be appreciated that any suitable support structure may be used to reinforce the connection between the support unit 122 and the lower and upper bearing plates 124 and 126.

The support unit 122 is shown to include a canopy support platform 132, for stabilization purposes, in similar manner as before. The integrated system 110 includes a primary canopy 134 and a secondary canopy 136, each of which are supported at least in part by the support unit 122. The support unit 122 is shown to pass through a service island 138, which assists in its support. A dispensing unit 140 is located atop the service island 138 for dispensing fluid from within the storage reservoir 112. In similar manner as before, the secondary canopy 136 may include the piping elements of the dispensing system (not shown), as previously described.

Figure 4:
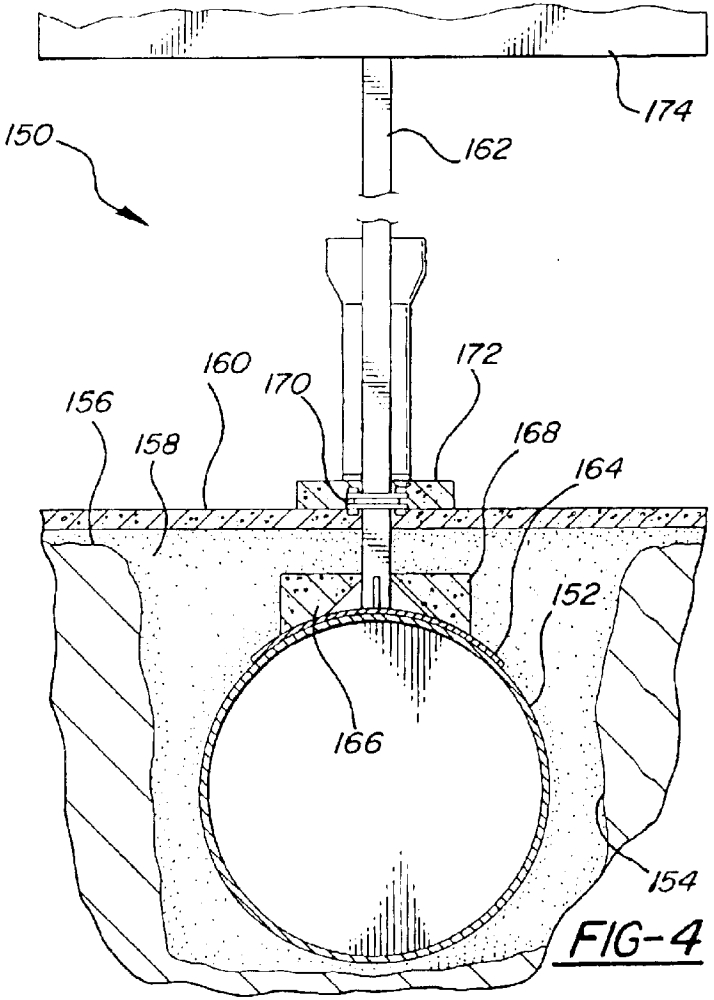
FIG. 4 is a cross-sectional view of an underground storage reservoir and a support unit disposed in communication therewith, for supporting an above-ground canopy, according to the teachings of another preferred embodiment of the present invention.

With reference now to FIG. 4, there is shown another preferred embodiment of the present invention in cross-section. An integrated system 150 is provided in similar form to the integrated systems previously described. In this arrangement, a storage reservoir 152 is located within an excavated pit 154 below the ground surface 156. Pea gravel 158 surrounds the storage reservoir 152, and a concrete driveway 160 is disposed above the ground surface 156 in similar manner as before.

In this arrangement, however, a support unit 162 is provided, which does not extend through the storage reservoir 152. Instead, the support unit 162 is attached to the upper exterior surface of the storage reservoir 152 and is reinforced for stability. The support unit 162 includes an upper bearing plate 164, that is of substantially circular cross-section for substantially matching the upper surface of the storage reservoir 152. In similar manner as before, gussets 166 are used to reinforce the connection between the support unit 162 and the upper bearing plate 164. The upper bearing plate 164 may preferably be attached to the storage reservoir 152 by welding or other suitable method. To provide reinforcement between the support unit 162, the storage reservoir 152, the gussets 166 and the surrounding pea gravel 158, a concrete footing 168 is provided. The concrete footing is applied to substantially surround the connection between the support unit 162 and the storage reservoir 152. In such an arrangement, the concrete footing 168 provides an anchor for the support unit 162 and also stabilizes the support unit 162 within the pea gravel 158.

The support unit 162 is further shown to include a canopy support platform 170, in similar manner as before. The canopy support platform 170 is located at approximately the same level as the service island 172, also in similar manner as before. In this arrangement, a single canopy, designated by the numeral 174, is suspended above the ground surface 156 by the support unit 162.

Figure 5:
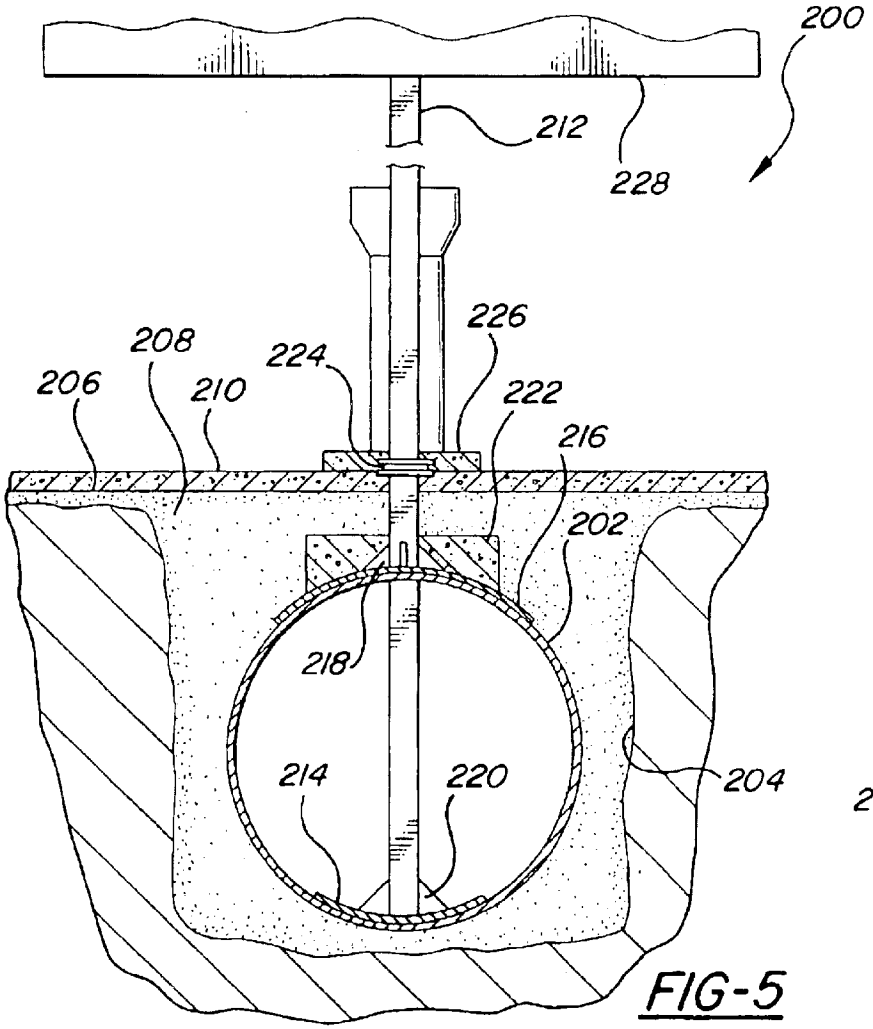
FIG. 5 is a cross-sectional view illustrating an underground storage reservoir with a support unit disposed therethrough, for supporting an above-ground canopy, according to the teachings of another preferred embodiment of the present invention.

Another preferred embodiment of the present invention is provided in FIG. 5. This FIG. shows the concrete reinforcement arrangement of FIG. 4, with the extension of the support unit through the storage reservoir, as in FIG. 3. More specifically, FIG. 5 shows an integrated system 200, including a storage reservoir 202 buried within an excavated pit 204 below the ground surface 206, and surrounded by pea gravel 208, as before. A concrete driveway 210, indicative of a service station premises, is also shown. In this arrangement, however, the support unit 212 extends through the interior of the storage reservoir 202. As such, the support unit 212 includes a lower bearing plate 214 that is attached to the lower internal surface of the storage reservoir 202 by welding or the like. An upper bearing plate 216 is attached to the upper external surface of the storage reservoir 202, also in similar manner as before. Gussets 218 and 220 are provided for reinforcing the connection between the support unit 212 and the lower and upper bearing plates 214 and 216, as before. A concrete footing 222 is provided, in similar manner as is shown in FIG. 4, for stabilizing and for providing an anchor for the support unit 212.

It will therefore be appreciated that varying configurations may exist for the support units and any concrete footing that may be used for providing the desired stabilization and anchoring effect. It will also be appreciated that concrete footings may be provided at other locations as may be suitable or necessary to achieve any desired stabilization and/or anchoring. In addition, the concrete footing 222 may be increased in size and weight in order to provide greater stabilization in the arrangement where two canopies are used.

The support unit 212 shown in FIG. 5 includes a canopy support platform 224 that extends through a service island 226. The support unit 212 is shown to extend above the ground surface 206 for supporting a canopy 228. In this embodiment, a single canopy design is shown; however, it will be realized that a multiple canopy assembly can also be used.

Figure 7:
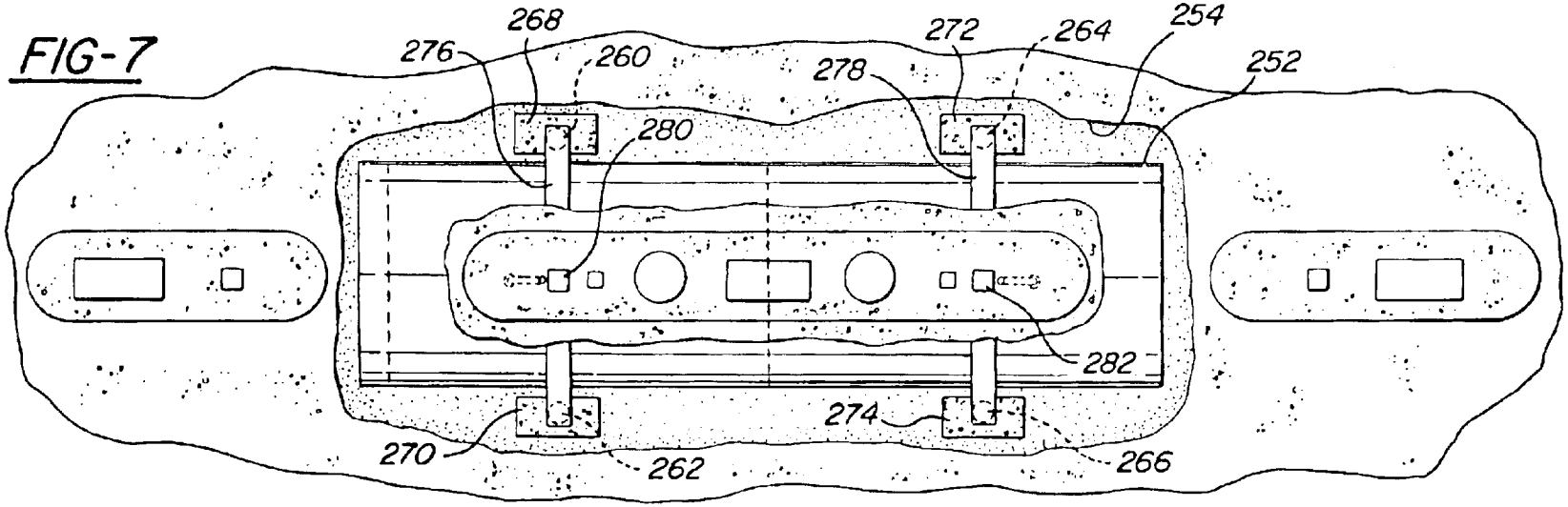
FIG. 7 is a plan view of the underground storage reservoir and support system shown in FIG. 6.
Figure 6:
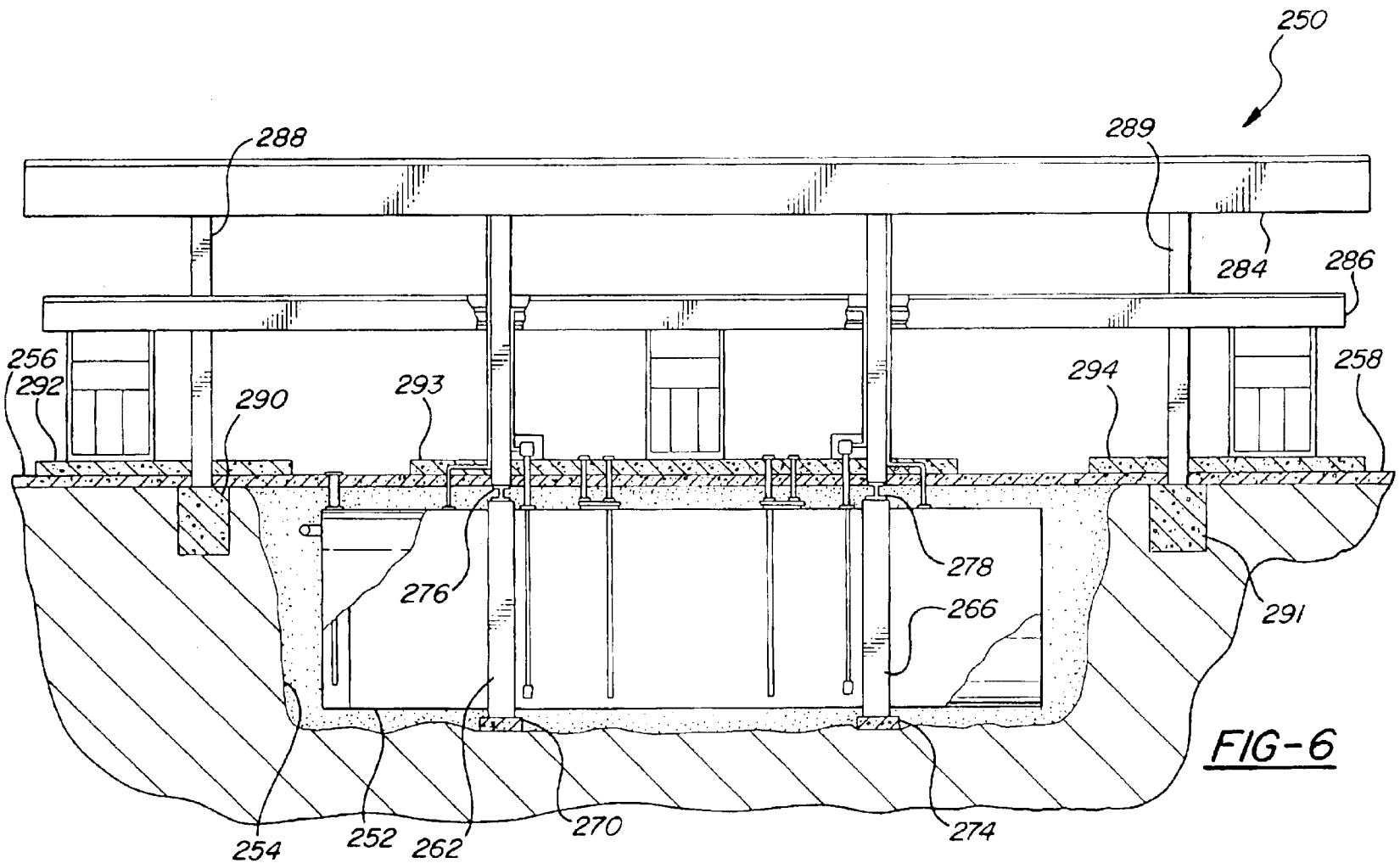
FIG. 6 is a partial cross-sectional view illustrating another preferred embodiment of the present invention, including an underground storage reservoir and a support system disposed adjacent thereto, for supporting a canopy.

Referring now to FIG. 6, there is shown an integrated system 250 in accordance with yet another preferred embodiment of the present invention. The integrated system 250 is shown to include a storage reservoir 252 located in an excavated pit 254 below the ground surface 256, with a concrete driveway 258 covering the ground surface 256, in similar manner as before. In this embodiment, however, the support system is disposed adjacent to the storage reservoir 252. As shown in FIGS. 6 and 7, the support system includes a plurality of support posts 260, 262, 264 and 266 disposed adjacent the storage reservoir 252. The support posts may preferably be of the type filled with concrete, and are anchored by concrete footings 268, 270, 272 and 274, located beneath the storage reservoir 252 at both sides. A pair of support beams 276 and 278 are disposed above the storage reservoir 252 and are supported by the support posts 260, 262, 264 and 266.

The support system shown in FIGS. 6 and 7 also includes support units 280 and 282. These support units are disposed upon the central portions of the support beams 276 and 278, and they project above the ground surface for supporting an above-ground canopy system. In this arrangement, a primary canopy 284 and a secondary canopy 286 are provided, in similar manner as in FIG. 1. Alternatively, it will be recognized that any suitable canopy arrangement may be used. The primary and secondary canopies are also supported by auxiliary support units 288 and 289, which are anchored by concrete footings 290 and 291, respectively, in a similar manner as described in connection with FIG. 1. Also in a similar manner, the support units 280 and 282 and the auxiliary support units 288 and 289 are secured in a substantially stationary position by being disposed within the concrete making up the service islands 292, 293 and 294.

The remaining components of the integrated system 250, including those comprising the delivery system, distribution system, dispensing units and venting system, are substantially similar to those components described in connection with FIG. 1. Therefore, they are not described in detail again here.

Figure 8:
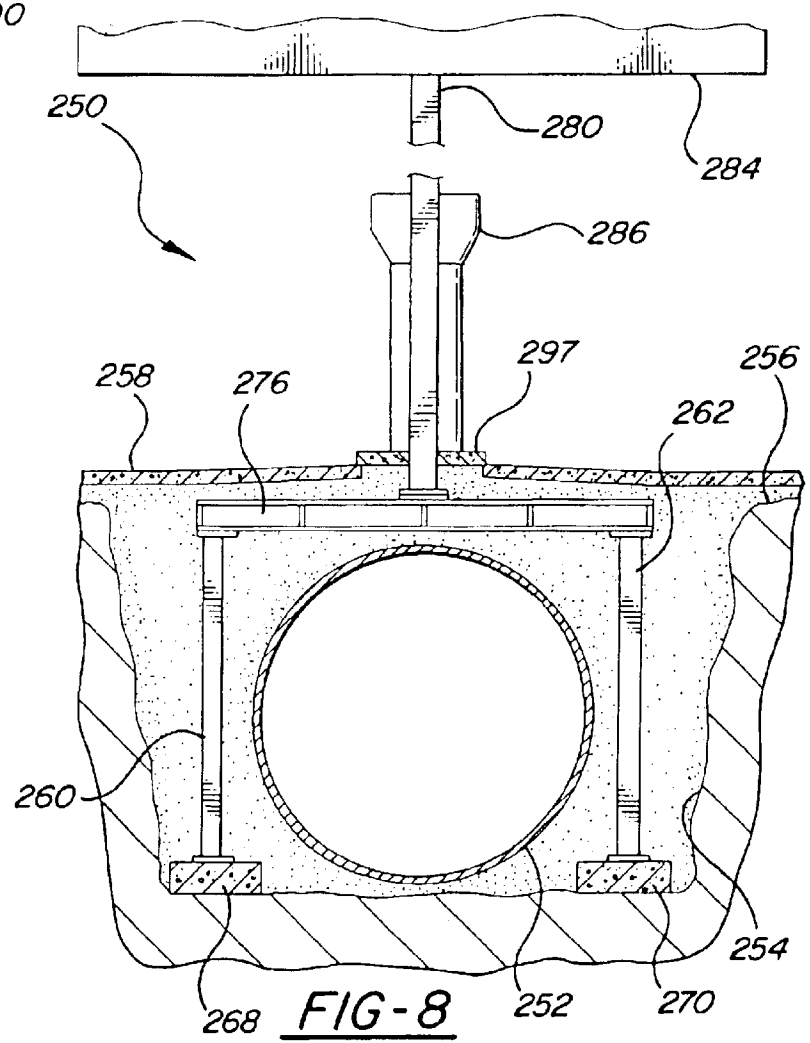
FIG. 8 is a cross-sectional view showing an underground storage reservoir and an adjacently disposed canopy support system, according to another preferred embodiment of the present invention.
Figure 10:
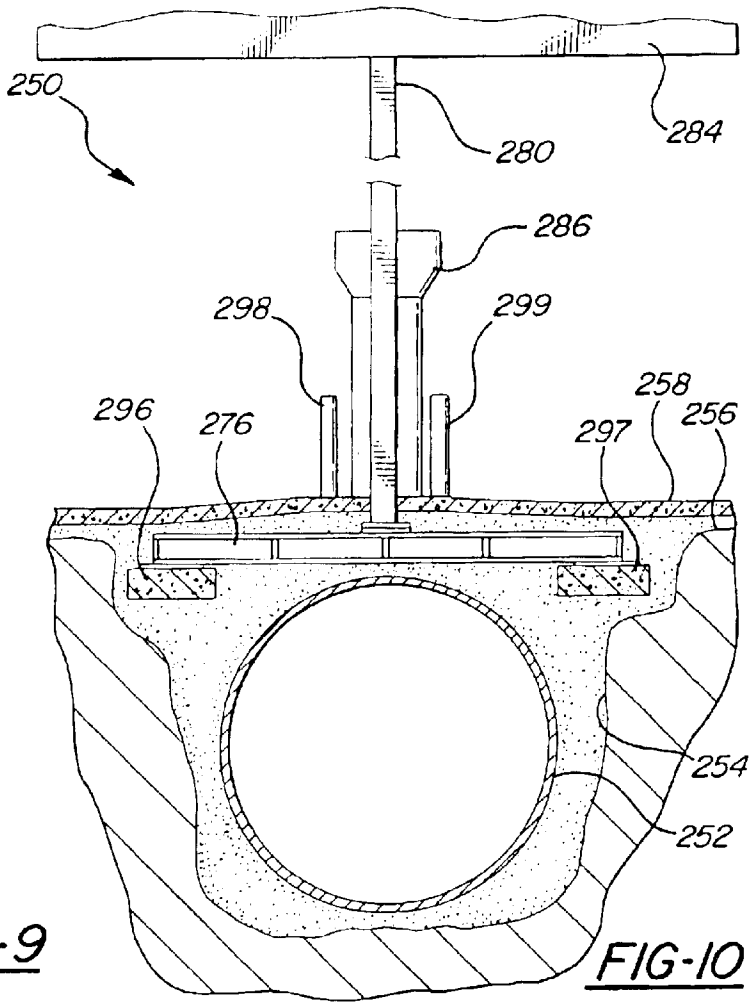
FIG. 10 is a cross-sectional view illustrating an underground storage reservoir and an adjacently disposed canopy support system according to yet another preferred embodiment of the present invention.
Figure 9:
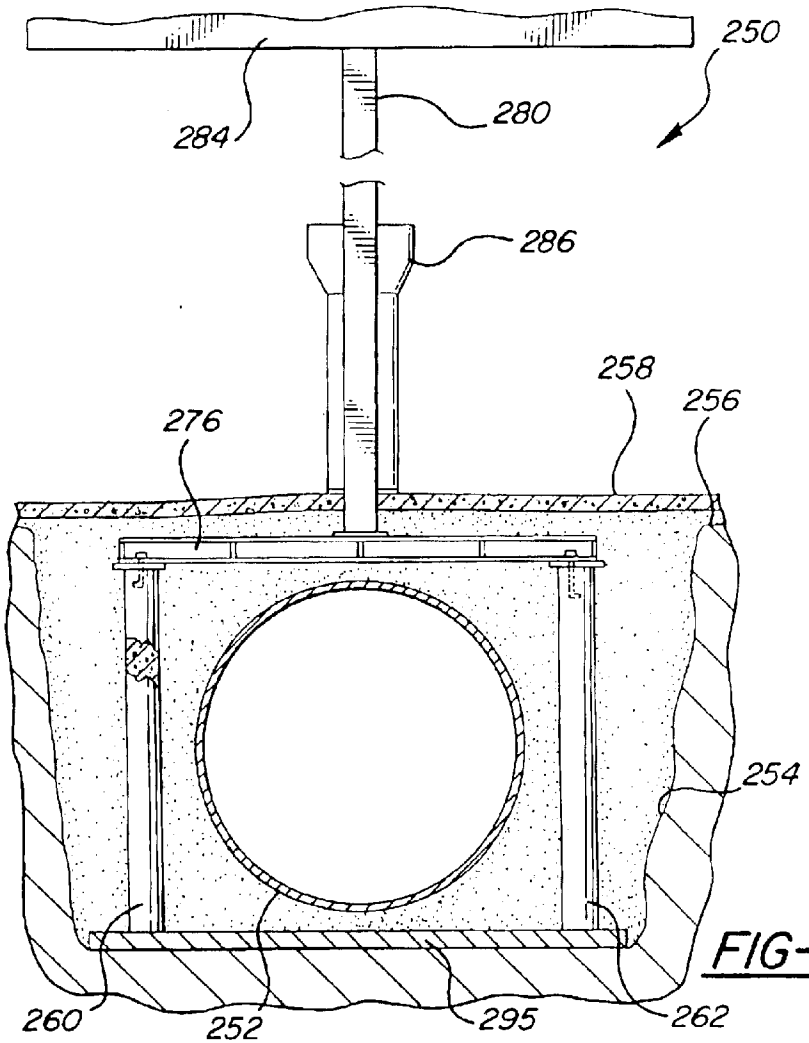
FIG. 9 is a cross-sectional view showing an underground storage reservoir and an adjacently disposed canopy support system, according to yet another preferred embodiment of the present invention.

With reference now to FIGS. 8, 9 and 10, there are shown three different embodiments of support systems, wherein each support system is disposed adjacent to, but substantially not in contact with, the underground storage reservoir. Since FIG. 8 shows a cross-sectional view including substantially the same components shown in FIGS. 6 and 7, like reference numerals will be used to describe these components in FIG. 8. FIG. 8 is shown to include an integrated system 250 having a storage reservoir 252 located within an excavated pit 254, with a concrete driveway 258, as previously described. Support posts 260 and 262 extend vertically above concrete footings 268 and 270 located at the bottom of the excavated pit 254. In this arrangement, the support posts 260 and 262 suspend the support beam 276 above the upper surface of the storage reservoir 252. Thus, a support system is created wherein the support system components are substantially free from contact with the storage reservoir 252. A support unit 280 is shown to project above the ground surface from the center of the support beam 276 for supporting the primary canopy 284 and secondary canopy 286. The service island 297 also provides additional support for the support unit 280.

Referring now to FIG. 9, a similar arrangement is shown for the support system. In this arrangement, however, the concrete footings 268 and 270 are replaced by a concrete slab 295 that is disposed at the floor of the excavated pit 254. This arrangement may provide additional support for the storage reservoir 252. In addition, FIG. 9 shows that the service islands are no longer in a raised condition above the concrete driveway 258.

Referring now to FIG. 10, there is shown another version of the integrated system 250. In this arrangement, the support beam 276 is supported directly by concrete footings 296 and 297, instead of by the support posts 260 and 262 described in connection with FIGS. 8 and 9. In addition, bumper guards 298 and 299 have been added to protect the support units and dispensing units from damage.

Figure 11:
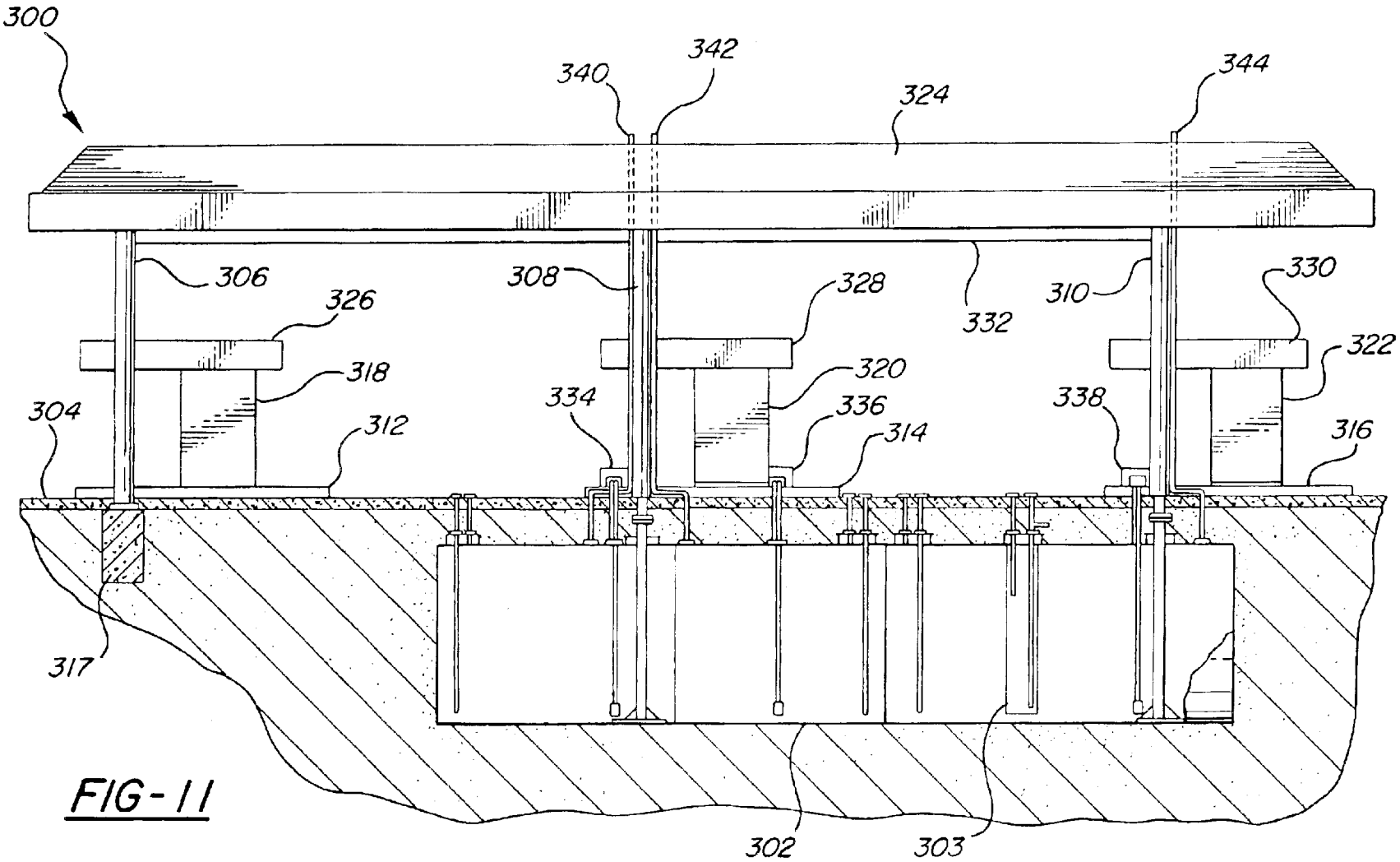
FIG. 11 is a cross-sectional view illustrating an underground storage reservoir and an adjacently disposed canopy support system according to yet another preferred embodiment of the present invention.

With reference now to FIG. 11, there is shown another preferred embodiment according to the present invention. FIG. 11 shows an integrated system generally at 300. The integrated system 300 includes a storage reservoir 302 that is buried beneath ground level, and includes an oil-water separator 303. A concrete driveway 304 is again shown. In this arrangement, however, the integrated system 300 includes support units 306, 308 and 310 that are anchored within service islands 312, 314 and 316, respectively, by concrete footing 317 and within the reservoir 302, as shown, in similar manner as before. Dispensing units 318, 320 and 322 are located upon the service islands 312, 314 and 316, respectively.

A primary canopy 324 is provided in this arrangement, while the secondary canopy present in the previously described embodiments is now divided into three secondary canopy sections, designated 326, 328 and 330. In this arrangement, a pipe race 332 is provided between the support units 306, 308 and 310 for containing the various lines of the distribution system, since the secondary canopy is of a discontinuous arrangement in this embodiment. Since the storage reservoir 302 is shown to be of a three-compartment design, three distribution heads 334, 336 and 338 are provided to access the three compartments. Accordingly, the distribution piping (not shown) may now be disposed within or upon the support units 306, 308 and 310 as well as through the pipe race 332. In this arrangement, fluid from the storage reservoir 302 is transported up to the primary canopy 324 and then down any of the respective support units for distribution to any of the dispensing units 318, 320 or 322. It will be appreciated, as before, that the piping of the distribution system may be disposed either within or upon the outside of the support units 306, 308 and 310. Suitable shrouds or other coverings may be desired to cover externally-located piping upon the support units to provide an aesthetic appearance. In addition, vents 340, 342 and 344 are provided for the individual compartments of the storage reservoir 302, as before.

Figure 12:
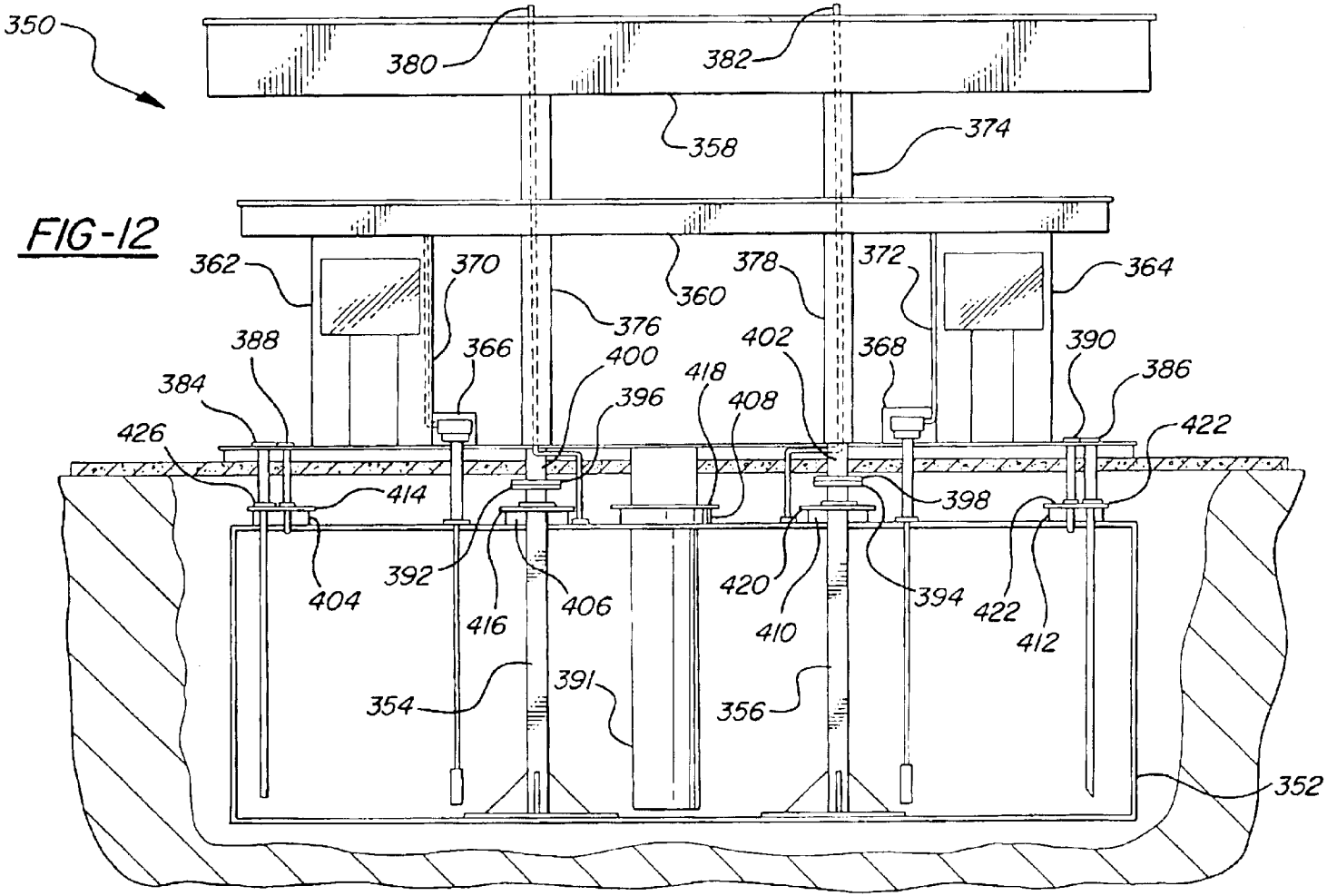
FIG. 12 is a cross-sectional view illustrating an underground storage reservoir and an canopy support system disposed in communication with the underground storage reservoir according to yet another preferred embodiment of the present invention.

Referring to FIG. 12, there is shown yet another preferred embodiment of the present invention. FIG. 12 shows an integrated system 350 including a storage reservoir 352, with support units 354 and 356 extending through the interior of the storage reservoir 352 and above ground level. The support units 354 and 356 support a primary canopy 358 and a secondary canopy 360. In this arrangement, however, the dispensing system is of a different configuration. The integrated system 350 includes a first dispensing unit 362 and a second dispensing unit 364, to which a first distribution head 366 and a second distribution head 368 are connected, to provide fluid from within the storage reservoir 352. The distribution heads 366 and 368 are located near the first and second dispensing units 362 and 364, so that the lines of the distribution system, namely, the first distribution line 370 and the second distribution line 372, can be disposed directly along the dispensing units. This arrangement provides an enhanced aesthetic appearance. As shown in FIG. 12, these distribution lines can be located either within or upon the exterior surface of the dispensing units. For example, the first distribution line 370 is disposed within the interior of the first dispensing unit 362, while the second distribution line 372 is disposed upon the exterior surface of the second dispensing unit 364. The distribution lines can then be routed through the secondary canopy 360 to distribute fluid from the storage reservoir 352 among multiple dispensing units connected by the same secondary canopy. In addition, this distribution system allows adjacent service islands to be connected through a distribution system that passes through the primary canopy 358. A third distribution line 374 is shown to be disposed between the secondary canopy 360 and the primary canopy 358 for this purpose.

In this embodiment, a first support shroud 376 and second support shroud 378 are disposed upon the above-ground portions of the support units 354 and 356 to provide an aesthetic appearance. The support shrouds, as used in any embodiment described herein, may contain any piping networks or venting apparatus. Accordingly, as shown in FIG. 12, vents 380 and 382 are disposed within the first and second support shrouds 376 and 378, to allow air to enter the storage reservoir 352 as it is emptied.

The embodiment shown in FIG. 12 also includes alternative arrangements for the filling lines 384 and 386 and accompanying vapor recovery ports 388 and 390. These are shown to be located laterally relative to the dispensing units, as opposed to the central location previously described. It will therefore be appreciated that the filling lines and vapor recovery ports can be located at any suitable position. The reservoir 352 is also shown to include an oil-water separator 391, as before.

The support units 354 and 356, like the support units described throughout, may preferably be provided as a two-piece assembly, wherein the portions designated 354 and 356 are the lower portions disposed within the storage reservoir 352. The support units 354 and 356 preferably include support covers 392 and 394, which are suitable for attachment by any suitable means, such as by welding, to the lower support platforms 396 and 398. The lower support platforms are preferably integrally formed with the remaining upper support portion of each two-piece support assembly, designated 400 and 402. It will be appreciated that this principle may apply to any of the embodiments described herein.

Another feature of the present invention that may apply to any embodiment described herein is the use of one or more manholes to provide access to the interior of the reservoir 352. In the embodiment shown in FIG. 12, five manholes are shown at 404, 406, 408, 410 and 412. The manholes may be covered by any suitable means, such as through covers 414, 416, 418, 420 and 422. The manhole covers are typically secured by bolting. Any of the manhole covers may include an attached porthole, such as that shown at 424, for direct access from above ground. The manholes allow for any repairs of the reservoir that may become necessary, and also provide a means for locating ports for the connection of the various distribution and venting lines to the reservoir 352. The manholes are typically from 18 to 36 inches diameter, depending upon the particular need. As may be the case for any embodiment shown herein, the various distribution and venting lines may preferably be connected to the reservoir 352 through a bunghole located upon the upper surface of the reservoir 352 or upon any of the manhole covers, such as that referenced at 426.

Figure 13:
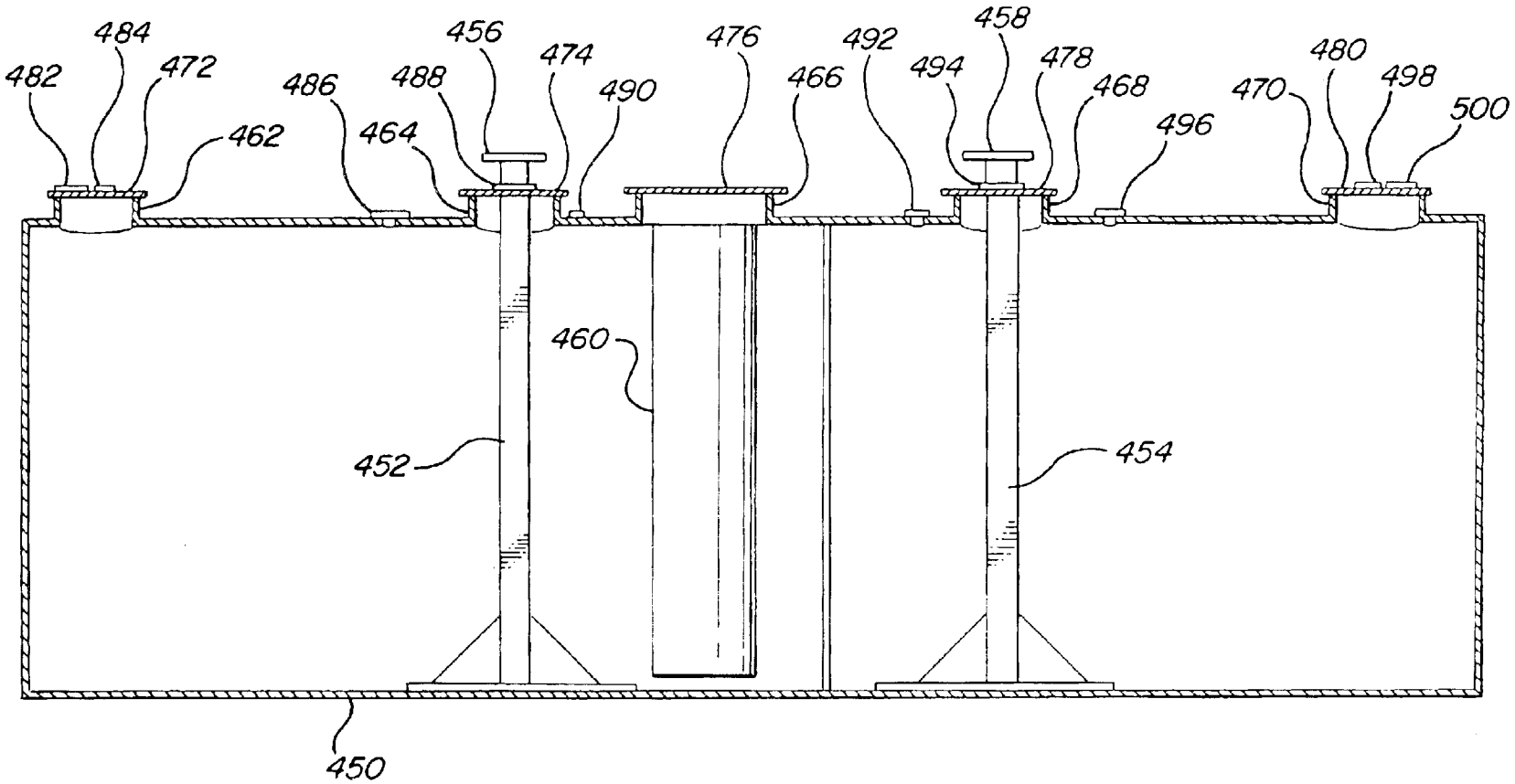
FIG. 13 is a cross-sectional view illustrating an underground storage reservoir in a pre-constructed form suitable for on-site installation below ground level.

Yet another preferred embodiment of the present invention is shown in FIG. 13. This figure shows a storage reservoir 450, which may be of the type shown in any of the embodiments previously described. The storage reservoir 450 is shown in the condition following manufacture, for delivery to a service station or other site for in-ground installation. Thus, the storage reservoir 450 can be provided in this condition, ready for installation in an excavated pit, and ready for the connection of all of the previously-described features of the integrated system at the locations provided.

To summarize, the storage reservoir 450 is provided with support units 452 and 454 which are preferably secured to the reservoir wall. The support units 452 and 454 include support covers 456 and 458, for the direct attachment of upper portions of the support units corresponding to the canopy system as previously described. The reservoir 450 includes an oil-water separator 460. Manholes are provided at 462, 464, 466, 468 and 470, for accessing the interior of the reservoir 450. Manhole covers are provided at 472, 474, 476, 478 and 480, for substantially closing the manholes. In addition, multiple bungholes are provided at 482, 484, 486, 490, 492, 496, 498 and 500, for the connection of the various support units, dispensing and venting lines and filling and vapor recovery lines. Welds are also provided at 488 and 494 for enhancing the engagement of the support units 452 and 454 with the manhole covers 474 and 478.

Figure 14:
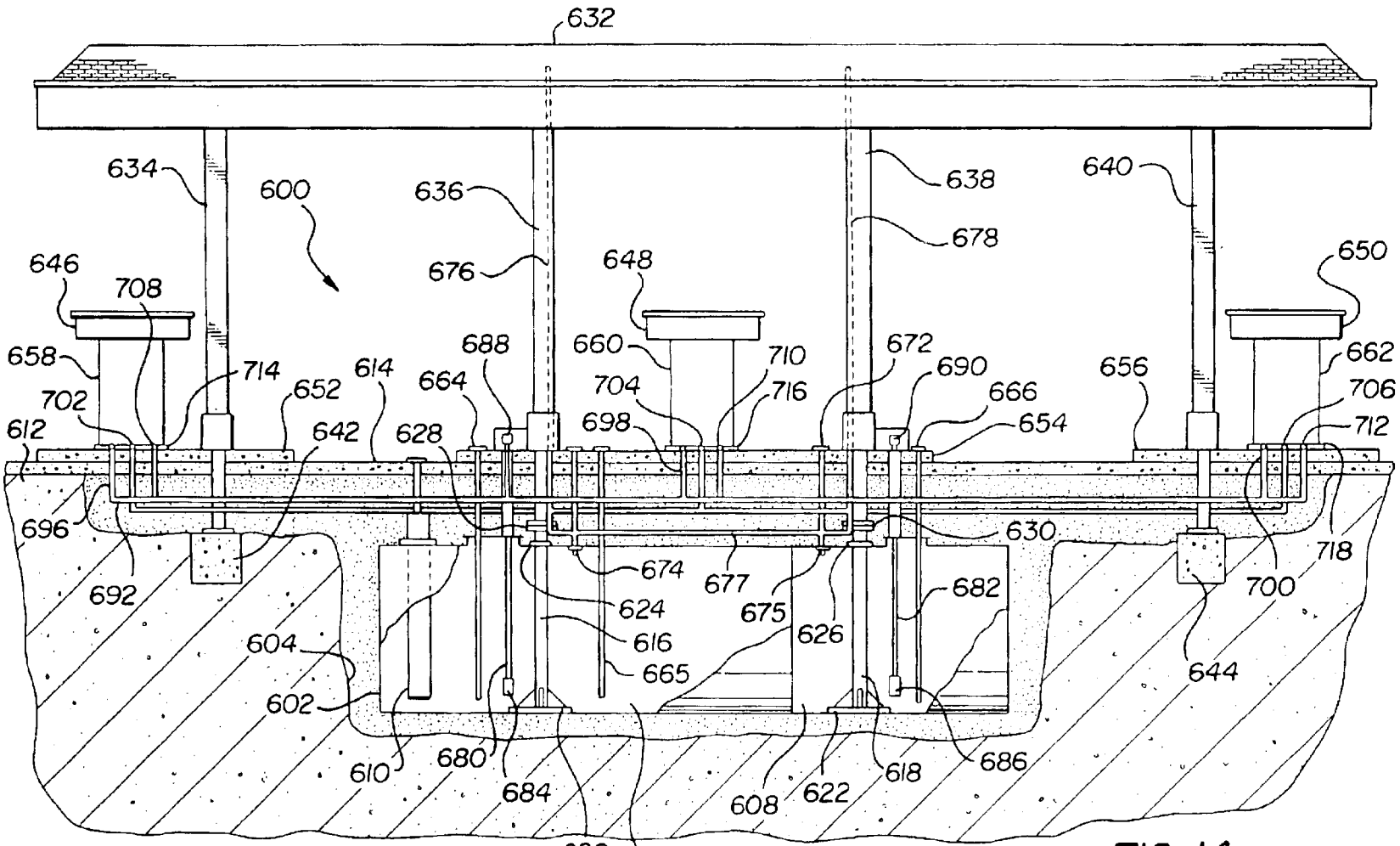
FIG. 14 is a partial cross-sectional view illustrating an integrated underground storage reservoir and canopy support system, which includes a beneath ground level distribution piping network.
Figure 15:
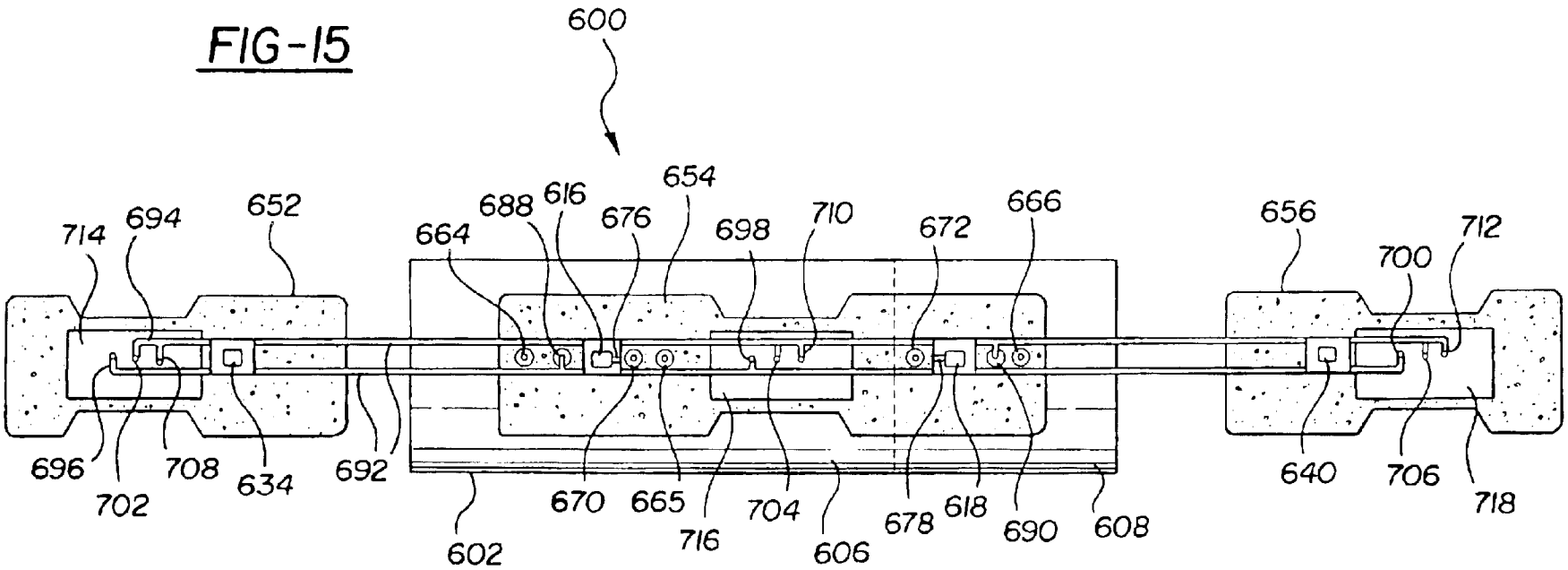
FIG. 15 is a plan view of the underground storage reservoir and canopy support system shown in FIG. 14.

Yet another preferred embodiment of the present invention is shown in partial cross-sectional view and in plan view, in FIGS. 14 and 15, respectively. These figures show a distribution system and recovery system that is located at a shallow depth beneath ground level, yet provides a minimum of piping due to its location and configuration within the integrated system. This arrangement is intended to provide maximum serviceability, a minimum amount of piping and reduced amounts of distribution system piping visible at an above-ground level. Typically, the distribution system piping will be located less than three feet below ground level, and preferably as shallow as possible. FIGS. 14 and 15 show an integrated system, generally at 600. The integrated system 600 includes a storage reservoir 602, which may be of the type shown in any of the embodiments previously described. It will be appreciated that any of the embodiments described herein are intended to share suitable features from other embodiments, such that features from two or more different embodiments may be combined in any desired favorable arrangement. The storage reservoir 602 is again shown in the condition following manufacture, for delivery to a service station or other cite for in-ground installation. Thus, as before, the storage reservoir 602 can be provided in this condition, ready for installation in an excavated pit, such as that shown at 604, and ready for the connection of all of the features of the integrated system 600 at the locations provided. The storage reservoir 602 may be of a two-compartment construction, in similar manner as before. Thus, two different grades of automobile fuel or other fluid being stored within the storage reservoir 602 may be included within the first compartment 606 and the second compartment 608. Alternatively, the storage reservoir having any suitable number of compartments may be used. The storage reservoir 602 includes an optional oil-water separator 610. Preferably, as before, the storage reservoir 602 is located beneath the ground surface 612 upon which a concrete driveway 614 has been constructed.

In similar manner as before, one feature of the integrated system 600 involves the integrated inclusion of a first support unit 616 and a second support unit 618 extending from the storage reservoir 602, through the ground surface 612 and concrete driveway 614, and extending upward in a generally vertical direction for supporting a canopy system to be described below. Although the first support unit 616 and the second support unit 618 may be connected with the storage reservoir 602 in many suitable ways, including those described elsewhere herein, FIGS. 14 and 15 show the first support unit 616 and the second support unit 618 to be connected by welding or other suitable means to the lower interior surface of the storage reservoir 602 through bearing plates 620 and 622. The first support unit 616 and the second support unit 618 are also preferably secured with respect to the upper surface of the storage reservoir 602 through the use of bungholes 624 and 626. Alternatively, it will be appreciated that bearing plates may be utilized at this location. In addition, it will further be appreciated that bungholes may be used at some or all of the connection ports along the upper surface of the storage reservoir 602, although for purposes of brevity, they are not individually numbered. As before, the first support unit 616 and the second support unit 618 include canopy support platforms 628 and 630 for connection to the support units used to suspend the canopy system above the ground.

The integrated system 600 also includes a canopy system for protecting service station customers from the weather. In the embodiment shown in FIGS. 14 and 15, the canopy system includes a primary canopy 632 that is supported above the ground through canopy support units 634, 636, 638 and 640. The canopy support units 636 and 638 are supported directly by the first support unit 616 and second support unit 618 and are connected to the support units through the canopy support platforms 628 and 630. The canopy support units 634 and 640, which are not directly integrated with the storage reservoir 602, are supported below ground level through concrete footings 642 and 644.

In addition to the primary canopy 632, the canopy system may also include a secondary canopy, which may take one of several different forms. In the embodiment shown in FIGS. 14 and 15, the secondary canopy is provided in three secondary canopy sections 646, 648 and 650. These secondary canopy sections are located beneath the primary canopy 632 and, in the form shown in FIG. 14, serve as individual covers for the dispensing units discussed below. Alternatively, it will be appreciated that the secondary canopy may be a continuous canopy structure of the same or different size relative to the primary canopy 632. The integrated system 600 is also shown to include service islands 652, 654 and 656 upon which the dispensing of fluid from the storage reservoir 602 can be conducted. Preferably, the service islands 652, 654 and 656 are elevated concrete structures above the level of the concrete driveway 614. Disposed upon the service islands 652, 654 and 656 are dispensing units 658, 660 and 662. The dispensing units are operable for the dispensing of one or more grades of fluid, such as automobile fuel, from within the storage reservoir 602.

The storage reservoir 602 includes similar features as previously described for filling and venting of the reservoir.

In this regard, the storage reservoir 602 includes filling lines 664, 665 and 666 for filling the first compartment 606 and the second compartment 608 of the storage reservoir 602. Two filling lines, shown at 664 and 665 are provided for filling the larger first compartment 606, while a single filling line 666 is provided for filling the smaller second compartment 608. Typically, the grade of fluid used more frequently (such as regular grade automobile gasoline) is stored in the larger first compartment 606, while another lesser-used grade (such as premium grade automobile gasoline) is stored in the smaller second compartment 608. Thus, a tanker truck having a two-compartment reservoir for refilling the storage reservoir 602 may be attached at one reservoir to a first filling line (such as 664) for the first compartment 606 and at the other reservoir to a second filling line 666 for the second compartment 608. Once the second compartment 608 is filled, the tanker truck filling line can be switched to tap the truck reservoir feeding the first compartment 606, and this line can be attached to filling line 665 so that two lines can simultaneously feed the larger first compartment 606. Thus, use of a three-port arrangement for filling the storage reservoir 602 can save time.

Vapor recovery ports 670 and 672 are provided for extraction of vapors such as gasoline vapors, from within each compartment of the storage reservoir 602 upon filling (called Phase I vapor recovery). Check valves 674 and 675 are provided on the vapor recovery ports 670 and 672 to prevent direct venting to the atmosphere. Vent lines 676, 677 and 678 allow for venting of excess pressure to the atmosphere when necessary.

The integrated system 600 also includes a delivery system for delivery of fluid from within the storage reservoir 602 to an above-ground level. In the embodiment shown in FIGS. 14 and 15, this is provided to include discharge lines 680 and 682 in communication with submersible pumps 684 and 686 for the extraction of fluid from within the first compartment 606 and second compartment 608, respectively, of the storage reservoir 602. Distribution heads 688 and 690 are provided above the discharge lines 680 and 682 for the distribution of fluid to the dispensing units 658, 660 and 662. Although the distribution heads 688 and 690 are shown to be located at an above-ground level, it will be appreciated that the distribution heads may be located below ground level or, alternatively, may be positioned at a higher above-ground location, such as within one of the overhead canopies.

The integrated system 600 also includes a distribution system. The distribution system in this embodiment is located substantially below ground level to minimize the amount of exposed piping visible to service station customers upon the above-ground premises. However, the distribution system is largely located just below ground level and in substantially parallel relation in order to provide maximum serviceability and a minimum amount of piping. It will therefore be appreciated that this invention contemplates the placement of distribution system equipment at above-ground or below-ground locations in arrangements that provide maximum serviceability and minimum piping. Above-ground and below-ground distribution system equipment may largely be arranged in similar configurations, and may even be substantial mirror images of each other. Preferably, all of the piping making up the distribution system is of a double-walled nature, although it will be appreciated that any suitable type of piping may be used.

Accordingly, the distribution system includes a distribution manifold 692 that is operable for distributing fluid from the distribution heads 688 and 690 to the dispensing units 658, 660 and 662. A return manifold 694 is also provided for the return of fluid and vapors to the storage reservoir 602 (Phase II recovery). The distribution system further includes distribution lines 696, 698 and 700, each attached to one of the dispensing units 658, 660 and 662, for the transfer of one grade of fluid to the dispensing units 658, 660 and 662. Also connected to the dispensing units 658, 660 and 662 are a plurality of recovery lines 702, 704 and 706 for the return of fluid and vapors (Phase II recovery) from the dispensing units 658, 660 and 662 into the return manifold 694, for transfer back to the storage reservoir 602. In addition, distribution lines 708, 710 and 712 are each attached to one of the dispensing units 658, 660 and 662, for the transfer of a second grade of fluid to the dispensing units 658, 660 and 662. It will be appreciated that additional distribution lines may be provided in the same general manner for the distribution of fluid to other service islands located upon the service station premises. In the situation where a third grade of fluid is distributed by the dispensing units 658, 660 and 662, a blending pump (not shown) of the type well-known to those skilled in the art is provided within any or all of the dispensing units 658, 660 and 662 to blend the two available grades of fluid to produce a third, intermediate grade. Alternatively, it will be appreciated that a three-compartment storage reservoir may also be used, with three sets of associated distribution piping for the three fluid grades. It will also be appreciated that the piping manifold system as shown in FIG. 15 can also be substantially duplicated beneath adjacent service station islands, and supplied by the submersible pumps 688 and 690. In addition, optional drip pans 714, 716 and 718 are provided at the base of each dispensing unit 658, 660 and 662 for the collection of fluid in liquid form that may be spilled during dispensing. Optionally, the drip pans 714, 716 and 718 may be connected by suitable piping (not shown) for return of fluid to the storage reservoir 602.

Figure 16:
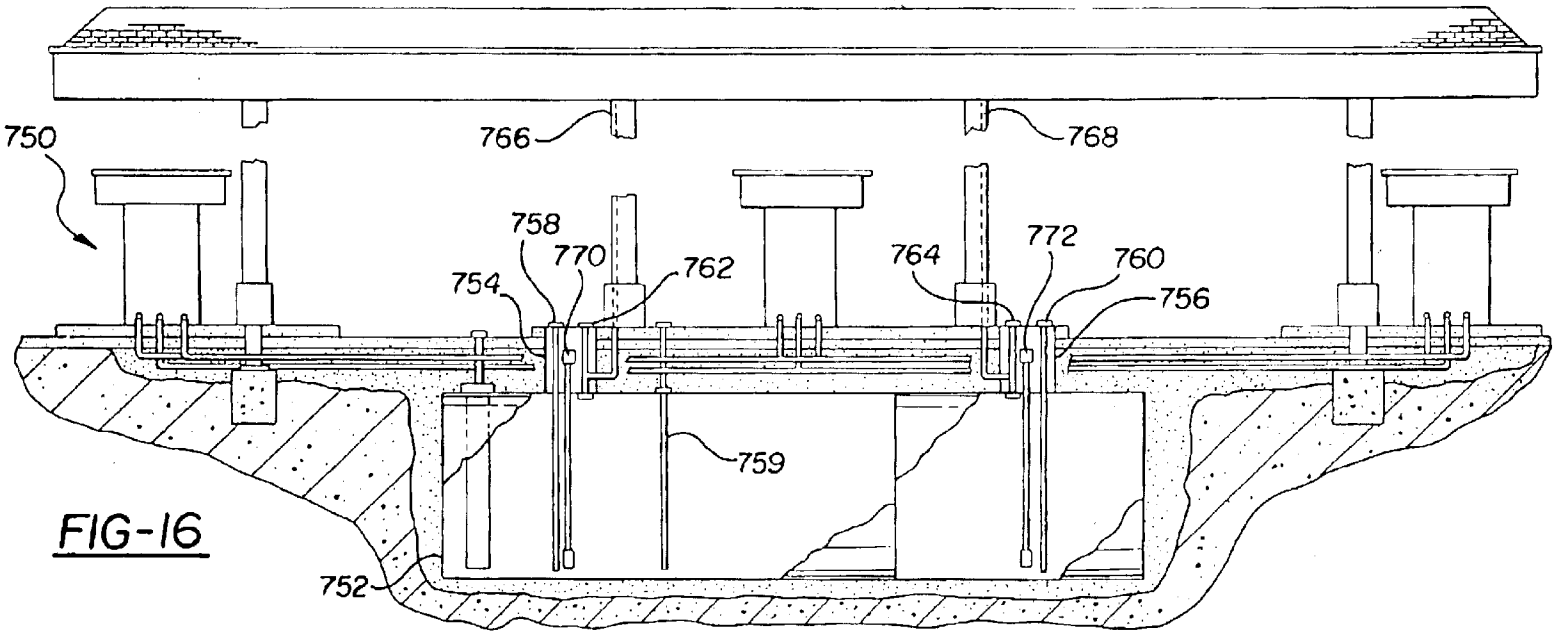
FIG. 16 is a partial cross-sectional view illustrating an integrated underground storage reservoir and canopy support system, which includes distribution equipment beneath ground level in a manhole sump.
Figure 17:
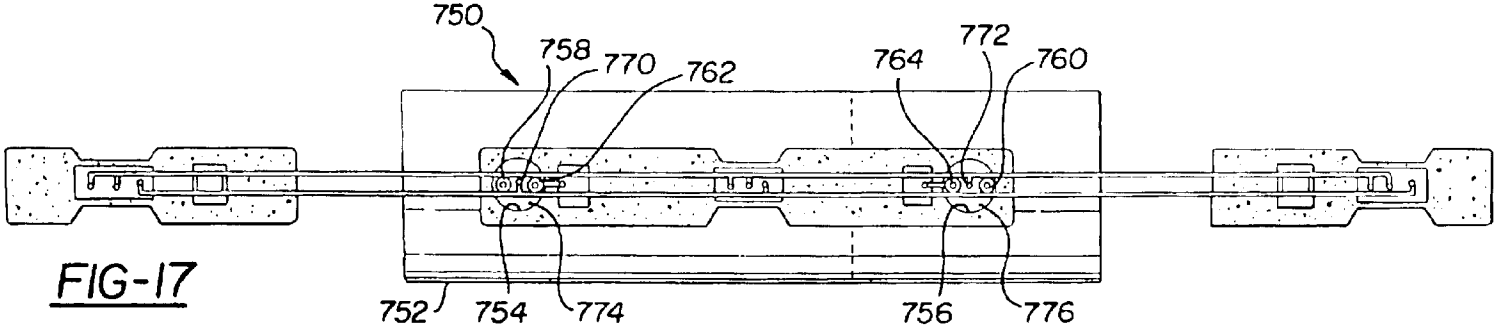
FIG. 17 is a plan view of the underground storage reservoir and canopy support system shown in FIG. 16.

Another preferred embodiment of the present invention is shown with respect to FIGS. 16 and 17, which show a partial cross-sectional view and a plan view, respectively, of an alternate construction embodiment. In this embodiment, the amount of visible delivery system and distribution system equipment is reduced even further, as compared to the previous embodiment. It will be noted that for purposes of avoiding redundancy, most of the features set forth in the previous embodiment are repeated here, with the exception of the changes to certain features noted below. Therefore, several elements making up the integrated system are not repeated in the description below for this embodiment.

FIGS. 16 and 17 show an integrated system generally at 750. The integrated system 750 includes a storage reservoir 752 that is substantially of the same design and configuration as the storage reservoir 602 previously described. In this arrangement, however, a pair of sumps 754 and 756 are provided beneath ground level to contain some of the components of the delivery and distribution systems previously described. The filling lines 758 and 760 for the storage reservoir 752 are changed in their location to be located within the sumps 754 and 756. A third, optional, filling line 759 is provided in similar manner as before, and may also be located within a sump if desired. The vapor recovery ports 762 and 764 for the Phase I recovery of the vapors from within the storage reservoir 752 during filling are also located within the sumps 754 and 756. In similar manner as before, the vapor recovery ports 762 and 764 are in communication with the vent lines 766 and 768. The distribution heads 770 and 772, which operate to extract fluid from within the storage reservoir 752, are also located within the sumps 754 and 756. It will be appreciated in this embodiment as well that additional distribution lines may be provided in the same general manner as before for the distribution of fluid to other service islands located upon the service station premises.

Thus, in this arrangement, an additional amount of equipment necessary for filling the storage reservoir 752 and for accomplishing the delivery and distribution of fluid from the reservoir is located within a serviceable and accessible location below ground level. Manhole covers 774 and 776 are preferably disposed across the upper edge of the sumps 754 and 756 so as to provide a cover that is preferably substantially flush with the surrounding surface. It will be noted that the surrounding surface may be the upper surface of one of the service islands previously described, or may alternatively be the surface of the concrete driveway previously described.

Figure 18:
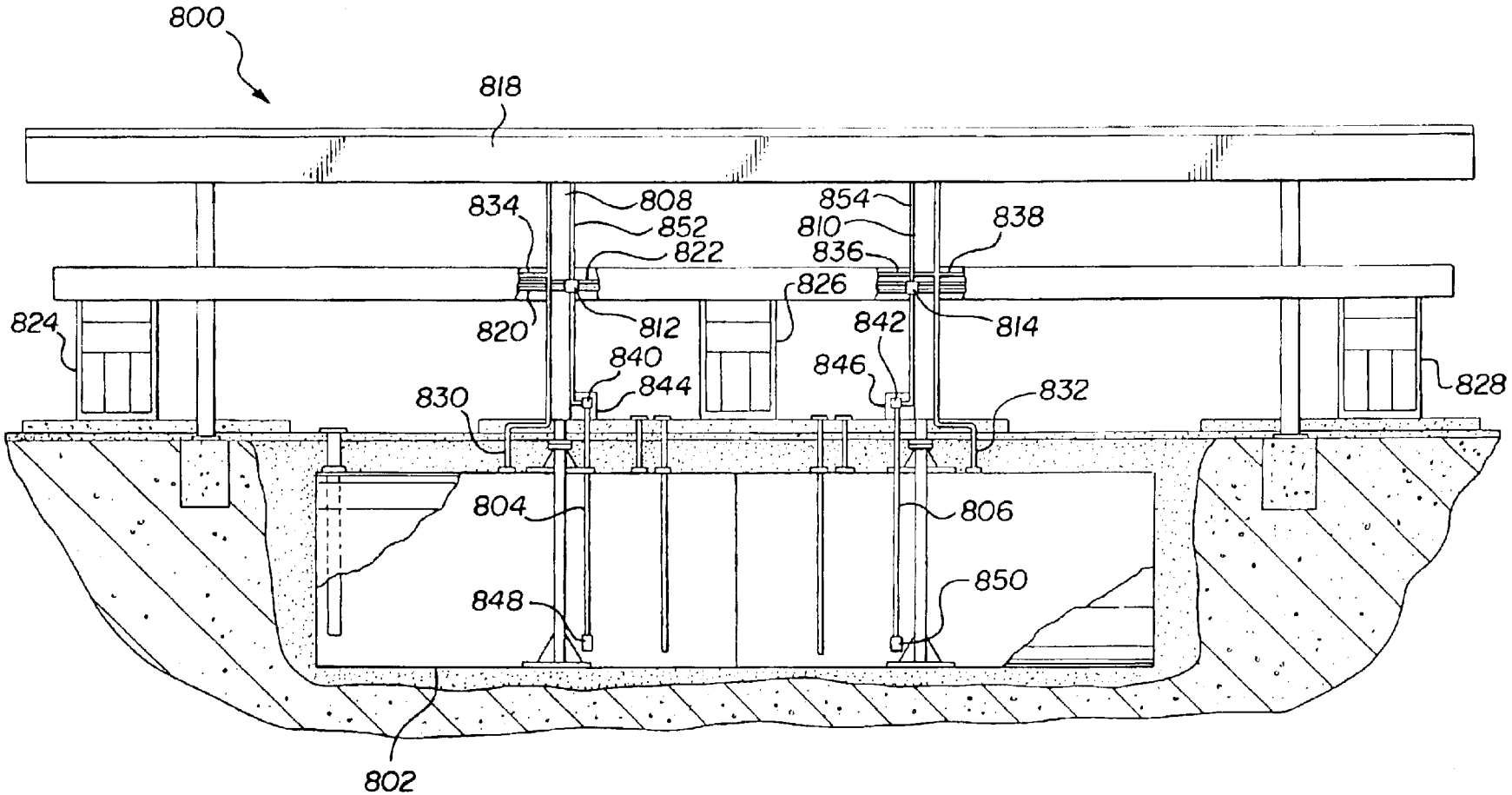
FIG. 18 is a partial cross-sectional view illustrating an integrated underground storage reservoir and canopy support system, which includes additional distribution components in an above-ground canopy.

Yet another embodiment of the present invention is shown in FIG. 18, which illustrates a partial cross-sectional view of this embodiment of the present invention. An integrated system 800 is provided, which shares many of the same features shown in FIG. 1. Accordingly, many of the features of that embodiment remain unchanged in this embodiment. Therefore, for purposes of brevity, those features that are unchanged are not repeated in the description here. In this embodiment, discharge lines 804 and 806, provided for the extraction of fluid from within the storage reservoir 802, are extended in length so that they travel vertically along the canopy support units 808 and 810, instead of terminating just above ground level as before. In this arrangement, distribution heads 812 and 814, to which the discharge lines 804 and 806 are connected, are located within the secondary canopy 816. Alternatively, the distribution heads 812 and 814 may also be located within the primary canopy 818. Location of the distribution heads 812 and 814 within the primary canopy 818 may be preferable where the secondary canopy 816 is instead provided in discontinuous segments, as in the previous embodiment. However, where the secondary canopy 816 is a continuous canopy, location of the distribution heads 812 and 814 within the secondary canopy 816 is suitable for the desired result.

Distribution lines 820 and 822 are provided within the secondary canopy 816 for the distribution of fluid from within the storage reservoir 802 to the dispensing units 824, 826 and 828. It will be appreciated that additional distribution lines may also be provided in this embodiment for the distribution of fluid to other service islands. Such additional distribution lines may pass through the secondary canopy (if connected to other islands), the primary canopy (if connected to other islands) or underground as desired. Phase II recovery lines 830 and 832 are also shown to pass through the secondary canopy 816 to the dispensing units 824, 826 and 828. Recovery lines 834, 836 and 838 are also provided within the secondary canopy 816 for the return of vapors from the three dispensing units 824, 826 and 828 to the reservoir 802. The placement of the vapor recovery lines within the secondary canopy 816 further reduces the amount of underground piping. This vapor recovery piping may also be located in the primary canopy.

FIG. 18 also shows an alternate arrangement for the distribution heads from that shown in previous embodiments. In this arrangement, additional distribution heads 840 and 842 are provided above ground level upon the service island, and are covered by enclosures 844 and 846 for aesthetic purposes. This arrangement also allows the submersible pumps 848 and 850 to be removed from within the reservoir with greater ease by simply lifting the distribution heads 840 and 842. This embodiment reduces the amount of delivery system and distribution system equipment that is observable by service station customers at ground level. It also allows for serviceability of the distribution pumps and heads and a substantial amount of the piping associated with the distribution system.

Figure 19:
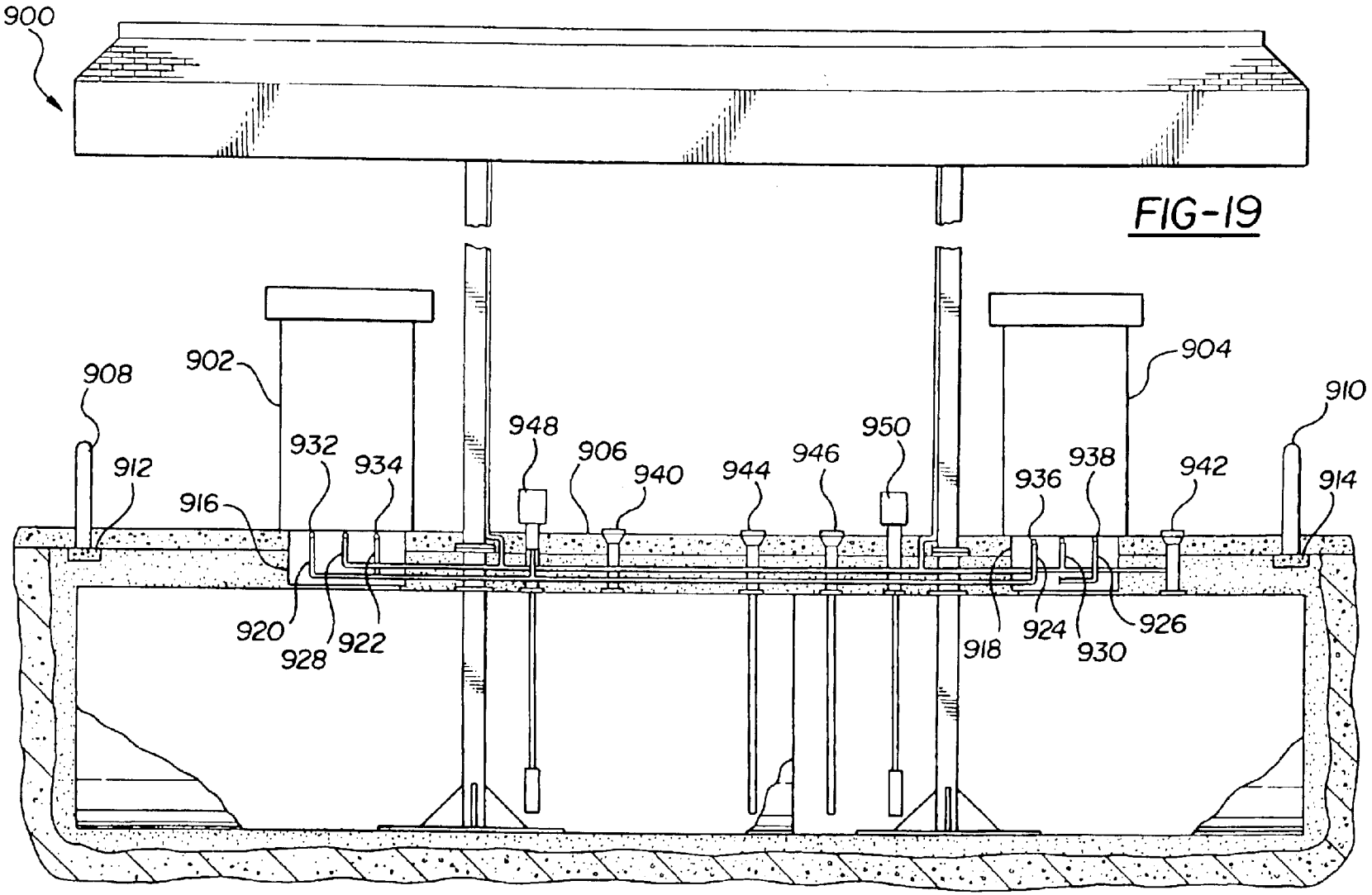
FIG. 19 is a partial cross-sectional view illustrating an integrated underground storage reservoir and canopy support system, which includes a beneath ground level distribution piping network and wherein dispensing units are located directly upon a concrete driveway.

Another preferred embodiment of the present invention is shown in FIG. 19. FIG. 19 shows an integrated system, generally at 900. In this embodiment of the invention, the concrete island referred to in previous embodiments is not present. There is a trend in automobile service station construction to eliminate the concrete islands disposed in a raised fashion upon the concrete driveway of the service station premises. Thus, in this embodiment, two dispensing units 902 and 904 are shown to be disposed directly upon a concrete driveway 906. Guardposts 908 and 910 are provided at the ends of the former island areas to protect the dispensing units 902 and 904 from contact by vehicles upon the service station premises. The guardposts 908 and 910 may preferably be reinforced in their secured positions upon the concrete driveway 906 by anchoring with concrete bases 912 and 914.

In this arrangement, it will be appreciated that any suitable number of dispensing units may be used, although two are shown in FIG. 19. Further, it will be appreciated that this embodiment may include any variation of features described in any of the embodiments herein. For example, the support unit, canopy arrangement and underground storage tank is shown to be similar to that described in connection with previous embodiments, although it will be realized that any suitable arrangement may be used. For this reason, the canopy, underground storage tank and support units are not described again in detail here.

In this embodiment, plastic sumps 916 and 918 are shown to be located beneath the dispensing units 902 and 904. The plastic sumps 916 and 918 are provided to isolate the areas of the distribution system for easy serviceability and/or maintenance. Accordingly, the plastic sumps 916 and 918 provide a hollow enclosure intended to keep these components free from contact with the surrounding earth and concrete making up the concrete driveway 906. Although the sumps 916 and 918 are typically made out of a plastic material reinforced with steel, it will be appreciated that any suitable construction may also be used. The components of the distribution system that are shielded by the plastic sumps 916 and 918 include distribution lines 920, 922, 924 and 926, which feed two separate grades of fluid to the dispensing units 902 and 904. The sumps 916 and 918 also enclose a portion of the Phase II recovery lines 928 and 930 where they feed into the dispensing units 902 and 904. In addition, emergency valves 932, 934, 936 and 938, located where the distribution lines 920, 922, 924 and 926 feed into the dispensing units 902 and 904, are also protected by the sumps 916 and 918. Also, it will be noted that suitable emergency valves of the type described herein may be installed in any embodiment described herein at any location effective for restricting the flow of fluid within the distribution system. Preferably, the sumps 916 and 918 are substantially enclosed, except for apertures suitably located to allow the passage of these various lines, as previously described, into the interior of the sumps 916 and 918. Although the sumps 916 and 918 are shown to be fed from the end in a parallel relation to the underground storage tank, it will be appreciated that any suitable connection configuration may be used. It will further be appreciated that any suitable arrangement for the distribution lines and recovery lines may also be used with the plastic sumps 916 and 918 without departing from the present invention.

The removal of raised concrete service islands in this embodiment results in slight changes in configuration for other components of the integrated system 900. As shown in FIG. 19, the openings for the Phase I recovery lines 940 and 942 and the filling lines 944 and 946 are now located upon the concrete driveway 906 in a substantially flush configuration. The distribution heads 948 and 950 are also shown to be located above the concrete driveway 906. It will be appreciated, however, that any other suitable configuration for this arrangement may be used, including submerging the distribution heads 948 and 950 within a sump arrangement, in accordance with the intended ability for universal substitution of features throughout the various embodiments of this invention. It is also intended that the various arrangements of the various embodiments of the present invention may be either assembled at the factory or field-installed.

Figure 20:
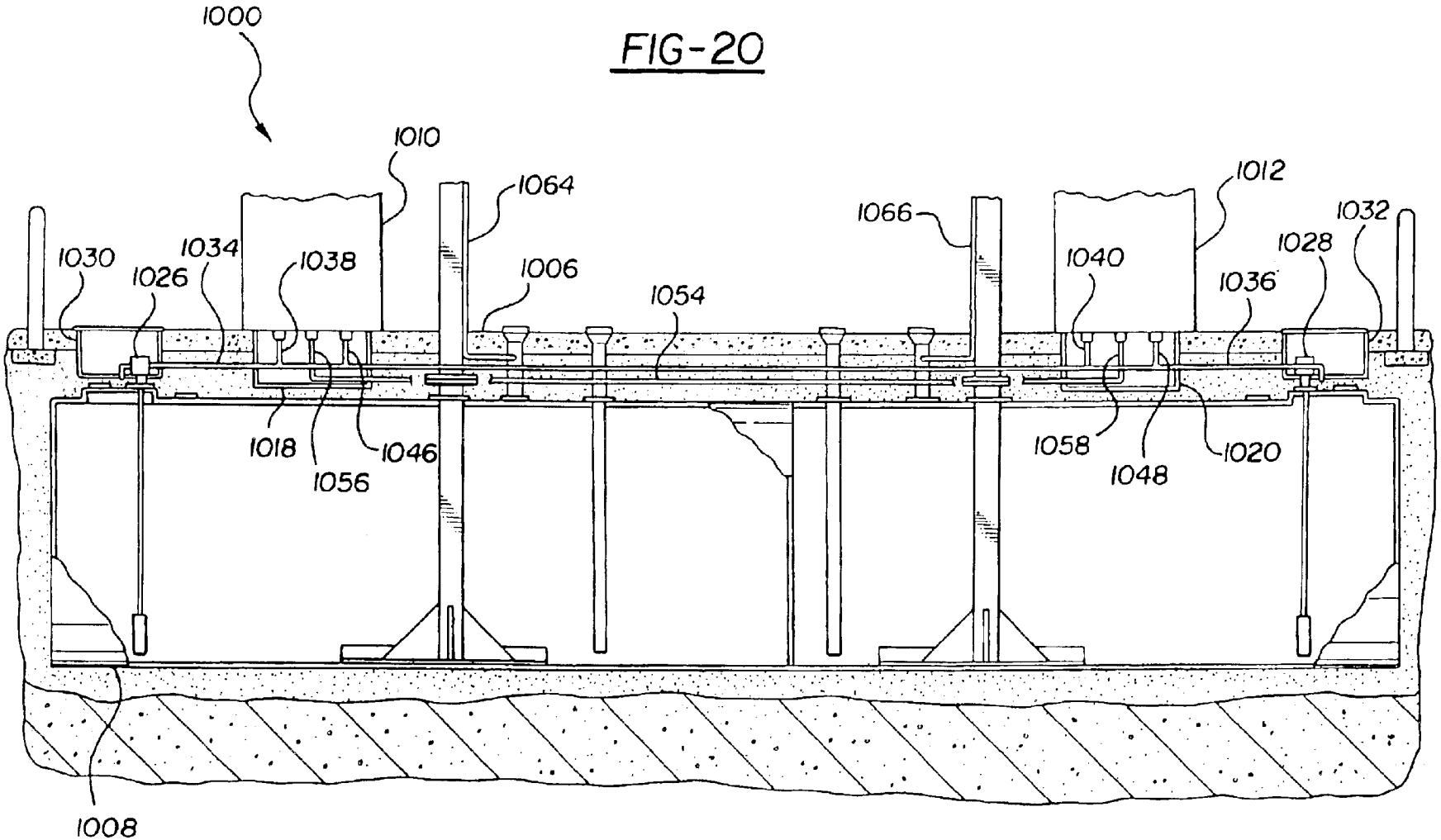
FIG. 20 is a partial cross-sectional view illustrating an integrated underground storage reservoir and canopy support system, which includes a beneath ground level remote island area distribution piping network.
Figure 21:
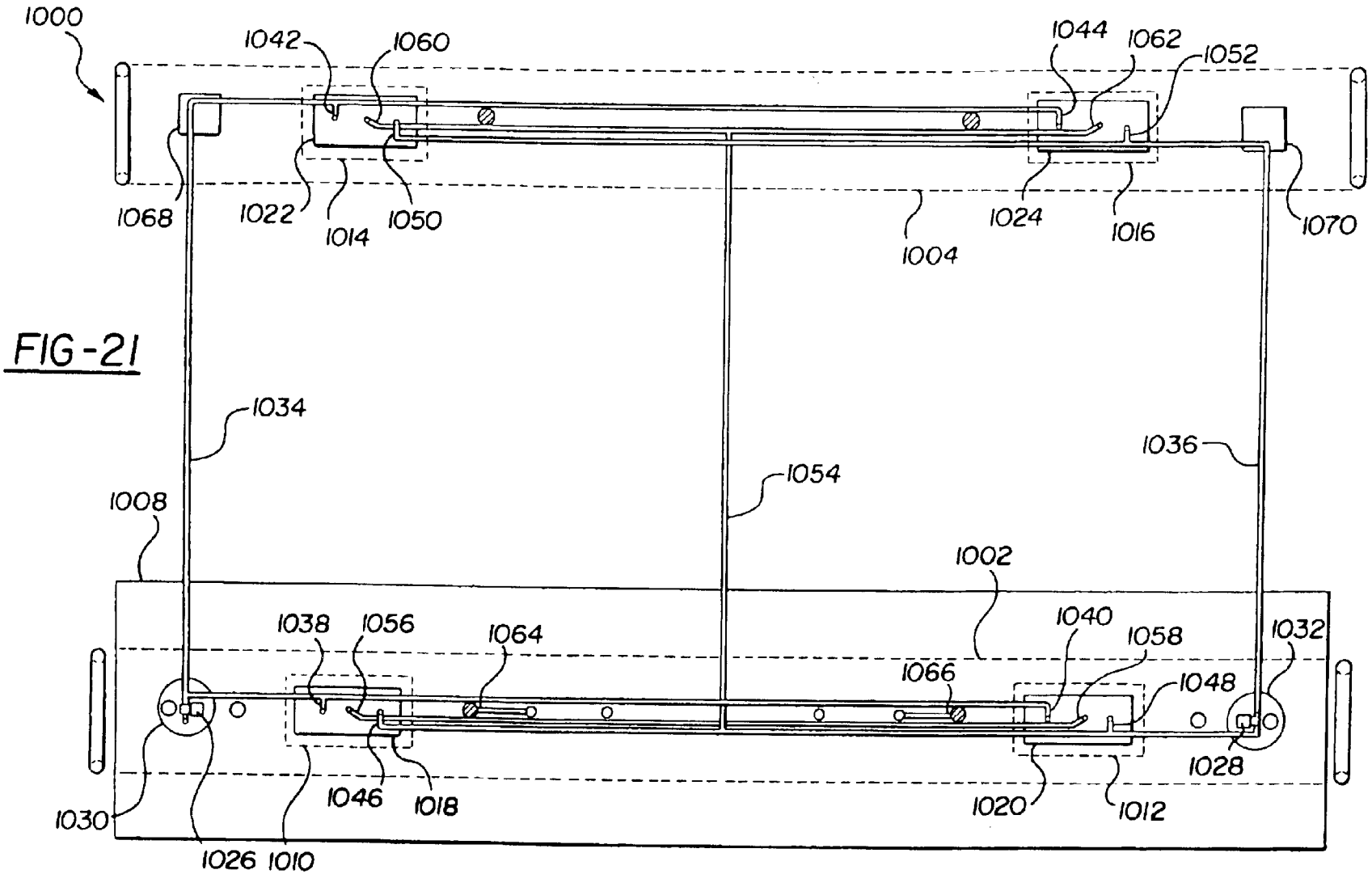
FIG. 21 is a plan view of the integrated system shown in FIG. 20.

Referring now to FIGS. 20 and 21, there is shown yet another preferred embodiment of the present invention. Specifically, FIGS. 20 and 21 show respectively a partial cross sectional view and a plan view of a different version of integrated system, designated at 1000. The integrated system 1000 is different from the arrangement shown in previous embodiments in that it includes a distribution and Phase II recovery system designed to feed and return from two separate service island areas upon a service station premises. Thus, this embodiment demonstrates one principal of remote piping in a distribution system.

The integrated system 1000 is shown to include a first island area 1002 and a second island area 1004 located upon a concrete driveway 1006 of a service station premises. A storage reservoir 1008 is located directly beneath the first island area 1002. It will be appreciated, however, that this principal of the present invention may be utilized with any suitable arrangement among the first and second island areas 1002 and 1004 and the storage reservoir 1008. As demonstrated previously, this embodiment involves the use of dispensing units 1010 and 1012 located upon the first island area 1002, and dispensing units 1014 and 1016 located upon the second island area 1004. The first and second island areas 1002 and 1004 are not shown to include raised service islands, although it will be appreciated that they may be used in this arrangement. Dispenser sumps 1018, 1020, 1022 and 1024 are again shown to be located beneath the dispensing units 1010, 1012, 1014 and 1016 in similar manner as before.

In this arrangement, the distribution heads 1026 and 1028 are located in such a way that they can feed into specially-designed piping loops forming part of the distribution system. As shown most clearly in FIG. 21, the distribution heads 1026 and 1028 are located within sumps 1030 and 1032 near the ends of the first island area 1002. It will be appreciated that alternatively, the distribution heads 1026 and 1028 may also be located above the concrete driveway 1006, or above any raised service islands which may be used.

The arrangement shown for the location of the distribution heads 1026 and 1028 is preferred in this type of remote island area distribution piping system because it allows for either a complete or incomplete distribution piping system to be used in a loop arrangement. The integrated system 1000 includes a first grade distribution loop 1034 and a second grade distribution loop 1036, which access fluid from within the two fluid compartments of the storage reservoir 1008. In the situation where a configuration other than a two-compartment configuration is used for the storage reservoir 1008, it will be appreciated that additional distribution loops may be added as required and the distribution loops may be positioned differently as appropriate. The first and second grade distribution loops 1034 and 1036 are preferably configured to run in a parallel loop configuration near a perimeter defining the first and second island areas 1002 and 1004. In this arrangement, serviceability of the distribution system piping is enhanced. In addition, this configuration for the distribution system piping provides a minimum of underground piping while still accomplishing the desired result. In the arrangement shown in FIG. 21, the distribution heads 1026 and 1028 are located at the corners of the first and second grade distribution loops 1034 and 1036.

The first grade distribution loop 1034 is shown to supply fluid from the storage reservoir 1008 to the first grade distribution lines 1038, 1040, 1042 and 1044, which supply a first grade of fluid to the dispensing units 1010, 1012, 1014 and 1016, respectively. Likewise, the second grade distribution lines 1046, 1048, 1050 and 1052 supply a second grade of fluid from within the storage reservoir 1008, through the second grade distribution loop 1036 and to the dispensing units 1010, 1012, 1014 and 1016. The first and second grade distribution loops 1034 and 1036 are shown to be incomplete loops in that they terminate at the dispensing unit located farthest from the distribution head supplying fluid to that loop. It will be appreciated, however, that a complete loop configuration may also be used. Such a configuration is discussed below.

The integrated system 1000 also includes a Phase II recovery loop 1054 for the recovery of vapors into the storage reservoir 1008. Phase II recovery lines 1056, 1058, 1060 and 1062 are connected to the dispensing units 1010, 1012, 1014 and 1016 for feeding such vapors to the phase two recovery loop 1054. The Phase II recovery loop 1054 is also connected to vents 1064 and 1066 in a similar manner as before for releasing excess vapor pressure to the atmosphere when necessary. In addition, FIG. 21 shows two distribution junction boxes 1068 and 1070, which may be optionally located at the corners of the distribution loops servicing a remote island area, such as the second island area 1004. The distribution junction boxes 1068 and 1070 allow for inspection and maintenance at the corners of the distribution loops.

Figure 22:
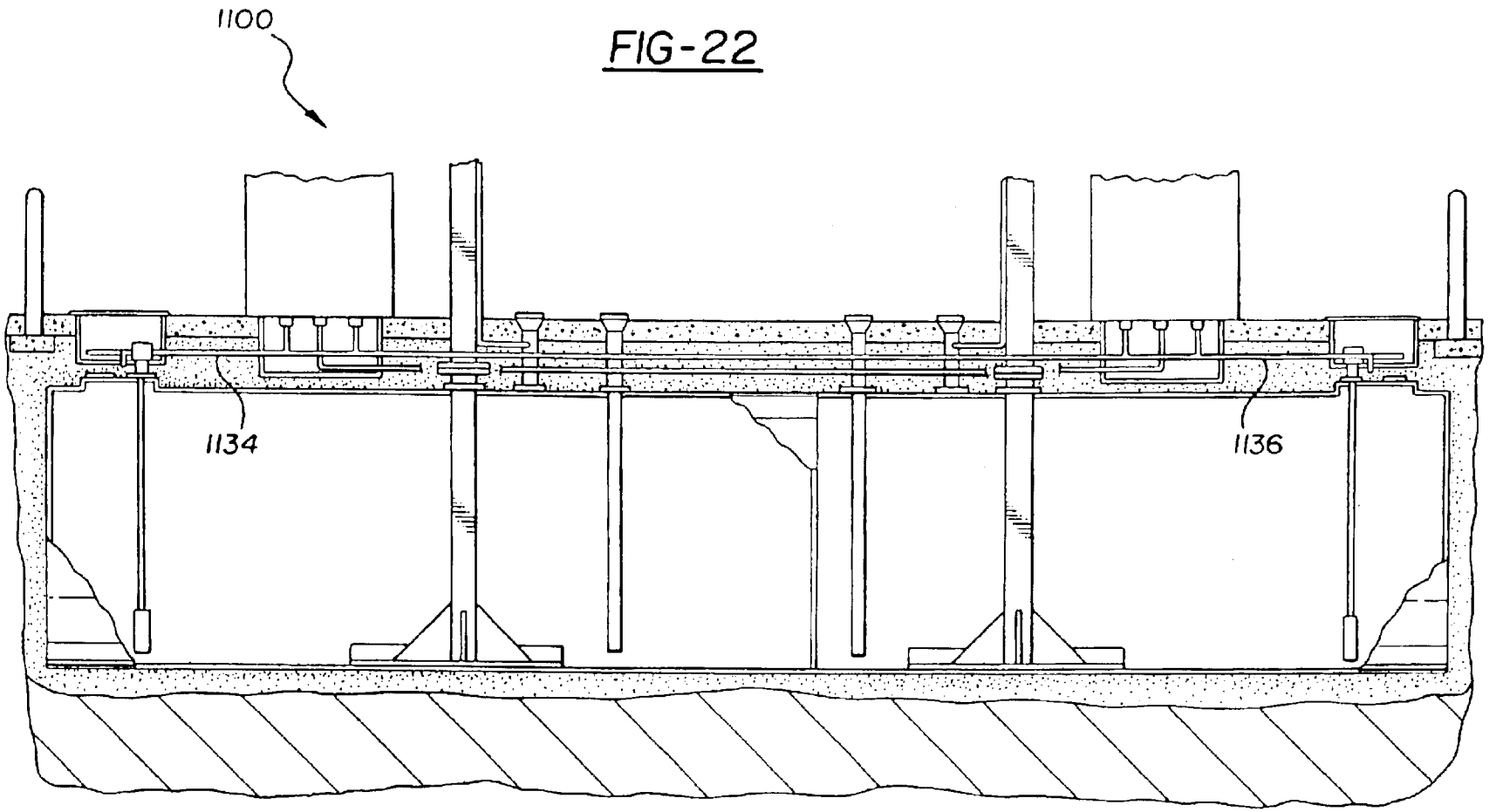
FIG. 22 is a partial cross-sectional view illustrating an integrated underground storage reservoir and canopy support system, which includes a beneath ground level closed loop distribution piping network for feeding a remote island area.
Figure 23:
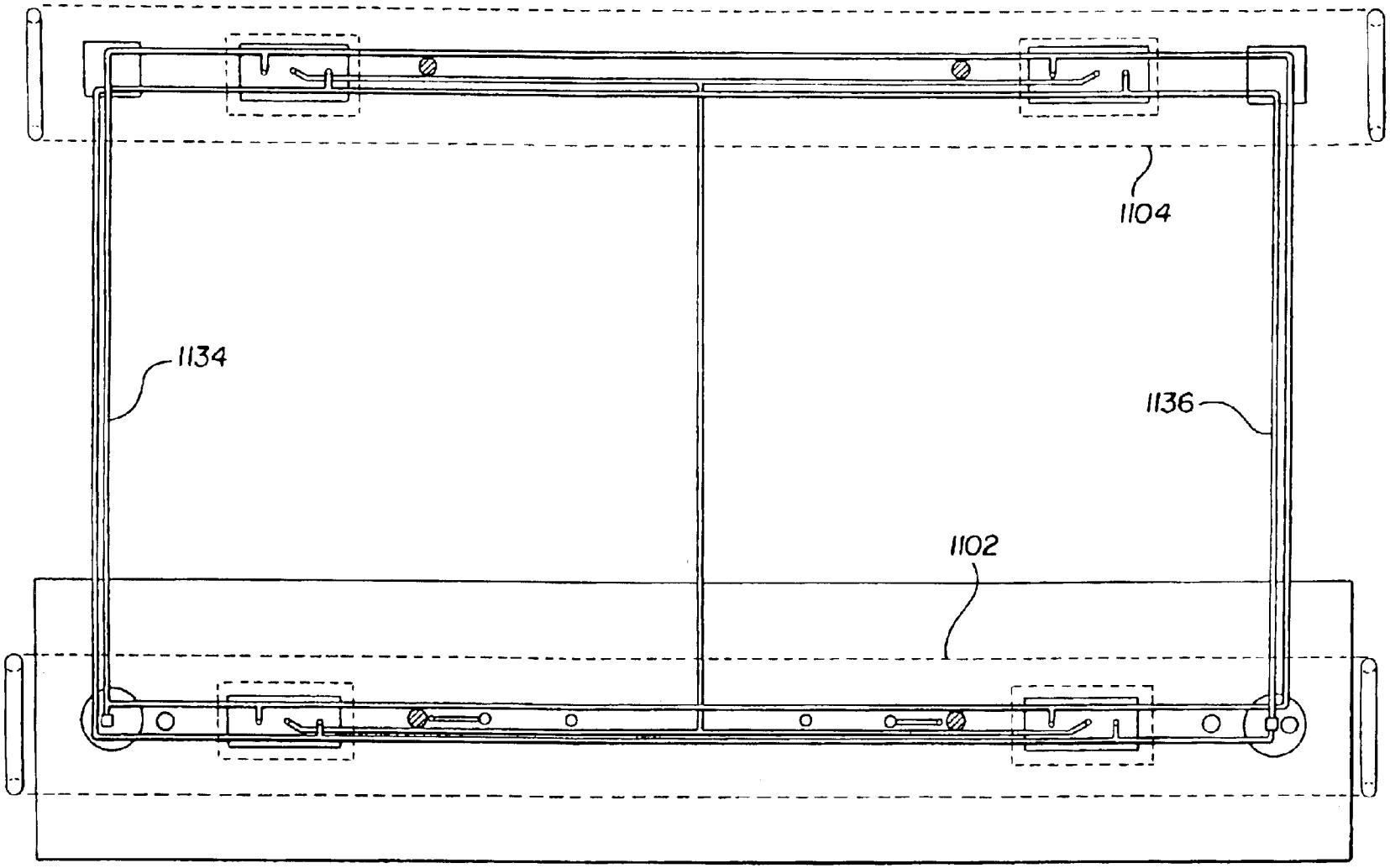
FIG. 23 is a plan view of the integrated system shown in FIG. 22.

Referring now to FIGS. 22 and 23, there is shown a partial cross-sectional view and a plan view, respectively, of yet another preferred embodiment of the present invention. In this embodiment, the remote island area distribution piping system principle is utilized in a closed-loop arrangement. One advantage of such a closed-loop system is that it provides dual supply lines for each fluid product to each dispensing unit permitting equal product distribution regardless of the dispensing unit location relative to the distribution piping loop. This arrangement also allows one section of the loop to be shut down or otherwise separated as may be required for maintenance without causing a complete loss of function for the system. It will be appreciated that many of the descriptions of various components and many of the optional configurations and/or accessories described in connection with the previous embodiment are also suitable for use in this embodiment. However, for the sake of brevity, these will not be repeated here.

In this arrangement, an integrated system 1100 supplies fluid to a first island area 1102 and a second island area 1104. A first grade distribution loop 1134 and second grade distribution loop 1136 are shown in a similar manner as in the previous embodiment, except that they are now provided in a closed-loop configuration. All other features of this embodiment may preferably be substantially as previously described. It will be appreciated that in any type of arrangement shown herein, sensors (not shown) may be employed at any suitable location to detect any leaks which may occur. Any arrangement may also allow for the utilization of appropriate shut-off valves located at any appropriate location within the distribution piping system for removing any portion or portions of any loop or other distribution piping system portion from service when required. FIGS. 24–29 illustrate some variations of closed-loop distribution piping configurations that may be suitable in the present invention. It will be appreciated that these figures show only a few examples of the many configurations that can be used. These figures are intended to illustrate the general principle of extending a closed-loop distribution piping system among differently configured island areas and among dispensing units configured in series or in parallel. In addition, these figures are intended to illustrate the variations in placement of an underground storage reservoir relative to both a concrete driveway upon a service station premises and one or more service island areas located upon the premises. It will be appreciated that any combination of features from any of these figures may be utilized in a single arrangement.

Figure 24:
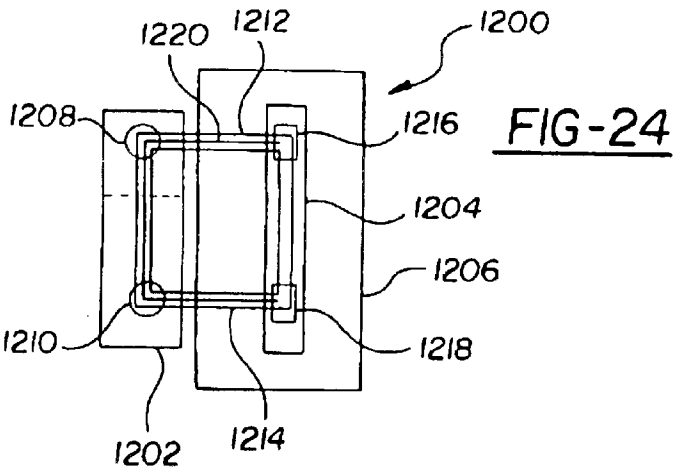
FIG. 24 is a plan view of an integrated system having a closed loop distribution piping network for feeding an island area displaced relative to the underground storage reservoir.

Referring now to FIG. 24, there is shown an integrated system at 1200 which includes a underground storage reservoir 1202 that is displaced horizontally relative to an island area 1204 which the storage reservoir 1202 is intended to feed. The island area 1204 is disposed upon a concrete driveway 1206 in a similar manner as before. In this arrangement, the storage reservoir 1202 is disposed underground at a location horizontally displaced from the concrete driveway 1206 as well. A first grade distribution loop 1212 and a second grade distribution loop 1214 serve to supply the dispensing units 1216 and 1218 with two grades of fluid from the storage reservoir 1202. A Phase II recovery loop 1220 is also provided for the return of vapors from the dispensing units 1216 and 1218.

Figure 25:
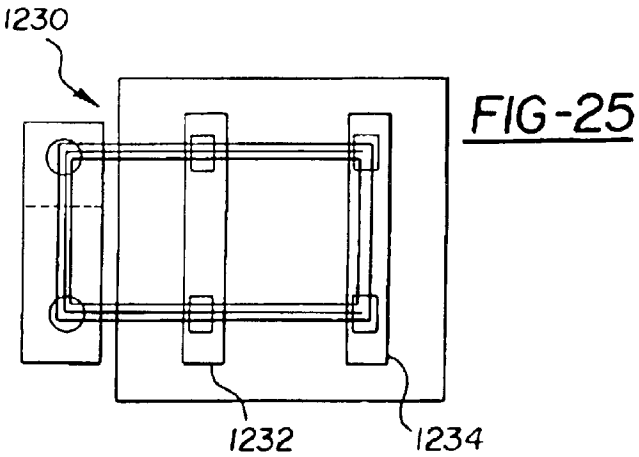
FIG. 25 is a plan view of an integrated system having a closed loop distribution piping network for feeding two island areas displaced relative to the underground storage reservoir.
Figure 27:
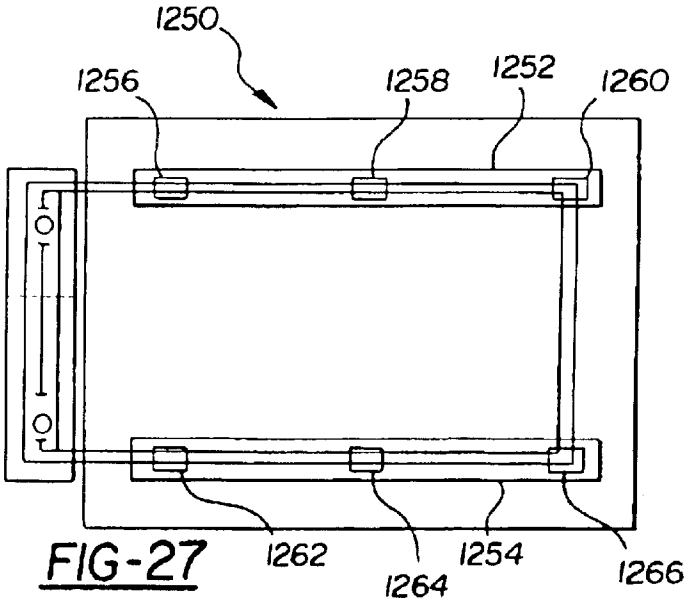
FIG. 27 is a plan view of an integrated system having a closed loop distribution piping network for feeding two island areas displaced in parallel relative to the underground storage reservoir, wherein dispensing units are located in series upon the island areas.
Figure 26:
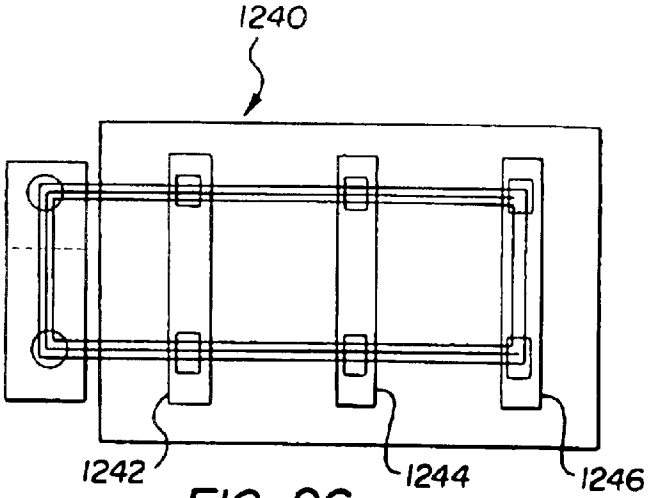
FIG. 26 is a plan view of an integrated system having a closed loop distribution piping network for feeding three island areas displaced relative to the underground storage reservoir.

The remaining FIGS. 25–29 show variations for locations of the island areas and dispensing units for an integrated system such as that described above. Accordingly, specific discussion of the distribution loop components will not be repeated here for brevity. FIG. 25 shows an integrated system 1230 that is similar to the integrated system 1200 described in connection with FIG. 24, except that FIG. 25 shows a first island area 1232 and a second island area 1234 that are both supplied with fluid as two series in parallel. FIG. 26 is a further expansion of the principle set forth in FIGS. 24 and 25, wherein an integrated system 1240 includes first, second and third island areas at 1242, 1244 and 1246, which are also fed as two parallel series of distribution locations. FIG. 27 shows a slightly different arrangement, where an integrated system 1250 includes a first island area 1252 and a second island area 1254 disposed in a perpendicular relation relative to the first, second and third island areas 1242, 1244 and 1246 described in connection with FIG. 26. Dispensing units 1256, 1258 and 1260 are disposed in series upon the first island 1252. Similarly, dispensing units 1262, 1264 and 1266 are disposed in series upon the second island area 1254. In this arrangement, the first island area 1252 and second island area 1254 are fed in parallel as part of the closed loop distribution system.

Figures 28, 29, 30:
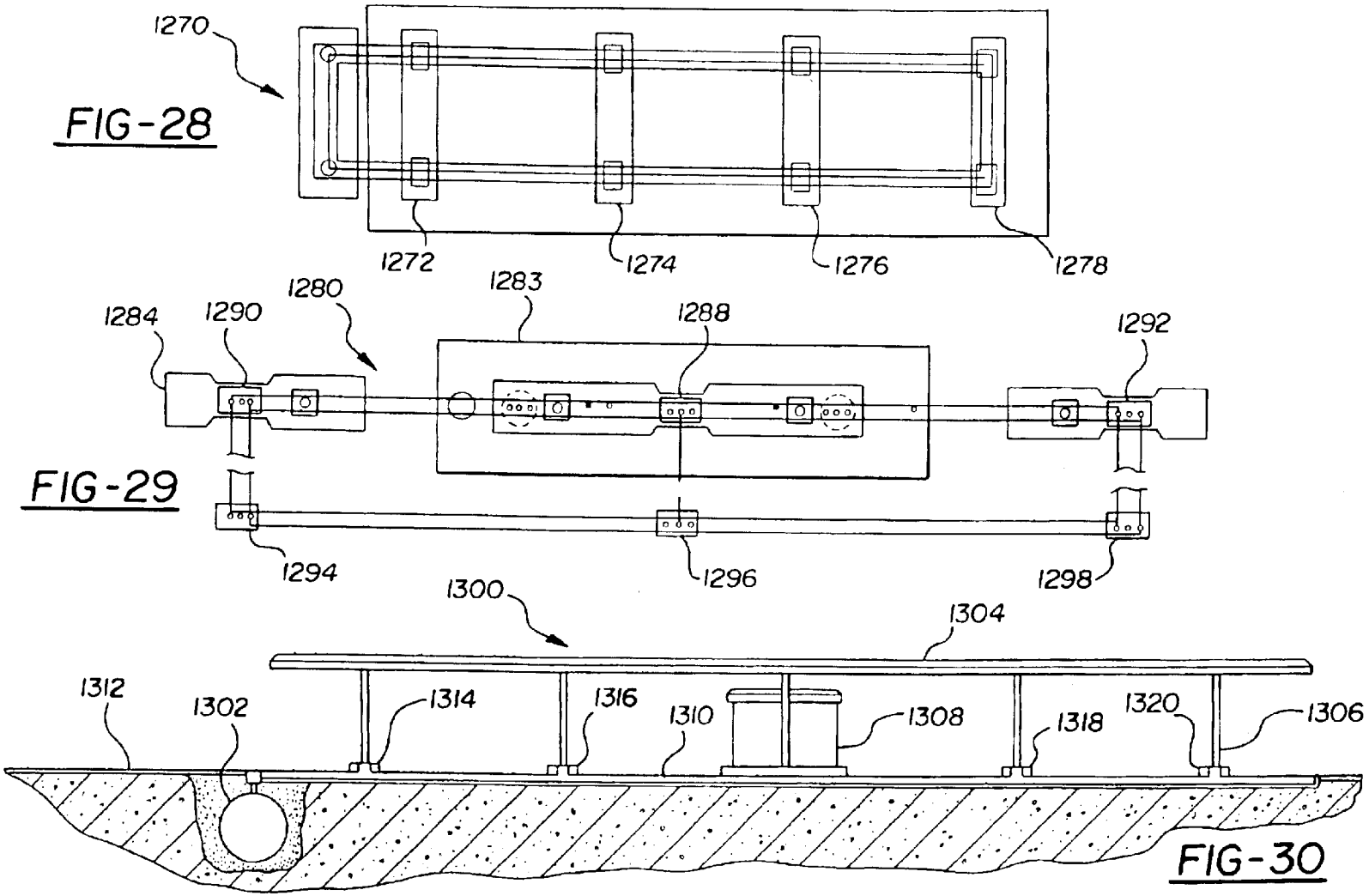
FIG. 28 is a plan view of an integrated system having a closed loop distribution piping network for feeding four island areas displaced relative to the underground storage reservoir.
FIG. 29 is a plan view of an integrated system having a closed loop distribution piping network for feeding two island areas displaced laterally in a planar arrangement relative to an island area located directly above an underground storage reservoir, wherein three additional island areas are displaced in a second, remote planar arrangement.
FIG. 30 is a partial cutaway view illustrating a combination pipe and drain trench having a quick drain spill basin system.

FIG. 28 shows a further expansion of the principle set forth in FIGS. 24–26. Specifically, an integrated system 1270 includes island areas 1272, 1274, 1276 and 1278. These island areas are sequentially fed by the closed-loop distribution system along parallel paths relative to the dispensing locations upon each island area, in a similar manner as before. FIG. 29 shows yet another possible configuration for the integrated system for the present invention. Specifically, FIG. 29 shows an integrated system 1280 having a first island area 1282 located directly above the storage reservoir 1283 in a similar manner as shown in previous embodiments. Here, however, a closed-loop distribution system is provided which serves second and third island areas 1284 and 1286 disposed laterally relative to the storage reservoir 1283. Accordingly, in this arrangement, the first, second and third island areas 1282, 1284 and 1286 are disposed in a substantially planar arrangement. Dispensing units 1288, 1290 and 1292 are disposed upon the first, second and third island areas 1282, 1284 and 1286. In addition, a second set of dispensing units 1294, 1296 and 1298 are shown to be disposed in a substantially planar arrangement at a distance removed from the dispensing units 1288, 1290 and 1292. Thus, the arrangement in FIG. 29 shows that the closed-loop distribution system of the present invention can also be used to supply dispensing units that are displaced in perpendicular directions relative to either the storage reservoir or the first dispensing unit or units that are served in the closed-loop system. It will therefore be appreciated that the description above contemplates any suitable arrangement of closed or open-loop distribution piping system among various dispensing units disposed upon a service station premises. It will further be appreciated that the closed-loop system may provide multiple parallel feeding of dispensing units relative to a storage reservoir, and may also provide multiple sequential feeding of dispensing units in series as part of the same closed loop. Although the arrangements shown herein generally disclose rectangularly-shaped distribution system piping arrangements, it will be realized that such arrangements tend to be easier and less expensive to design and install. However, the present invention is intended to support closed or open-loop designs of any suitable configuration for the feeding of any suitable configuration of dispensing units. In addition, it will further be appreciated that while these configurations have been set forth as being applicable to closed-loop designs, it will also be realized that the open-loop design set forth in FIGS. 20 and 21 may also utilize these principles.

Figure 31:
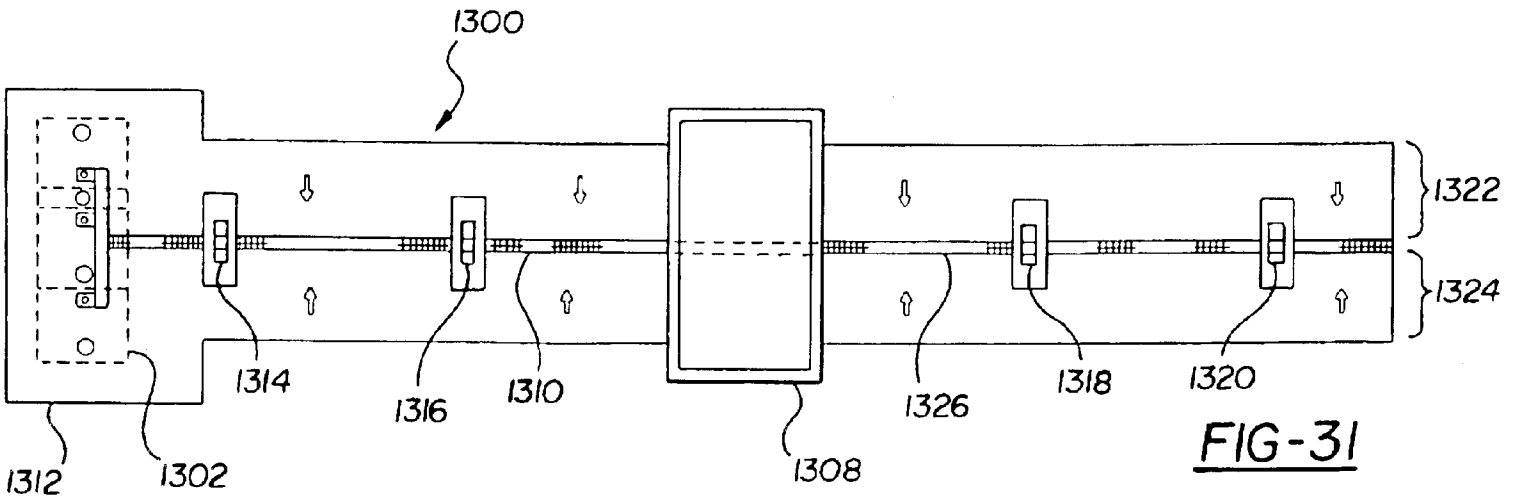
FIG. 31 is a plan view of the quick drain spill basin system of FIG. 30, shown as having a single spill basin and single drain trench arrangement.
Figure 32:
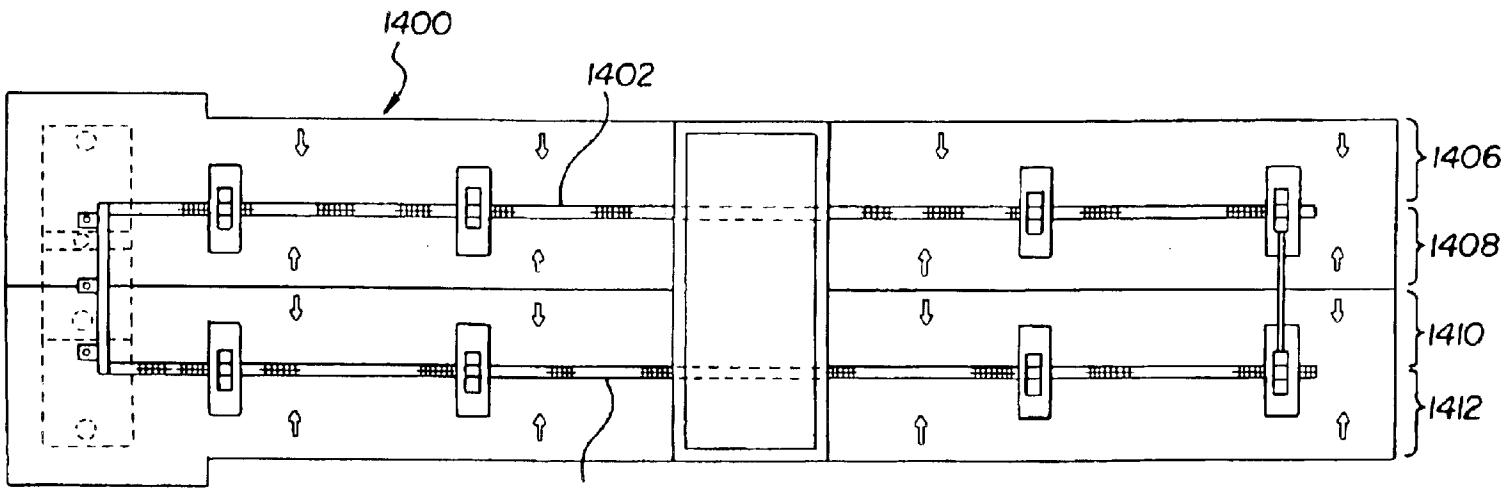
FIG. 32 is a plan view illustrating the quick drain spill basin system of the type shown in FIG. 31, with a double spill basin and double drain trench arrangement.

FIGS. 30–32 show yet another preferred embodiment of the present invention. Specifically, FIGS. 30–32 apply the additional principle of a quick drain spill basin to capture and contain surface spills such as those occurring on a service station premises. Although this principle is described in connection with particular examples, it will be appreciated that the spill basin principles may be utilized with any of the embodiments described herein.

FIG. 30 shows another version of integrated system of the present invention, generally at 1300. The integrated system 1300 includes a storage reservoir 1302 that is disposed below ground level as before. The integrated system 1300 also includes a canopy structure 1304, which may be of any configuration described herein or any other suitable configuration. A support structure is also provided, which includes support units 1306. In this figure, an optional convenience or cashier store 1308 of the type commonly found at automobile service stations is also shown. This embodiment of the integrated system includes a combination pipe and drain trench system that is operable in conjunction with specifically designed tilted concrete driveway surfaces, for directing surface spills so that they can be collected efficiently. Accordingly, the integrated system 1300 includes a combination pipe and drain trench 1310 that is preferably constructed as part of the concrete driveway 1312. The combination pipe and drain trench 1310 may be of any size or shape suitable for containing the amount of piping used for the distribution system. In addition, the trench 1310 should be of sufficient volume to adequately transport spilled fluid from upon the surface of the concrete driveway 1312. FIG. 30 also shows dispensing locations 1314, 1316, 1318 and 1320. These dispensing locations are intended to represent the location of items such as dispensing units.

Referring now to FIG. 31, there is shown a plan view of the quick drain spill basin system of FIG. 30. As can be seen in this view, the trench 1310 is disposed longitudinally along the length of the concrete driveway 1312 to the storage reservoir 1302. The concrete driveway 1312 is then tilted from each side of the trench 1310 at an angle toward the trench 1310, so as to direct surface spills into the trench 1310. Accordingly, these specially configured concrete driveway surfaces are designated as spill basin sections 1322 and 1324. The directions of the arrows upon the spill basin sections 1322 and 1324 show the direction of travel for any fluid spilled upon the concrete driveway surface within these sections. A grate 1326 or other suitable covering is preferably provided over the trench 1310. The grate 1326 should preferably be suitable for allowing spilled fluid to pass through it and into the trench 1310, while at the same time, allowing vehicles using the service station premises to travel over the grate 1326.

FIG. 32 shows an expanded arrangement for the quick drain spill basin system of the type shown in FIGS. 30 and 31. In this arrangement, an integrated system is provided at 1400 that includes a double spill basin and double drain trench arrangement. This arrangement includes two combination pipe and drain trenches at 1402 and 1404 that are fed by spill basin sections 1406, 1408, 1410 and 1412 in the directions indicated by the arrows upon each section. As can be seen from this figure, the quick drain spill basin system is designed to be used with any configuration of closed-loop or open-loop distribution piping system, such as those described in previous embodiments. It will be appreciated that any suitable configuration for the quick drain spill basin system may be used.

Figure 33:
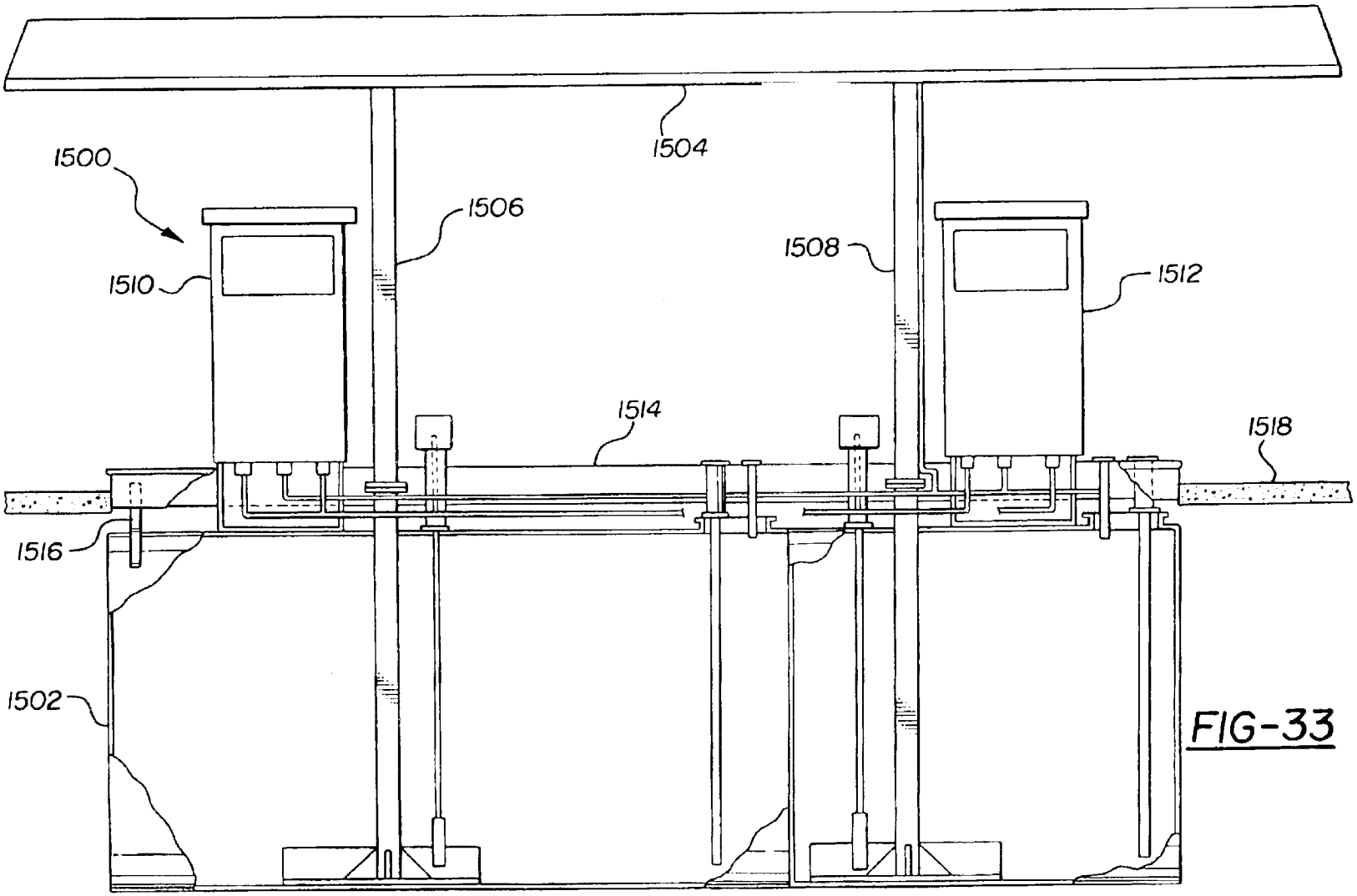
FIG. 33 is a partial cutaway view illustrating one version of an integrated system of the present invention in pre-assembled form from a factory, ready for on-site installation.
Figure 34:
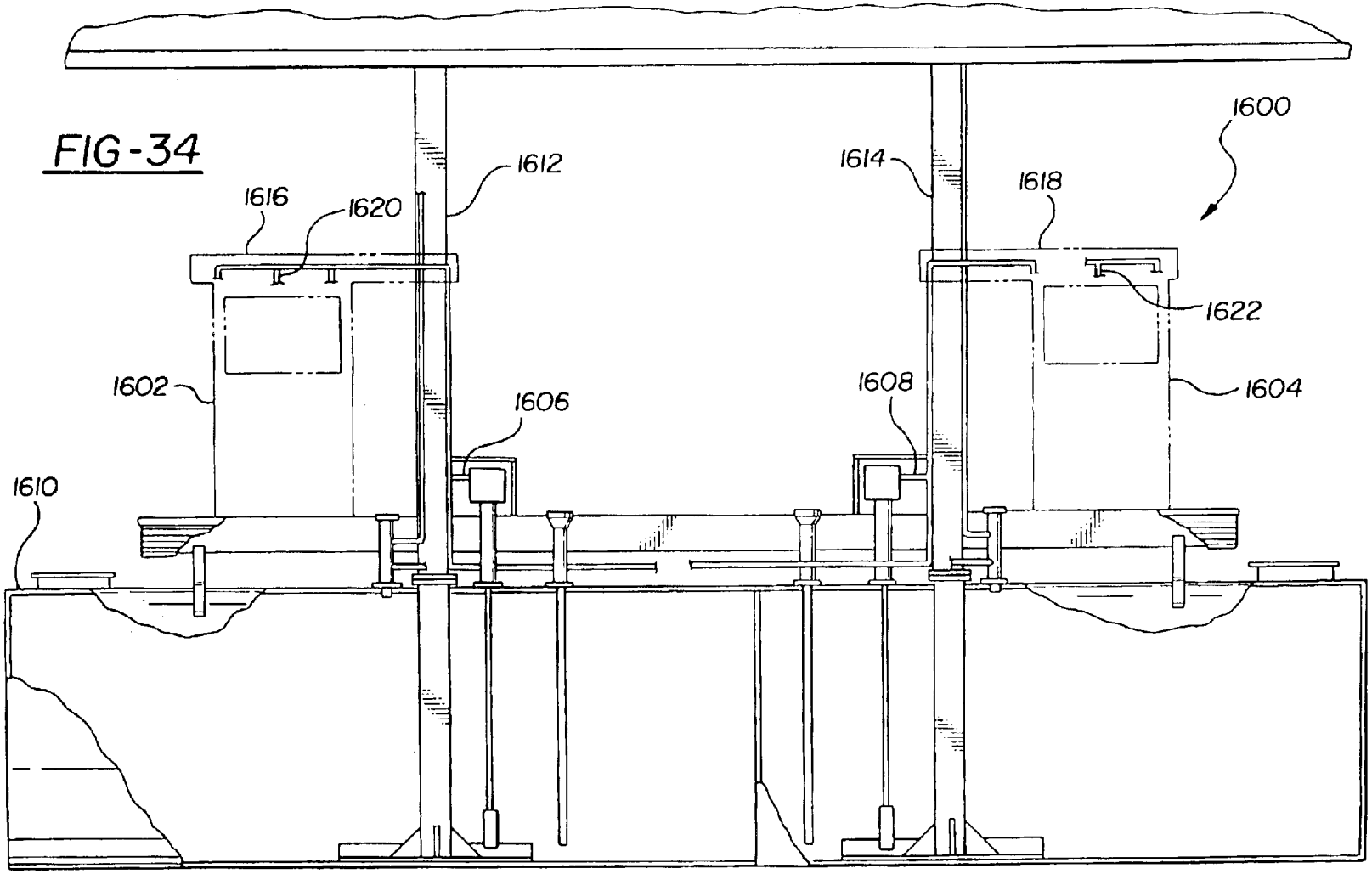
FIG. 34 is a partial cutaway view illustrating another version of an integrated system of the present invention in pre-assembled form from a factory, ready for on-site installation.

FIGS. 33 and 34 are provided in order to illustrate the ability of certain components of the integrated system of the present invention to be pre-assembled at a factory location for subsequent installation on site. In many of the embodiments previously discussed, much of the underground storage tank and underground piping is installed on site. Thus, these two figures are intended to show that the present invention also contemplates a more complete factory-assembled package that can be transported as a unit to a particular site for installation.

FIG. 33 shows an integrated system generally at 1500. The integrated system 1500 includes a storage reservoir 1502 and a canopy system which may include such components as the canopy 1504, or any other canopy arrangement, including a primary and secondary canopy arrangement. The integrated system 1500 also includes support units 1506 and 1508 which may be suitably connected to the storage reservoir 1502 in any of the ways described herein, or in other suitable ways. Dispensing units 1510 and 1512 are provided atop a service island 1514 that is attached to the storage reservoir 1502 by frame supports 1516. It will be appreciated that the remaining components associated with the delivery system and dispensing system, including any of the variations discussed in connection with any of the embodiments herein, are also considered to be part of this version of the integrated system 1500. These components are assembled at the factory as one unit, and are transported for on-site installation. A suitable pit is excavated within the ground so that the storage reservoir 1502 can be installed and anchored through means well known to those skilled in the art. Once the integrated system is in place, a concrete driveway such as that shown at 1518 in FIG. 33 can then be installed around the integrated system 1500. As can be seen in FIG. 33, this type of arrangement works best when the storage reservoir 1502 is located directly beneath the service island 1514. It will be appreciated, however, that other arrangements of the type described herein may also be possible for a factory-assembled system.

FIG. 34 illustrates another version of integrated system of the present invention generally at 1600. The integrated system 1600 includes many of the components described in connection with FIG. 33; therefore, they will not be repeated in detail here. FIG. 34 shows that the integrated system 1600 may also include distribution system piping in an above-ground secondary canopy arrangement, in a similar manner as described previously. Accordingly, FIG. 34 shows dispensing units 1602 and 1604 that are fed by lines of the first grade distribution system 1606 and second grade distribution system 1608. These distribution systems 1606 and 1608 feed the two dispensing units 1602 and 1604 with fluid from each compartment of the storage reservoir 1610. The first grade distribution lines and second grade distribution lines are shown to be located upon the support units 1612 and 1614, and are shown to reach the dispensing units 1602 and 1604 through the secondary canopy portions 1616 and 1618. In addition, Phase II recovery lines 1620 and 1622 are also shown to pass through the secondary canopy portions 1616 and 1618 for facilitating the return of vapors to the storage reservoir 1610. It will further be appreciated that the piping equipment of the distribution system and vapor recovery system may also be disposed within a primary canopy.

Figure 35:
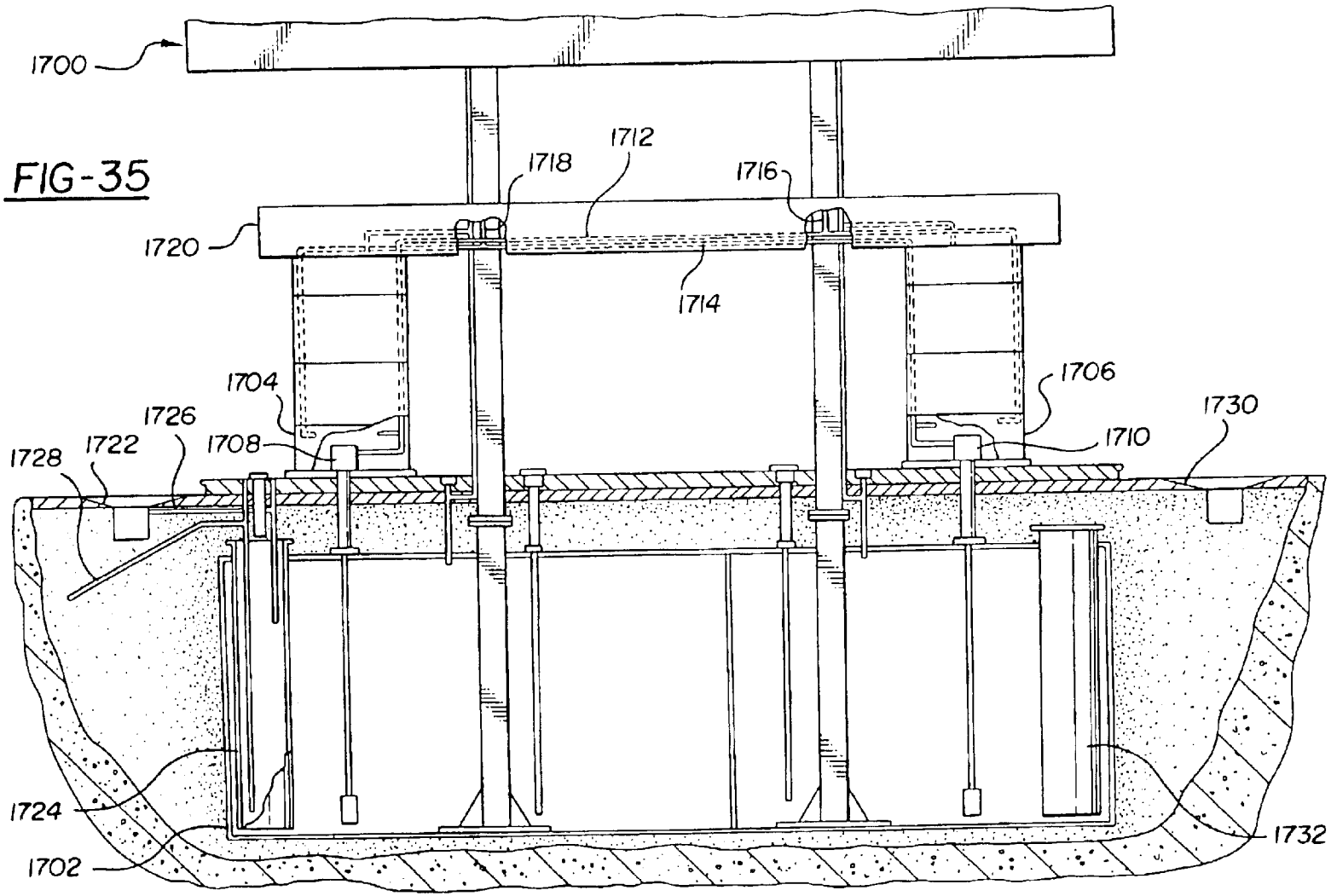
FIG. 35 is a partial cutaway view illustrating another version of an integrated system of the present invention, with distribution heads integrated within the dispensing units and a spill basin operating in conjunction with an oil-water separator.

Another embodiment of the present invention is shown in connection with FIG. 35. Again, many of the features in this figure are shared with previously described arrangements and are not repeated. In this arrangement, the integrated system 1700 includes an underground reservoir 1702 and two dispensing units 1704 and 1706 located directly above the reservoir 1702. Here, an alternate location for the distribution heads 1708 and 1710 is shown, within the dispensing units 1704 and 1706. In this arrangement, the distribution heads 1708 and 1710 are each in communication with a compartment of the reservoir 1702. Distribution system piping is associated with the distribution heads 1708 and 1710 so that each head is operable to feed the dispensing unit within which it is located, as well as remote dispensing units located on the same or adjacent service islands.

In FIG. 35, piping loops 1712 and 1714 are shown to feed fluid from the respective compartments of the reservoir 1702 to the dispensing units 1704 and 1706, while being located entirely within the dispensing units 1704 and 1706 and the secondary canopy 1720. In addition, lines 1716 and 1718 may optionally be connected to the piping loops 1712 and 1714 for connecting dispensing units of adjacent service islands. This arrangement provides an enhanced appearance by hiding the piping loops 1712 and 1714 from view. It will be appreciated that this arrangement may be duplicated for any embodiment described herein.

This embodiment is also intended to show that the spill basins described herein, such as at 1722, may also be disposed in communication with an oil-water separator 1724. In this arrangement, any fluid falling within the spill basin 1722 flows into the oil-water separator 1724 through line 1726. Water can be discharged from the separator 1724 by being connected to a sewer through outlet 1728. Also, the spill basin 1730 and the oil-water separator 1732 can be configured substantially similar to the spill basin 1722 and the oil-water separator 1724.

Figure 36:
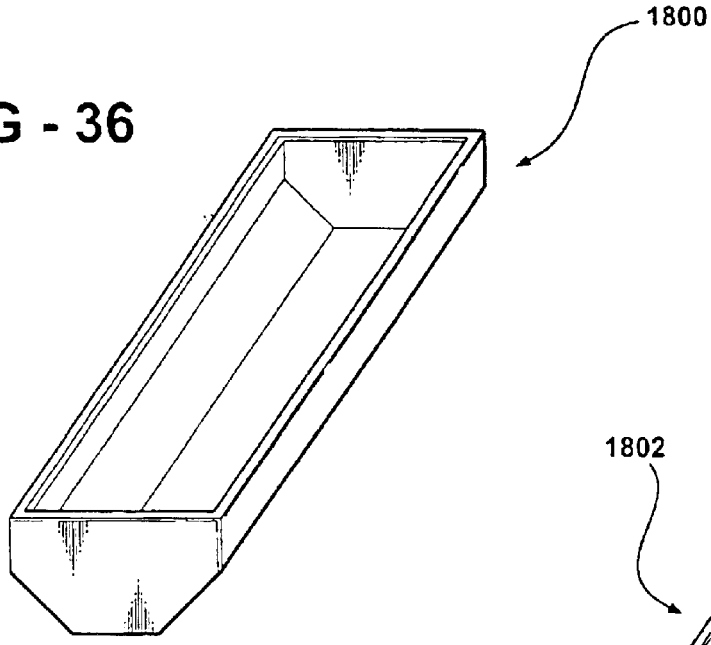
FIG. 36 is a perspective view illustrating one version of an enclosure forming part of the improved storage reservoir assembly of the present invention, having a semi-octagonal cross-section.
Figure 37:
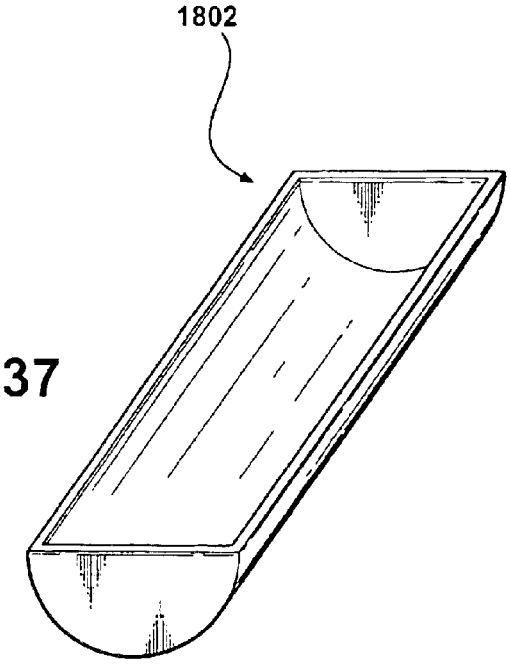
FIG. 37 is a perspective view illustrating another version of enclosure forming part of the improved storage reservoir assembly of the present invention, having a semi-circular cross-section.

In accordance with other embodiments of the present invention, shown in FIGS. 36–47, storage reservoir assemblies are provided having increased resistance to leakage of fluid from the assemblies into the surrounding ground. These assemblies include specially-designed tubs, or enclosures, used in conjunction with any of the underground storage reservoirs described herein, to at least partially surround the reservoirs from beneath, and thus provide additional barriers to fluid leakage. FIGS. 36 and 37 show, respectively, enclosures 1800 and 1802 according to the present invention, of semi-octagonal and semi-circular cross-section.

The enclosures 1800 and 1802 may be constructed of steel, fiberglass or other suitable material, and are preferably sized somewhat larger than the exterior dimensions of the reservoirs, to define a void which can be filled with a filling material that can serve as yet another barrier to fluid penetration. The enclosures are configured to partially surround at least a lower portion of a reservoir, such as below its beltline, defined by its maximum width, when the reservoir is disposed within a particular enclosure. When the enclosure 1800 or 1802 is positioned within an excavated pit in the ground and a reservoir is disposed within the enclosure, the enclosure prevents direct contact of the reservoir with the surrounding ground. In this way, the likelihood of leakage of a storage reservoir is decreased, because electrolysis is no longer likely to occur from continued contact of the reservoir surface with wet ground.

Figure 38:
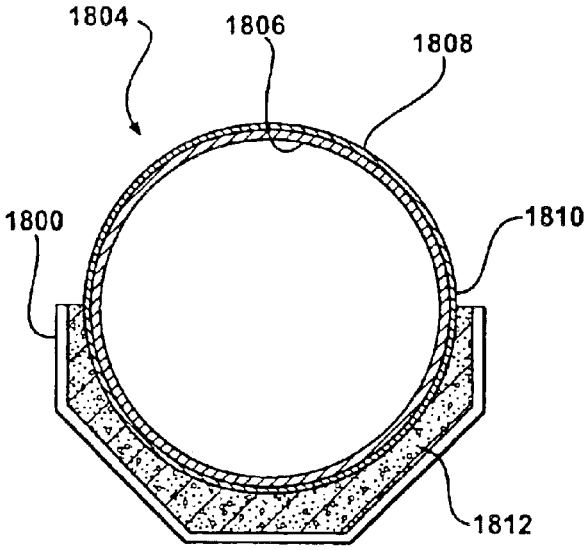
FIG. 38 is a cross-sectional view illustrating the relationship of a storage reservoir disposed partially within an enclosure of the type shown in FIG. 36.

FIG. 38 is a cross-sectional view illustrating how the various embodiments of FIGS. 36–47 enhance the resistance of such storage reservoir assemblies to leakage of fluid. FIG. 38 shows a double-walled reservoir 1804 disposed within enclosure 1800. The reservoir 1804 is positioned relative to the enclosure 1800 so that a lower portion, preferably at least half, of the reservoir 1804 is surrounded by the enclosure 1800. The reservoir 1804 is of a double-walled variety, having an interior wall 1806 and an exterior wall 1808. The reservoir 1804 may preferably be wrapped by a suitable wrapping material, such as a polyethylene wrap 1810. The wrapping material 1810 is preferably suitable for decreasing the accumulation of moisture outside the reservoir and/or increasing the resistance of fluid from within the storage reservoir from leaking into the ground. In a preferred embodiment of the present invention, the enclosure 1800 is spaced from the reservoir 1804 so as to define a void 1812 between the reservoir 1804 and the enclosure 1800. The void 1812 is preferably filled with a filling material suitable for decreasing leakage of fluid into the ground and/or assisting maintaining the buried condition of the reservoir within the ground. Suitable filling materials include pea gravel, concrete, portland cement and mixtures thereof. In FIG. 38, the void 1812 is shown to be filled with concrete.

As shown in FIG. 38, the enclosure 1800 or 1802 is preferably constructed to be of a size suitable for surrounding at least a lower portion of the reservoir 1804. Preferably, the enclosure 1800 or 1802 substantially surrounds the reservoir at least below a beltline of the reservoir, defined by the reservoir's maximum width. Thus, FIG. 38 shows that a multiple barrier arrangement contemplated by the present invention is intended to increase resistance to leakage of fluid from within the reservoir 1804, or any other reservoir used as part of the present invention. Five separate fluid barriers are shown in FIG. 38: the interior reservoir wall 1806, the exterior reservoir wall 1808, the wrapping material 1810, the filling material within the void 1812 and the enclosure 1800. It will be appreciated that the principles set forth with regard to FIGS. 36–38 may be applied throughout this description to the improved storage reservoir assembly embodiments described herein.

Figure 39:
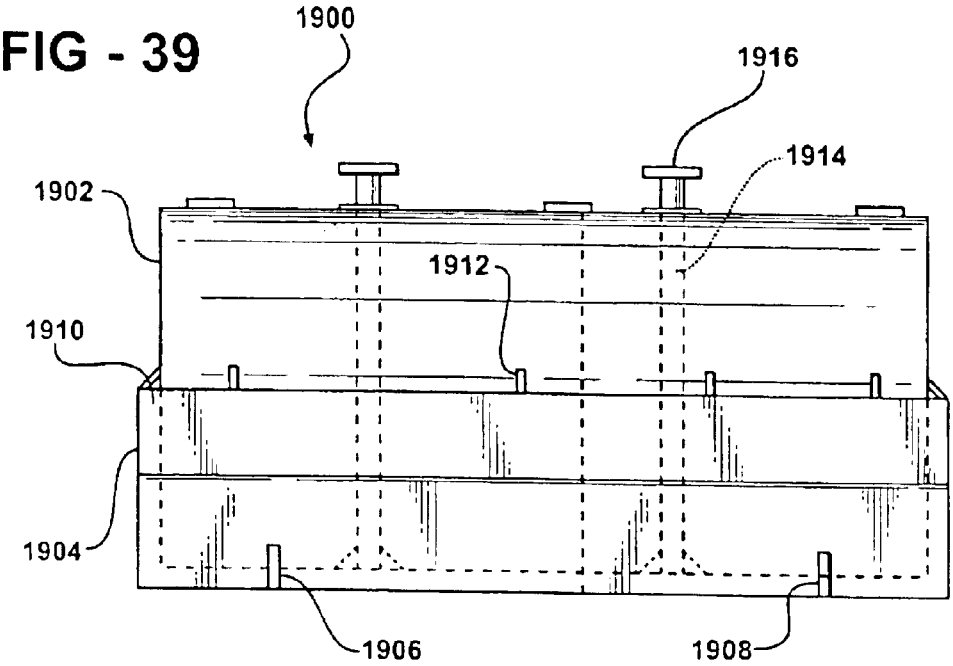
FIG. 39 is a side view illustrating one embodiment of improved storage reservoir assembly of the present invention, including a storage reservoir disposed within, and attached to, an enclosure, and a plurality of support units connected to the reservoir for attachment to an above-ground canopy.

Referring now to FIG. 39, there is shown an improved storage reservoir assembly 1900 in accordance with yet another embodiment of the present invention. The assembly 1900 includes a reservoir 1902 which is partially surrounded by an enclosure 1904. Support saddles 1906 and 1908 are optionally, but preferably, inserted between the lower exterior of the reservoir 1902 and the lower interior surface of the enclosure 1904 to provide a separation between the reservoir 1902 and the enclosure 1904. The support saddles 1906 and 1908 may be attached to either the reservoir 1902 or the enclosure 1904, through welding or any other suitable means. Use of the support saddles 1906 and 1908 maintains a separation between the reservoir 1902 and the enclosure 1904 to define a void 1910 about the entire lower portion of the reservoir 1902 and within the enclosure 1904.

In this embodiment, the reservoir 1902 is shown to be optionally attached to the enclosure 1904 through the use of a plurality of welded gussets 1912 disposed at intervals about the reservoir 1902. Securing the reservoir 1902 to the enclosure 1904 enhances the maintenance of the buried condition of the reservoir 1902 within the ground. When the void 1910 is filled with a suitable filling material, such as concrete, the weight added to the enclosure 1904 assists in maintaining a buried condition of the attached reservoir 1902 within the ground.

The assembly 1900 also includes at least one support unit 1914 which may be attached to the reservoir 1902 in any of the ways described herein. Each such support unit 1914 may preferably be disposed within the reservoir 1902 and project outside the reservoir, as shown in FIG. 39, for attachment to an above-ground canopy. Preferably, canopy support platforms, such as that shown at 1916, are provided atop the support units 1914 for ready attachment to canopy support columns (not shown) during on-site installation.

It will be noted that the improved storage reservoir assembly 1900 of the present invention may be assembled in different ways. In one method, the reservoir 1902 and the enclosure 1904 are brought as separate components to the installation site. The enclosure 1904 is positioned within an excavated pit and the reservoir 1902 is subsequently placed within the enclosure 1904. The reservoir 1902 may optionally be attached to the enclosure 1904 at that time, such as through the use of gussets 1912. Also, optionally, anchors of the type shown in later embodiments may be attached to the reservoir 1902 or the enclosure 1904 and disposed either within or outside the enclosure 1904. The void 1910 is then filled with a suitable filling material of the types previously described. Following this, the remainder of the excavated pit may preferably be filled with a backfill material selected from the group consisting of pea gravel, portland cement, concrete, mixtures thereof, and discrete volumes thereof.

In another manner of installing the assembly 1900, the reservoir 1902 and the enclosure 1904 are factory manufactured as a substantially assembled unit for subsequent on-site installation. When the assembly is substantially factory assembled, the steps of installation described above including placing the reservoir 1902 within the enclosure 1904, optionally attaching the reservoir 1902 to the enclosure 1904, optionally installing support saddles 1906 and 1908, and filling the void 1910 with a suitable filling material are all performed at the manufacturing facility. As a third option, which facilitates transportation, the assembly 1900 is manufactured as a unit but the void 1910 is not filled with the filling material until the assembly 1900 is placed within an excavated pit at the installation site.

Figure 40:
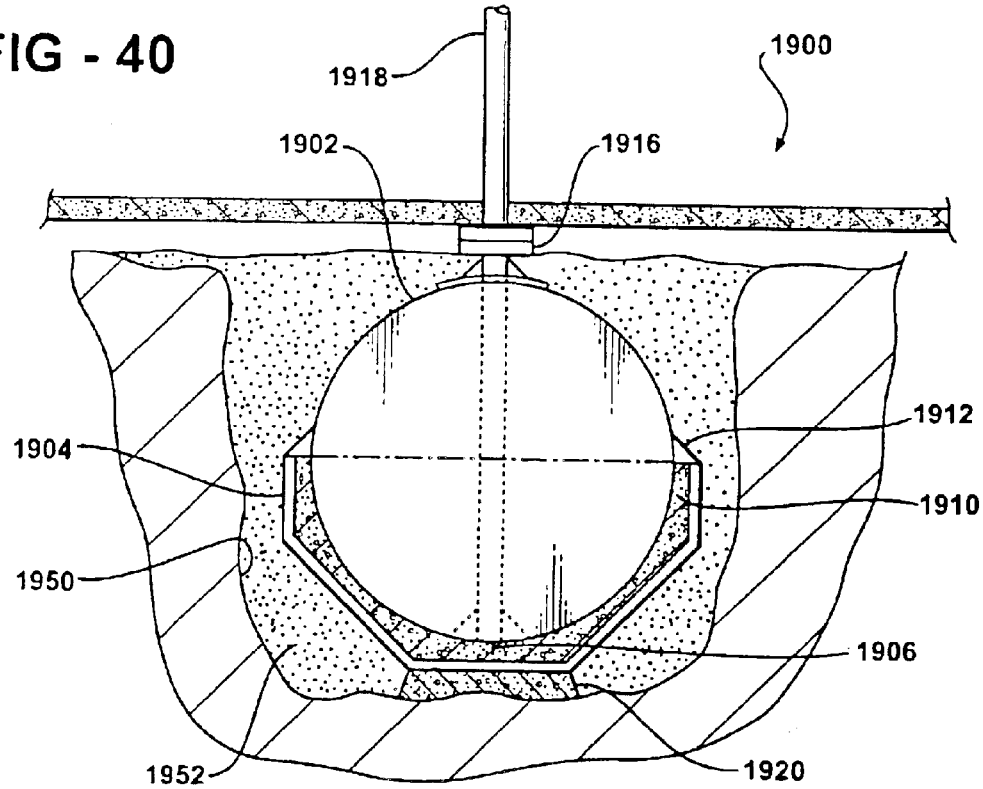
FIG. 40 is a cross-sectional view of one embodiment of improved storage reservoir assembly of the present invention, installed within an excavated pit in the ground, and including a storage reservoir disposed partially within an enclosure of semi-octagonal cross-section, and atop a support base, with a support unit connected to the reservoir and attached to a canopy column.

Referring now to FIG. 40, the improved storage reservoir assembly 1900 of FIG. 39 is shown in an installed condition within an excavated pit 1950. The reservoir 1902 is disposed within the enclosure 1904, and separated by support saddles 1906, in similar manner as before. The void 1910 is filled with concrete and gussets 1912 are shown to attach the reservoir 1902 to the enclosure 1904. In this figure, a canopy column 1918 is attached to the support unit 1914 at the canopy support platform 1916, and extends above ground level. Also, a support base 1920, made of any suitable material, including concrete, is disposed beneath the enclosure 1904. Use of the support base 1920 prevents direct contact of the enclosure 1904 with the bottom of the excavated pit 1950 within which the assembly 1900 is installed. Backfill material 1952, which may be of any selection previously described, is shown to fill the remainder of the excavated pit 1950.

Figure 41:
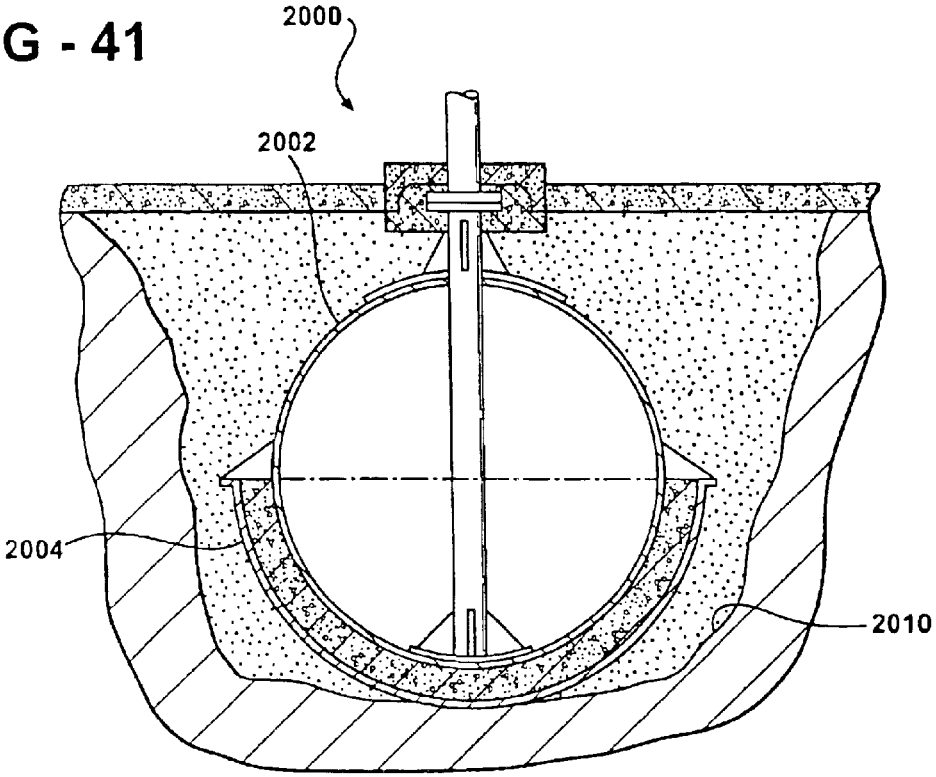
FIG. 41 is a cross-sectional view illustrating another embodiment of improved storage reservoir assembly of the present invention installed within an excavated pit in the ground, including a reservoir disposed partially within an enclosure of semi-circular cross-section and an attached support unit.

FIG. 41 shows yet another embodiment of the improved storage reservoir assembly of the present invention, generally at 2000. A reservoir 2002 is again disposed within an enclosure 2004, this time of similar semi-circular cross-section as the enclosure 1802 of FIG. 37. In this arrangement, however, the assembly 2000 is shown to be installed within an excavated pit 2010 without the use of a support base, such as that shown at 1920 in connection with FIG. 40.

Figure 42:
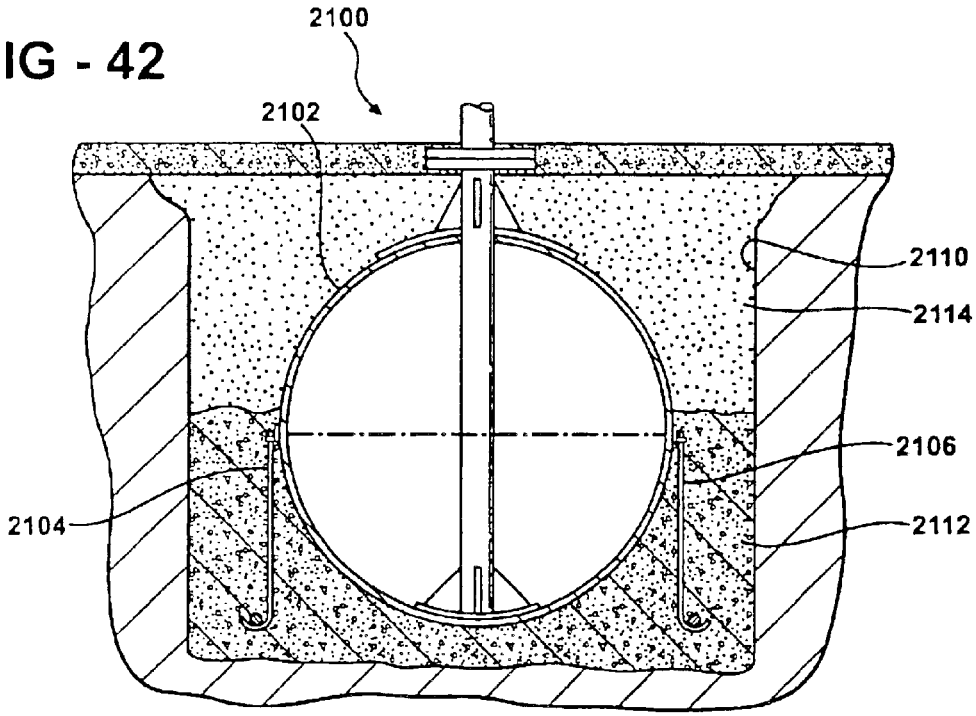
FIG. 42 is a cross-sectional view illustrating another embodiment of improved storage reservoir assembly of the present invention installed within an excavated pit in the ground, wherein anchor rods are used to assist in maintaining the buried condition of the reservoir, with the anchor rods and a lower portion of the reservoir buried in concrete.

Referring now to FIG. 42, there is shown yet another embodiment of the improved storage reservoir assembly of the present invention, generally at 2100. In this embodiment, a reservoir 2102 is shown to be located within an excavated pit 2110, with anchor rods 2104 and 2106 attached to the reservoir 2102. Both the anchor rods 2104 and 2106, and the lower portion of the reservoir 2102, are buried in concrete 2112. It will be noted that in this embodiment, no enclosure of the type previously described is used, and the concrete 2112 fills the remainder of the lower portion of the excavated pit 2110 just above the approximate beltline of the reservoir 2102. The remaining portion of the excavated pit 2110 is shown to be filled with pea gravel 2114. Thus, the use of concrete 2112 in an excavated pit 2110 can itself also serve to enhance resistance to leakage from a reservoir, without the use of a separate enclosure, by preventing direct contact of the reservoir with the ground, which may be wet, as previously stated. This embodiment is also intended to show that the remainder of an excavated pit can be filled with discrete volumes of separate filling materials. One such filling material can be concrete, the same preferred material used to fill the void between the reservoir and enclosure in previous embodiments. When concrete is used to fill the portion of the excavated pit 2110 to approximately the beltline of the reservoir 2102 (again defined by the reservoir's maximum width), this serves to assist in maintaining a buried condition of the reservoir 2102 within the ground, especially when the concrete 2112 is used in conjunction with anchor rods 2104 and 2106.

Figure 43:
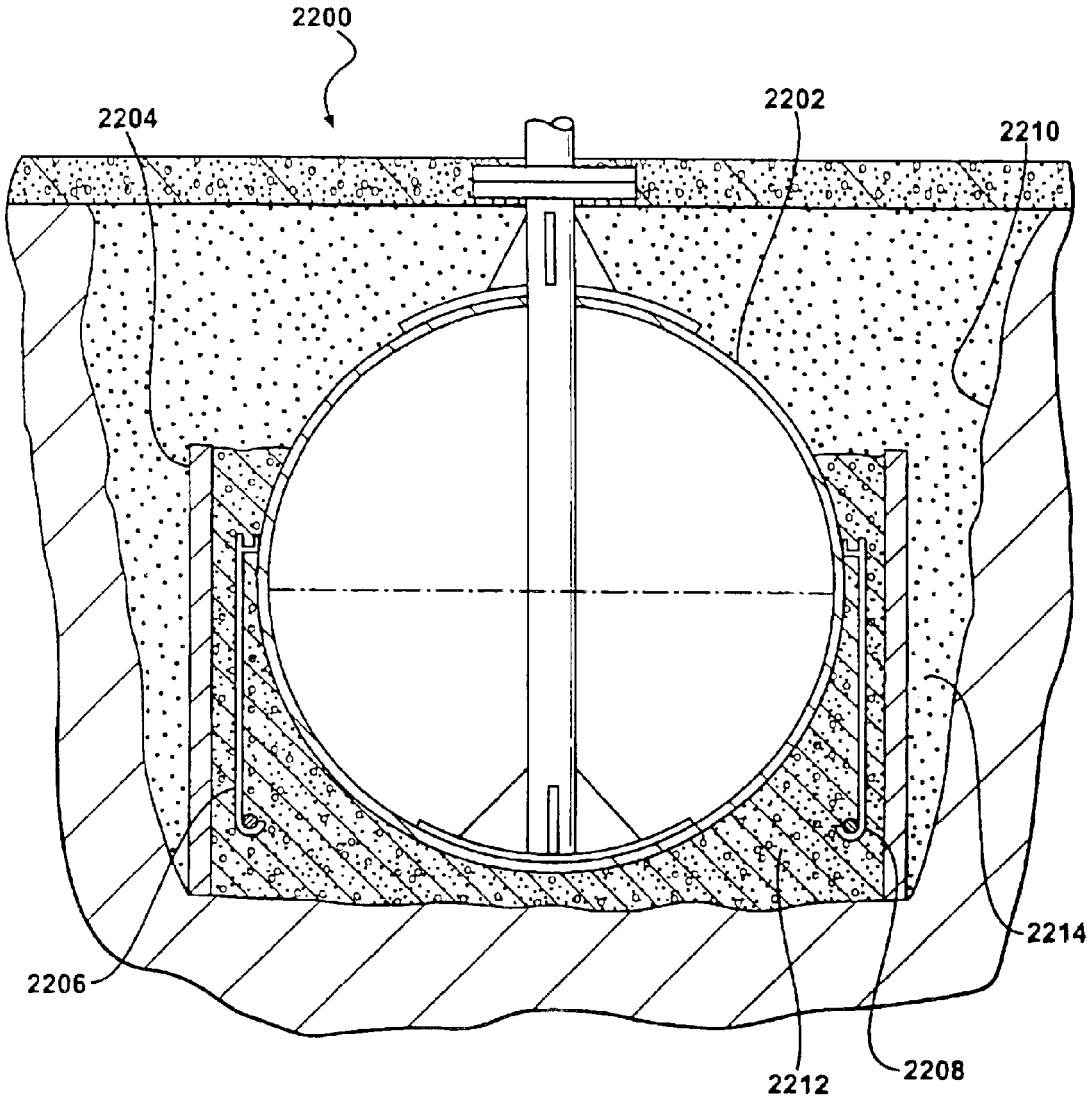
FIG. 43 is a cross-sectional view illustrating another embodiment of improved storage reservoir assembly of the present invention installed within an excavated pit in the ground, having an enclosure formed of plywood and wood studs surrounding an anchored reservoir, wherein the void between the enclosure and reservoir is filled with concrete.

Referring now to FIG. 43, there is shown yet another embodiment according to the present invention. In this embodiment, an improved storage reservoir assembly, shown generally at 2200, includes a reservoir 2202 and an enclosure 2204. In this embodiment, however, the enclosure 2204 is constructed of plywood and wood studs in a frame-type arrangement that either partially or substantially surrounds the reservoir 2202. Thus, this plywood and wood stud arrangement forms an enclosure 2204 which contains filling material in similar manner as before. Optionally, anchor rods 2206 and 2208 may again be attached to the reservoir 2202 and are disposed within concrete 2212 for both decreasing the likelihood of fluid leakage and for assisting in maintaining the buried condition of the reservoir 2202 within the excavated pit 2210. The remainder of the excavated pit 2210, outside the enclosure 2204, is shown to be filled with pea gravel 2214.

Figure 44:
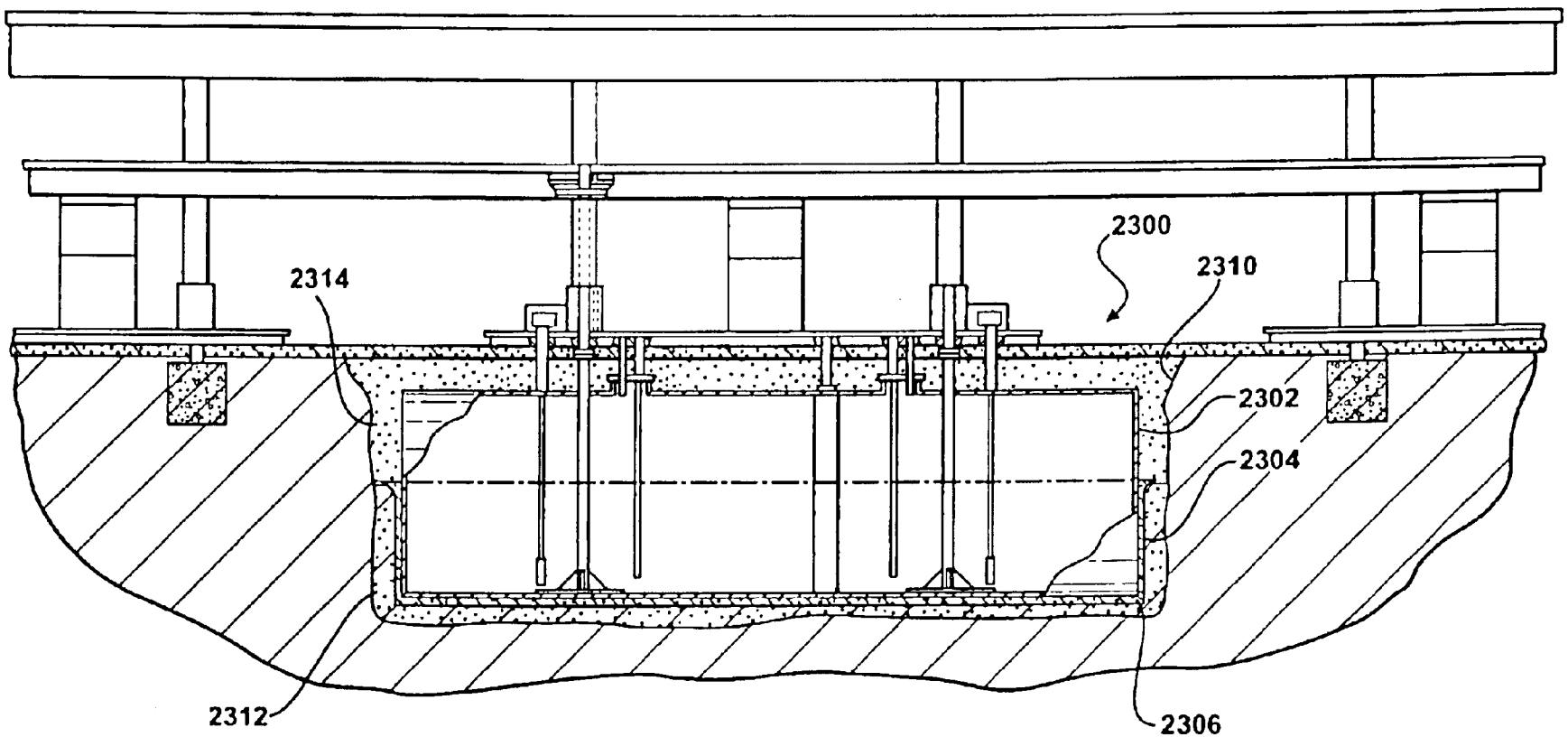
FIG. 44 is a side partial cut-away view illustrating an embodiment of improved storage reservoir assembly of the present invention in the context of an automobile service station.

FIG. 44 shows an improved storage reservoir assembly, generally at 2300, in the context of a complete automobile service station. The assembly 2300 includes a reservoir 2302 which is partially surrounded by an enclosure 2304, in similar manner as before. The void 2306, between the reservoir 2302 and the enclosure 2304, is again filled with concrete. In this arrangement, the remaining portion within the excavated pit 2310 external to the enclosure 2304 is filled with concrete 2312 up to approximately the beltline of the reservoir 2302. The remainder of the excavated pit 2310 above the concrete 2312 is shown to be filled with pea gravel 2314. It will thus be appreciated that any combinations of reservoir and enclosure configurations, void filling materials and backfill materials for the excavated pit can be used, and are interchangeable among the various embodiments described herein.

Figure 45:
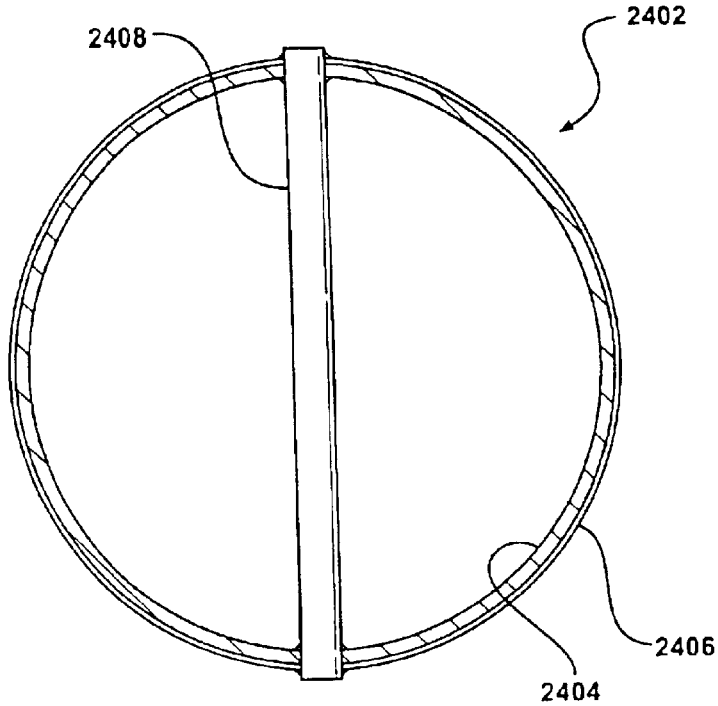
FIG. 45 is a cross-sectional view illustrating another embodiment of storage reservoir which can form a portion of an improved storage reservoir assembly of the present invention, wherein the reservoir is provided with a fluid-tight passageway for the insertion of a support unit for supporting an above-ground canopy.

FIG. 45 illustrates a different configuration for a storage reservoir according to a different embodiment of the present invention. The reservoir, shown generally at 2402, is shown to be of a double-walled variety, including an interior wall 2404 and an exterior wall 2406. In this embodiment, the reservoir 2402 is provided with at least one fluid-tight passageway 2408, disposed vertically through the reservoir 2402. It will be appreciated that other configurations and locations for the passageway 2408 may be used. For example, although the passageway 2408 is shown to extend vertically through the central portion of the reservoir 2402, other passageway configurations may extend through other portions of the reservoir 2402.

The passageway 2408 is suitable for accommodating the insertion of a support unit of the type used to support an above-ground canopy in previous embodiments. Thus, in this arrangement, a support unit can be extended through the passageway 2408 for supporting an above-ground canopy from beneath the reservoir 2402, without placing the weight of an above-ground canopy upon the reservoir 2402.

Figure 46:
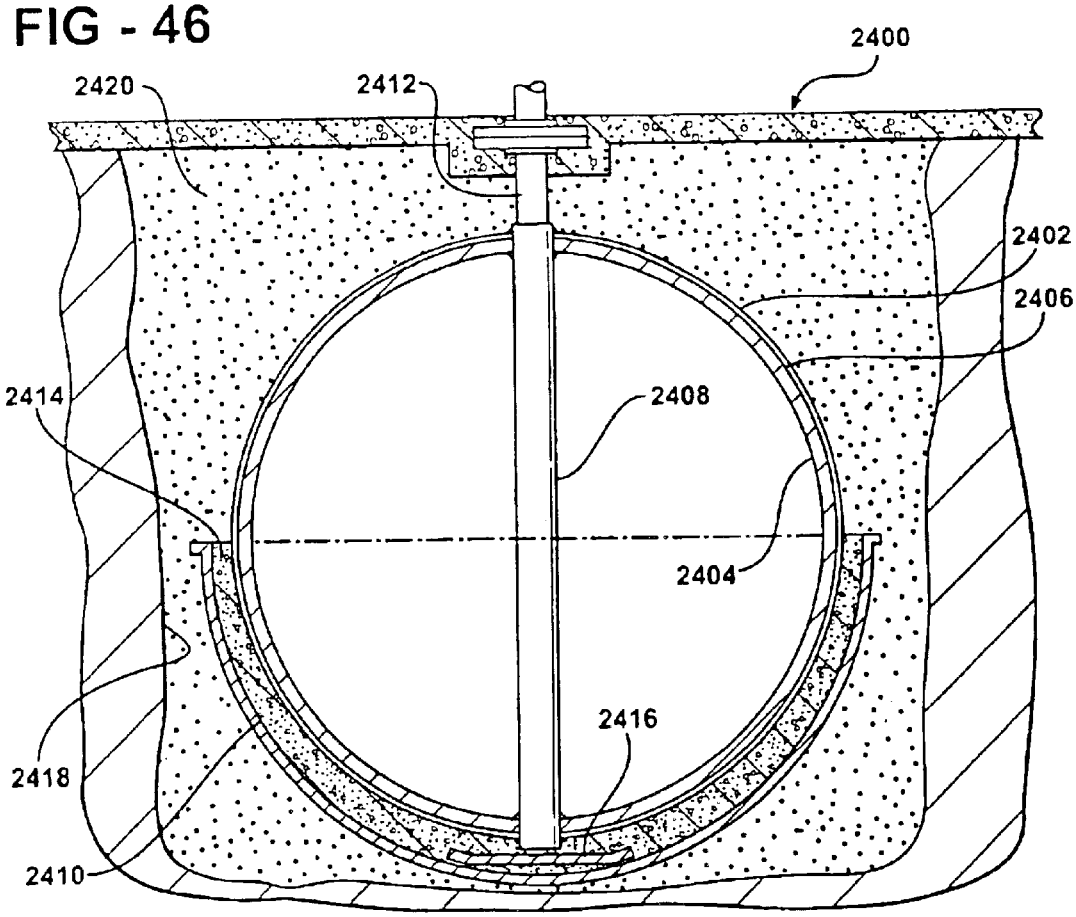
FIG. 46 is a cross-sectional view illustrating another embodiment of improved storage reservoir assembly of the present invention, installed within an excavated pit within the ground, and including the reservoir of FIG. 45 disposed partially within an enclosure of semi-circular cross-section, with a support unit disposed within the reservoir passageway.

FIG. 46 shows a cross-sectional view of the reservoir 2402 in an installed arrangement within an enclosure 2410, as part of an improved storage reservoir assembly 2400. A support unit 2412, of the type suitable for attachment to an above-ground canopy, is disposed through the passageway 2408. In this arrangement, the support unit 2412 is operable to support the weight of an attached above-ground canopy external to, or separate from, the reservoir. Thus, the majority of the weight of an attached above-ground canopy will be borne by one or more support units 2412. In the preferred arrangement shown in FIG. 46, a support unit 2412 extends through the passageway 2408. A support unit base 2416 can be attached to the lower end of the support unit 2412 to assist in distributing the weight of any attached above-ground canopy. In this arrangement, the lower end of the support unit 2412, preferably with an attached support unit base 2416, can preferably be disposed within concrete used as filling material within the void 2414. In similar manner as before, the remainder of the excavated pit 2418 can be filled with pea gravel 2420.

Figure 47:
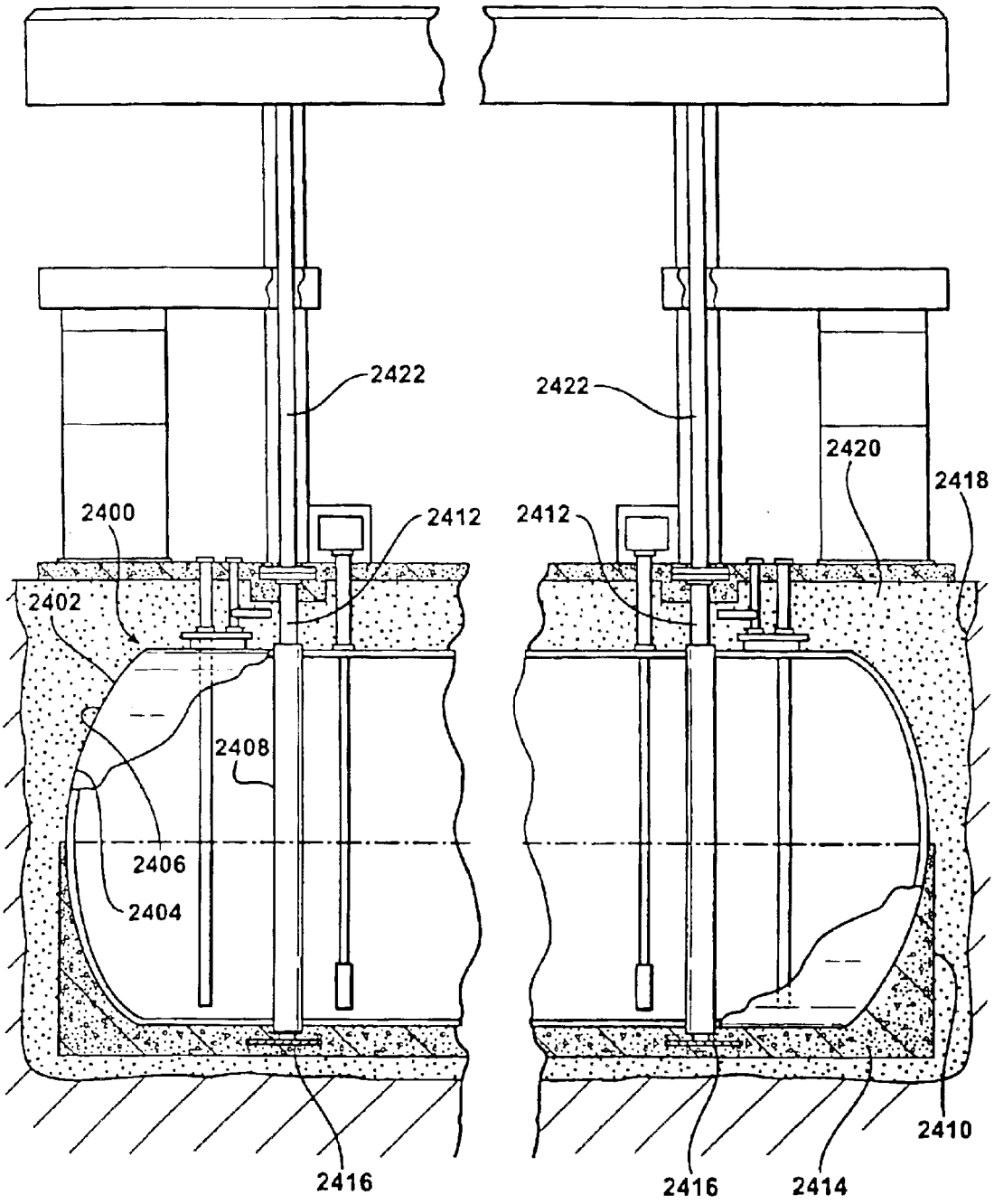
FIG. 47 is a side partial cut-away view illustrating the assembly of FIG. 46 in the context of an automobile service station.

Referring now to FIG. 47, there is shown a side partial cutaway view of the embodiment of the improved storage reservoir assembly 2400 from FIG. 46, in the context of an automobile service station. Here, the reservoir 2402 is shown to include two support units 2412 disposed within two passageways 2408. The support units 2412 are attached to canopy support columns 2422.

In accordance with yet other embodiments of the present teachings, shown in FIGS. 48–51, storage reservoir assemblies are provided wherein a reservoir may be partially or substantially surrounded with a second fluid, such as water or brine, which is capable of identifying a leaking condition of the reservoir by detected infiltration of the surrounding second fluid into the reservoir. This arrangement can be achieved through use of a double-walled reservoir or a single-walled reservoir surrounded by an enclosure of the types described herein. Such reservoir assemblies may be integrated into an underground storage reservoir and above-ground canopy system having increased resistance to leakage of fluid into the ground.

Figure 48:
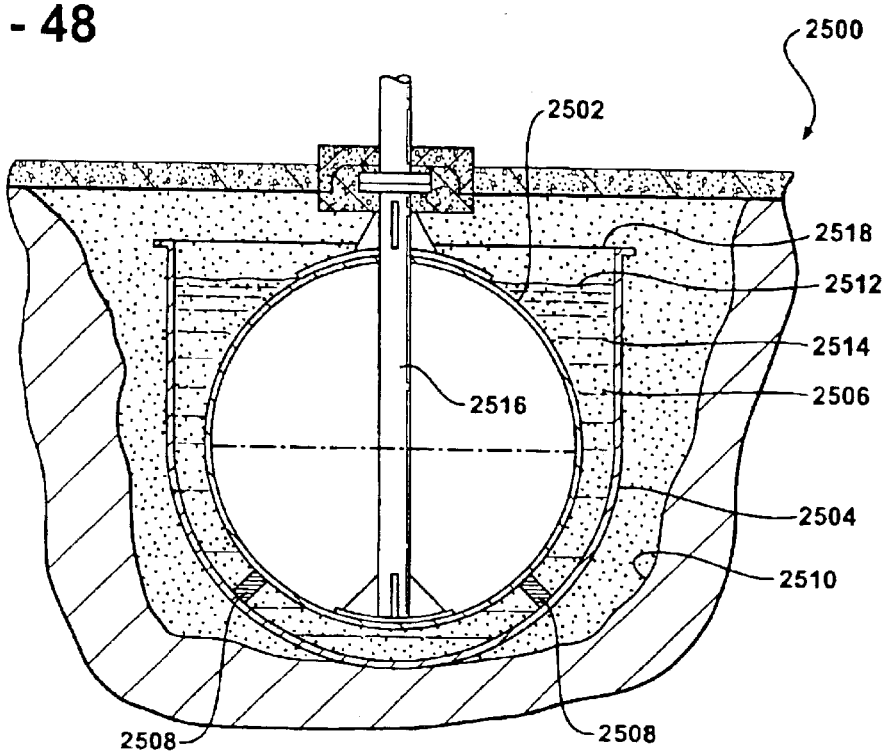
FIG. 48 is a cross-sectional view illustrating another improved storage reservoir assembly of the present invention installed within an excavated pit in the ground, including a reservoir disposed substantially within an enclosure of U-shaped cross-section and a support unit extending within the reservoir.

Referring now to FIG. 48, there is shown an end cross-sectional view of an improved storage reservoir assembly at 2500, in an installed condition, again in the context of an automobile service station. The assembly 2500 includes a single-walled reservoir 2502, again disposed within an enclosure 2504 and located within an excavated pit 2510 and surrounded by a filler material such as pea gravel. The reservoir 2502 may be constructed of steel, fiberglass or other suitable material. The enclosure 2504 may be constructed of steel, fiberglass or other suitable material.

The enclosure 2504 is shown to be of semi-circular cross-section in its lower portion, although other suitable shapes for the lower portion can also be used. The walls of the enclosure 2504 are expanded to extend upwardly near or above the top of the reservoir 2502, making the enclosure 2504 approximately U-shaped in cross-section. As such, the enclosure 2504 is operable to surround most or all of the total height of the reservoir 2502. The enclosure 2504 is spaced from the reservoir 2502, typically by about six to eight inches, to define a void 2506 therebetween. This spacing may be assisted by at least one support spacer 2508 disposed within the enclosure 2504 beneath the reservoir 2502 for supporting the reservoir within the enclosure. The support spacers 2508 may be welded to the interior lower surface of the enclosure 2504 for maintaining a stationary support position. It may also be shaped and sized to allow for any filler(s) and or fluid of the type described below to be introduced without obstruction. The enclosure 2504 may be attached to the reservoir 2502 by a plurality of attachment devices (not shown) of the type well known to those skilled in the art, including straps, belts and welded gussets. Also, optionally, the enclosure 2504 may be suitably sized and spaced from the reservoir 2502 to allow a person to crawl inside the enclosure to inspect the external surface of the reservoir.

The void 2506 between the reservoir 2502 and the enclosure 2504 may be filled with a second fluid 2512 that is capable of identifying a leaking condition of a first fluid stored within the reservoir 2502. Suitable selections for the second fluid include water or brine, although it will be appreciated that others fluids may be used. This arrangement is intended to provide a hydrostatic head of the second fluid 2512 around the reservoir 2502 at all times, so that any leaks that do occur in the reservoir 2502 result in infiltration of the second fluid 2512 into the reservoir 2502, thereby reducing the likelihood of leakage of the first fluid stored within the reservoir 2502 into the surrounding ground. Also, optionally, the void 2506 may be partially or completely filled with a filler material, such as pea gravel 2514, which takes up some of the void space while still allowing for the introduction of the second fluid 2512. In the installation of the integrated underground storage reservoir and above-ground canopy system of the types described herein, the reservoir 2502 and enclosure 2504 are typically manufactured either as individual units or as a two-piece unit off-site and are installed on-site in the relationship described previously within an excavated pit, and subsequently filled on-site with the second fluid and optional filler material.

The assembly 2500 also provides for the detection of any leaks that do occur in the reservoir 2502 for subsequent repair such as by patching from inside the reservoir 2502. This detection can be accomplished by the use of sensors of the type well known to those skilled in the art (not shown) for detecting infiltration of the second fluid 2512 into the reservoir 2502 and/or a lowering of the level of the second fluid 2512 within the enclosure 2504. Where water, brine or other suitable fluid is used as the second fluid, the difference in density between the first and second fluids will cause any infiltrating second fluid to settle to the bottom of the reservoir 2502, where it can be detected by one or more sensors located at that location. Suitable sensors can also be located along the height of the enclosure 2504 for detecting any drop in the height of the second fluid 2512 within the enclosure 2504. Any amount of the second fluid 2512 within the enclosure 2504 that may evaporate over time can be periodically replaced and/or kept filled either manually or by an optional automatic refilling supply system (not shown) of the type well known to those skilled in the art. Optionally, covering the top of the enclosure 2504 with a polyethylene, other plastic or any other suitable covering material 2518 may decrease evaporation of the second fluid 2512 from within the enclosure. In addition, FIG. 48 shows an arrangement where at least one support unit 2516 is disposed within the reservoir and projects outside the reservoir for attachment to an above-ground canopy (such as in FIGS. 41–43).

Figure 49:
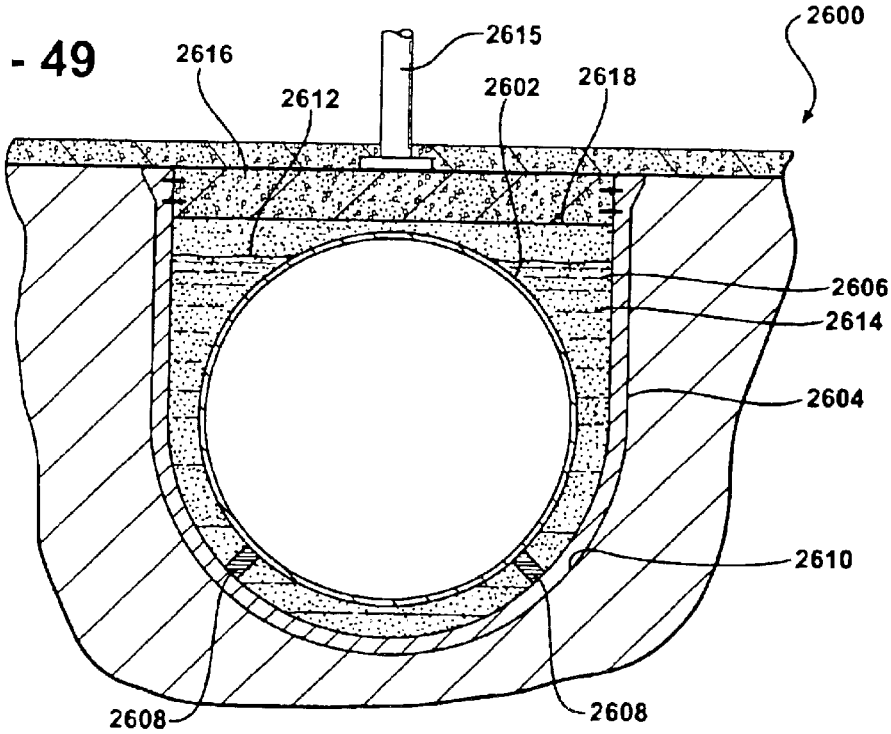
FIG. 49 is a cross-sectional view illustrating another improved storage reservoir assembly of the present invention installed within an excavated pit in the ground, including a reservoir disposed substantially within a concrete enclosure of U-shaped cross-section and an adjacently disposed canopy support system.

Enclosures of the present invention may also be constructed of suitable waterproof concretes such as a "shotcrete" or gunite concrete similar to the types used for in-ground swimming pools, which may be coated with a plaster coating or other suitable sealer for waterproofing. These constructions can be made directly within the ground without being surrounded by pea gravel or other fill material, in similar manner as a conventional in-ground swimming pool. Referring now to FIG. 49, there is shown an end cross-sectional view of an improved storage reservoir assembly at 2600, which includes a single-walled reservoir 2602, disposed within such a concrete enclosure 2604 that may be constructed directly within an excavated pit 2610 that is pre-sized and pre-shaped to accommodate the concrete enclosure 2604 without the use of pea gravel or other filler outside the enclosure 2604. A concrete beam or slab 2616 may also be constructed atop the enclosure 2604 at its opening.

The enclosure 2604 is again spaced from the reservoir 2602 to define a void 2606 therebetween. This spacing may again be assisted by at least one support spacer 2608 disposed within the enclosure 2604 beneath the reservoir 2602 for supporting the reservoir within the enclosure. The void 2606 between the reservoir 2602 and the enclosure 2604 may again be filled with a second fluid 2612 that is capable of identifying a leaking condition of a first fluid stored within the reservoir 2602. Again, optionally, the void 2606 may be partially or completely filled with a filler material, such as pea gravel 2614, and the top of the enclosure 2604 may be covered with a polyethylene, other plastic or any other suitable covering material 2618 for decreasing evaporation of the second fluid 2612 from within the enclosure. The arrangement shown in FIG. 49 also includes a support system for an above-ground canopy, including support unit 2615, that may alternatively be disposed adjacent to, instead of within, the reservoir 2602. However, it will be appreciated that a support unit extending through the interior of the reservoir may also be used with a concrete enclosure arrangement.

Figure 50:
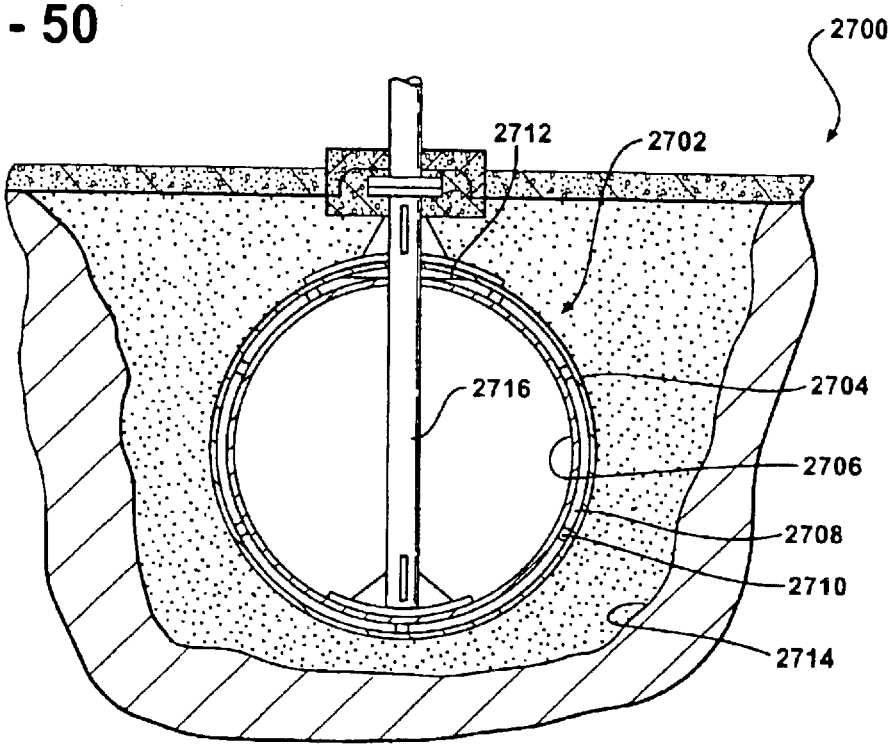
FIG. 50 is a cross-sectional view illustrating another improved storage reservoir assembly of the present invention installed within an excavated pit in the ground, including a double-walled reservoir and an attached support unit.
Figure 51:
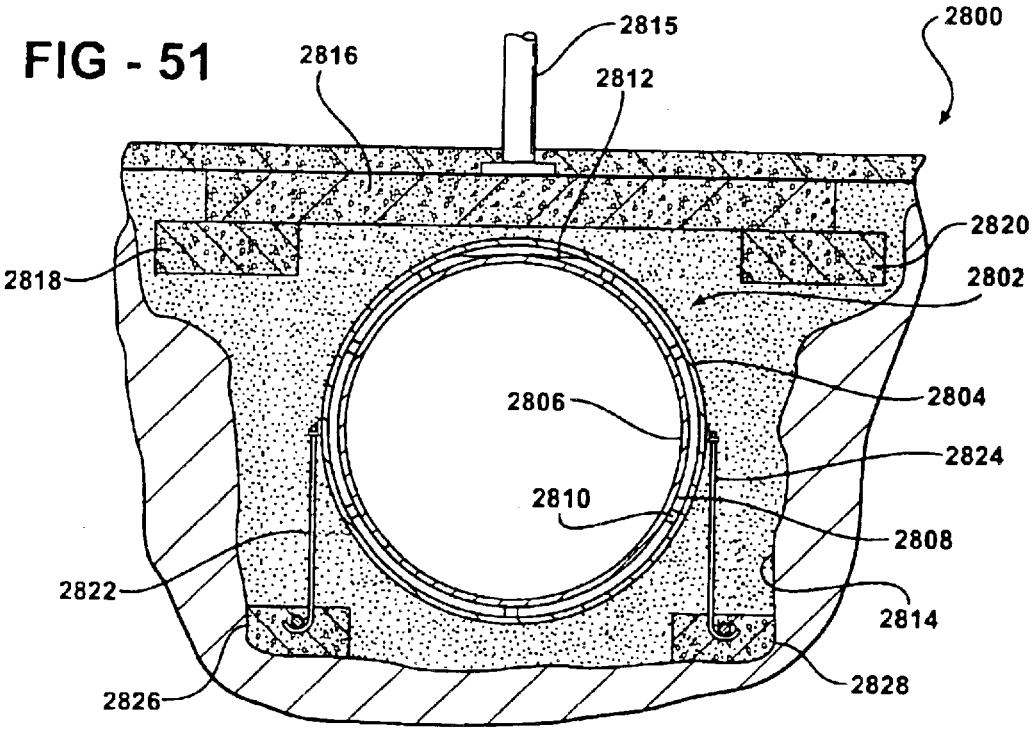
FIG. 51 is a cross-sectional view illustrating another improved storage reservoir assembly of the present invention installed within an excavated pit in the ground, including a double-walled reservoir and an adjacently disposed canopy support system.

Referring now to FIGS. 50 and 51, improved storage reservoir assemblies 2700 and 2800 are shown to include the use of double-walled reservoirs 2702 and 2802. In these arrangements, the double-walled reservoirs 2702 and 2802 include outer walls 2704 and 2804, which are separated from inner walls 2706 and 2806 so as to define voids 2708 and 2808. The voids 2708 and 2808 can be used to contain a second fluid, shown at 2712 and 2812, which is intended to provide a hydrostatic head of the second fluid 2712 and 2812 around the inner walls 2706 and 2806 at all times, so that any leaks that do occur in the inner walls 2706 and 2806 result in infiltration of the second fluid 2712 and 2812 into the reservoirs 2702 and 2802, thereby reducing the likelihood of leakage of the first fluid stored within the reservoirs 2702 and 2802 into the surrounding ground.

The voids 2708 and 2808 defined by the outer walls 2704 and 2804 and inner walls 2706 and 2806 of the respective reservoirs may be of any suitable size. Accordingly, the outer walls 2704 and 2804 and inner walls 2706 and 2806 may be maintained at a specified distance from each other by a plurality of spacers 2710 and 2810 which may be welded or otherwise secured between the inner and outer walls. It will also be appreciated that in any arrangement shown, such as in FIGS. 50 and 51, the reservoir may be placed directly within an excavated pit 2714 or 2814 without the use of any support spacers, such as that previously shown at 2508 and 2608. In addition, in any arrangement shown herein, the reservoir and/or the enclosure may be covered with a wrapping material of polyethylene or other plastic wrap (not shown) for decreasing the accumulation of moisture outside the enclosure and increasing the resistance of fluid from leaking into the ground.

FIG. 50 shows the arrangement where at least one support unit 2716 is disposed within the reservoir and projects outside the reservoir for attachment to an above-ground canopy (such as in FIGS. 41–43). FIG. 51 shows an alternative arrangement, similar to that shown in FIG. 50, but where a support system for an above-ground canopy, including support unit 2815, is disposed adjacent to the reservoir (such as in FIGS. 8–10), and includes a concrete beam 2816 supported by concrete footings 2818 and 2820. Also in FIG. 51, retaining devices in the form of tie-down rods 2822 and 2824 extend between the sides of the reservoir 2802 and concrete footings 2826 and 2828 for securing the position of the reservoir 2802 within the ground. Alternatively, straps may be extended over the reservoir and attached to the concrete footings in similar manner for retaining the reservoir within the ground. It will be appreciated that either of these retaining devices can be attached to any suitable reservoir or enclosure in any arrangement disclosed herein for this purpose.

It will be appreciated that this reservoir and enclosure combination can again also be used with any of the support arrangements for an above-ground canopy shown herein, including the arrangement shown in FIGS. 45 and 46, where one or more support units extend through a passageway disposed through the reservoir. It will also be appreciated that the concrete driveway above the reservoir may be sloped as may be desired in any version of the invention, as in FIGS. 9 and 10.

Figure 52:
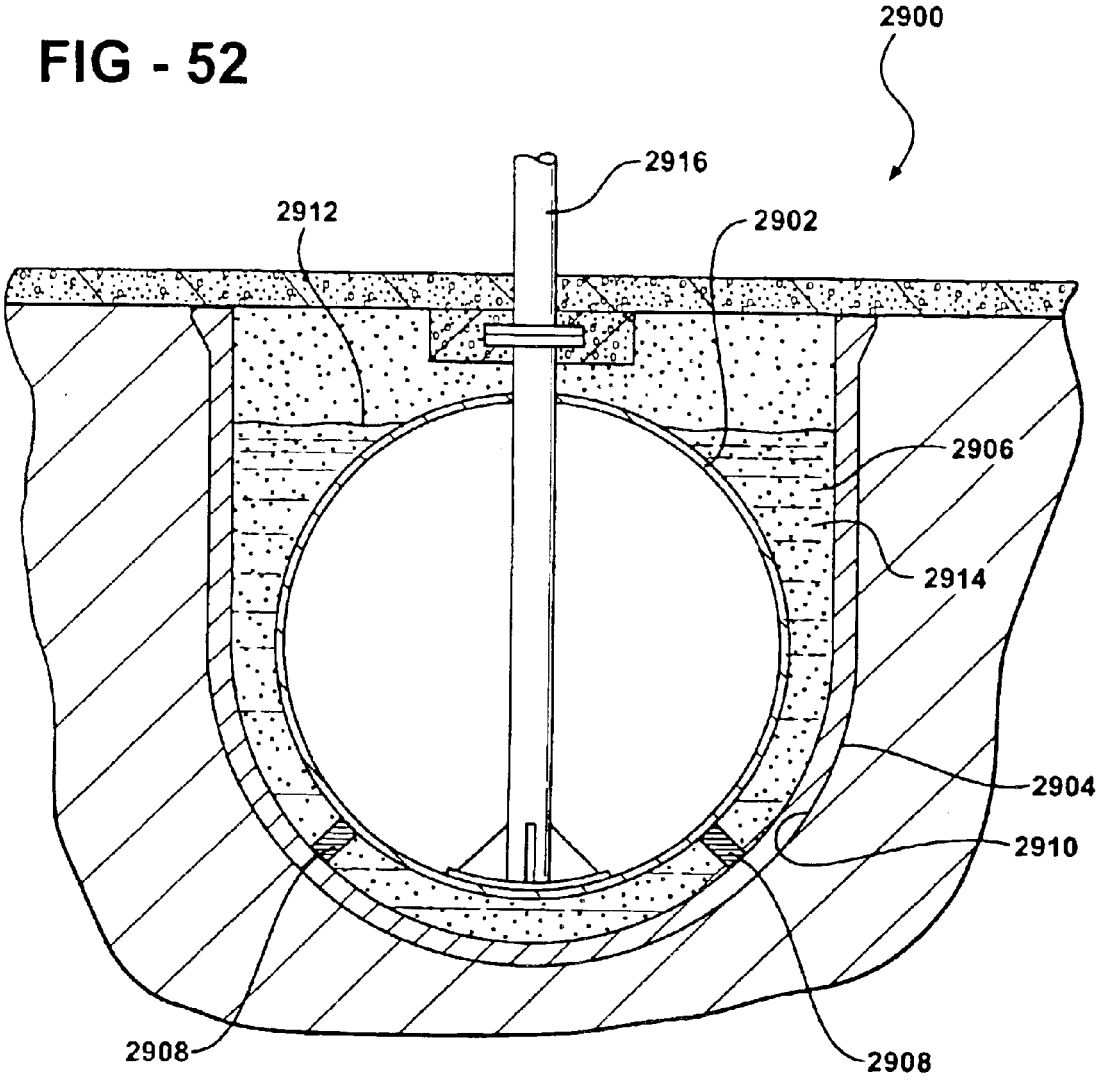
FIG. 52 is a cross-sectional view illustrating another improved storage reservoir assembly of the present invention installed within an excavated pit in the ground wherein a reservoir with attached support unit is located within a concrete U-shaped enclosure poured directly against U-shaped excavated ground walls.

FIG. 52 shows another arrangement of improved storage reservoir assembly 2900 which includes the use of a single-walled reservoir 2902 located within an underground concrete U-shaped enclosure 2904 constructed directly against the U-shaped excavated ground wall 2910. In this arrangement, similar to FIG. 50, the support unit 2916 extends within the reservoir 2902. Spacing between the reservoir 2902 and the enclosure 2904 may be maintained by one or more support spacers 2908 disposed within the enclosure 2904 beneath the reservoir 2902.

The void 2906 between the reservoir 2902 and the enclosure 2904 may again be filled with a second fluid 2912 that is capable of identifying a leaking condition of a first fluid stored within the reservoir 2902. Again, optionally, the void 2906 may be partially or completely filled with a filler material, such as pea gravel 2914. Also optionally, the top of the enclosure 2904 may again be covered with a polyethylene, other plastic or any other suitable covering material (not shown) for decreasing evaporation of the second fluid 2912 from within the enclosure.

It will be appreciated that any of the disclosed combinations of reservoirs, enclosures, support unit arrangements are accompanying structures can be interchanged as part of the present invention, including the arrangements shown where one or more support units extend through a passageway disposed through the reservoir.

The present invention also includes an integrated underground storage reservoir and above-ground canopy support system, with an above-ground distribution system for supplying multiple remote dispensing islands disposed within a canopy, instead of underground. FIGS. 1, 6 and 18 show the installation of a piping network as part of a distribution system within a secondary canopy which extends among multiple dispensing units on a common service station island. In those arrangements, distribution to remote islands is accomplished through underground piping networks also forming part of the distribution system (as shown in FIGS. 21 and 23–32). However, it will be appreciated that these same types of configurations of piping networks forming part of the distribution system may also be located within an overhead primary canopy which extends among multiple adjacent or remote service station islands. In such arrangements, the individual distribution units may be supplied from above, from piping units traveling through smaller secondary canopies which cover individual islands or dispensing units, as previously described. The individual distribution units may alternatively be supplied from the side or from below, from piping units extending along or within the various vertical canopy support units. As such, it will also be appreciated that this system can simultaneously supply distribution islands through both the primary and secondary canopies.

Figure 53:
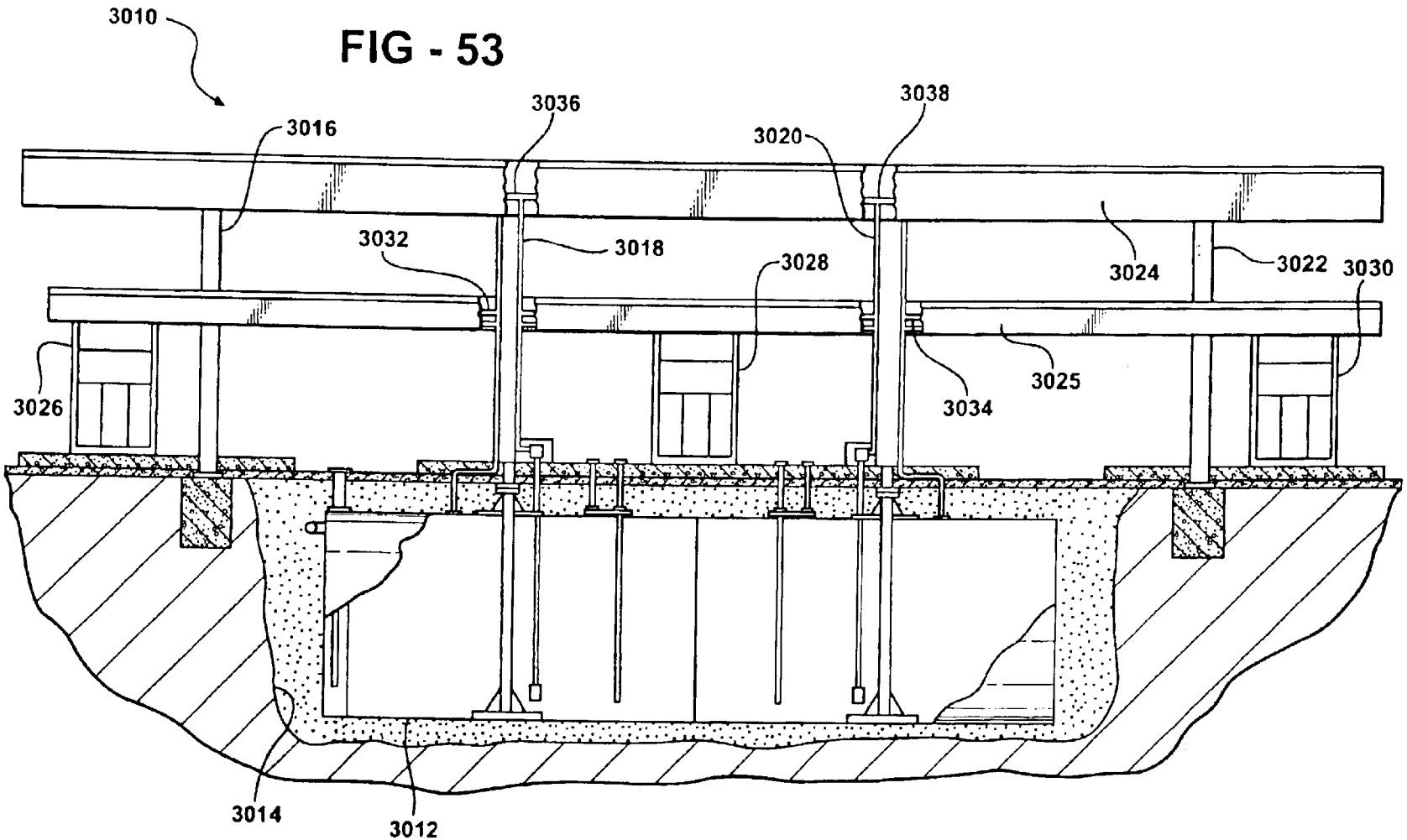
FIG. 53 is a partial cross-sectional view illustrating an integrated underground storage reservoir and canopy support system with a portion of a distribution system located within primary and secondary above-ground canopies.
Figure 54:
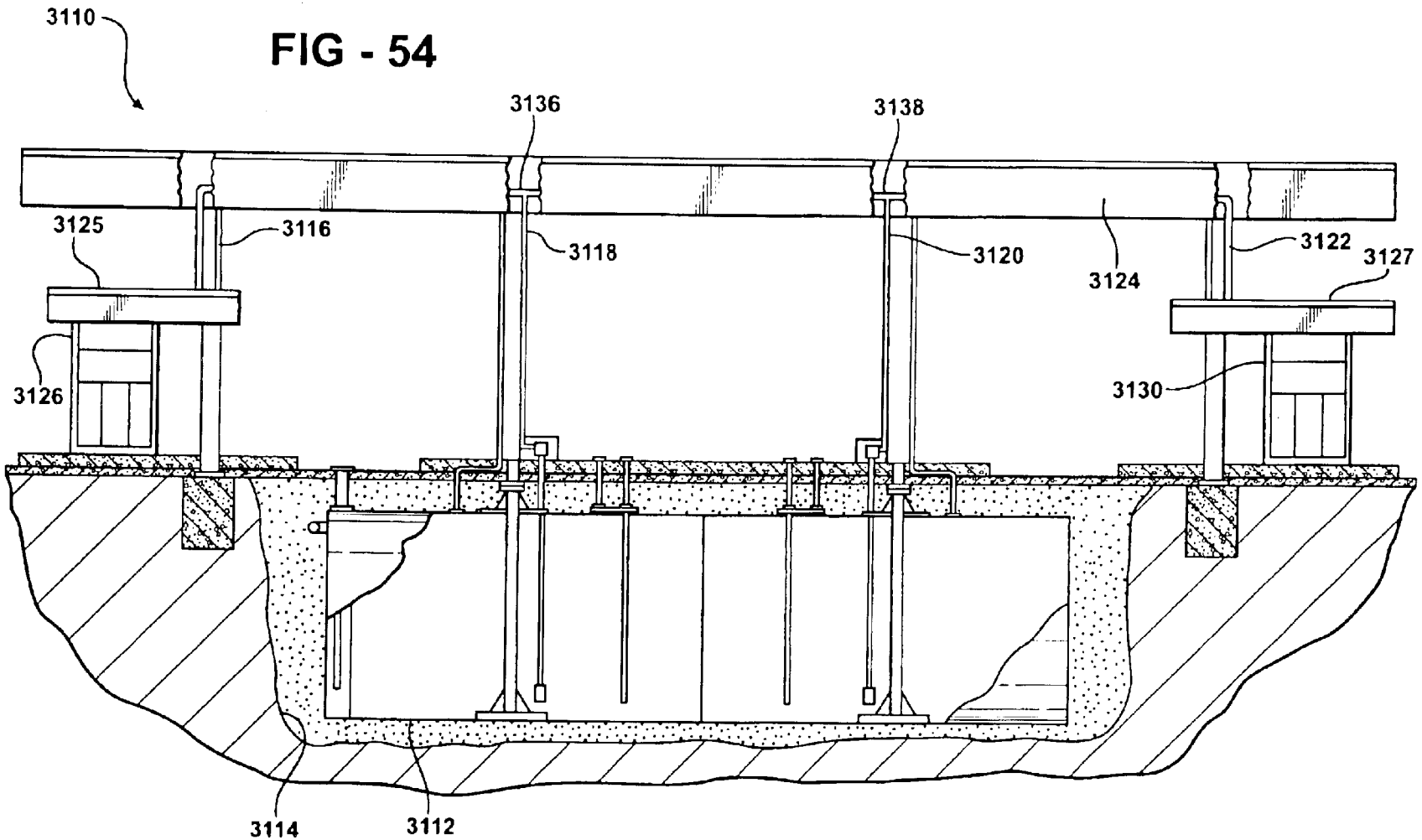
FIG. 54 is a partial cross-sectional view illustrating an integrated underground storage reservoir and canopy support system with a portion of a distribution system located within a primary above-ground canopy.

Two of these types of arrangements are shown in FIGS. 53 and 54. It will be appreciated that any suitable configuration for the piping network, including the configurations shown for underground arrangements in FIGS. 21 and 23–32, and other suitable configurations, may also be used within an overhead primary canopy. FIG. 53 shows an integrated underground storage reservoir and above-ground canopy support system, generally at 3010. The integrated system 3010 includes a storage reservoir 3012 located in an excavated pit 3014. Multiple support units 3016, 3018, 3020 and 3022 are shown to support a primary canopy 3024 and a secondary canopy 3025, in similar manner as before. Where the dispensing unit(s) to be supplied, such as 3026, 3028 and 3030, are located in a certain location relative to the underground reservoir (typically either directly above the reservoir or together forming one or more service station islands located generally above the reservoir), the dispensing units can be supplied through the secondary canopy 3026 from that portion of the distribution system piping network (3032, 3034) traveling through the secondary canopy 3026. Remote service islands can then be supplied through any suitable piping network, also forming part of the distribution system (3036, 3038), disposed within the primary canopy 3024.

FIG. 54 shows another similar integrated underground storage reservoir and above-ground canopy support system, generally at 3110, again including a storage reservoir 3112 located in an excavated pit 3114. This Figure shows how the dispensing units 3126 and 3130 may be supplied from distribution system piping 3136 and 3138 traveling upward alongside the support units 3118 and 3120, through the primary canopy 3124 and downward alongside the support units 3116 and 3122. Although the dispensing units 3126 and 3130 are supplied from the side in this Figure, they may also be supplied from below through additional piping traveling through the concrete islands, or from above through the small secondary canopies 3125 and 3127.

In general, it will be appreciated that any of the arrangements for any of the piping systems set forth herein may be located in below-ground or above-ground positions, or in any suitable combination. The present invention will thus be understood to cover integrated systems where the distribution system piping may be arranged in below-ground and above-ground alternatives that may be substantial mirror images of each other. Therefore, any underground piping may also be located in a similar above-ground arrangement, and vice-versa, where suitable. In addition, it will be appreciated that the various components of the invention can be altered with respect to their locations, while maintaining their operational relationships and not departing from the invention. For example, the oil-water separator module can also be located external to the storage reservoir. Also, it will be appreciated that other components or accessories may be used in connection with the invention, as may be necessary or desirable to accomplish certain advantages of the invention. For example, the storage reservoir described herein may be additionally anchored within the ground through the use of retention cables, anchors, straps and other means well known to those skilled in the art.

While the above description discusses preferred embodiments of the present invention, it will be understood that the description is exemplary in nature and is not intended to limit the scope of the invention. The present invention will therefore be understood as susceptible to modification, alteration and variation by those skilled in the art without deviating from the scope and meaning of the following claims.

What is claimed is:

1. An integrated underground storage reservoir and above-ground canopy system having increased resistance to leakage of a first fluid into the ground, said system comprising:

a reservoir suitable for being buried beneath ground level and for containing a first fluid;

at least one support unit disposed within the reservoir and projecting outside the reservoir for attachment to an above-ground canopy;

an above-ground canopy attached to said at least one support unit, said canopy suitable for providing shelter from weather while accessing said reservoir, said at least one support unit being operable for supporting said canopy in an above-ground position;

an enclosure suitable for at least partially surrounding the reservoir;

a delivery system for delivery of said fluid from within said reservoir to above ground level; and an above-ground distribution system for distribution of fluid from said delivery system to at least one above-ground fluid dispensing unit, at least a portion of said distribution system being disposed within said canopy;

wherein the enclosure is spaced from the reservoir so as to define a void therebetween, and wherein the void is filled with a second fluid capable of identifying a leaking condition of the reservoir by detected infiltration of the second fluid into the reservoir.

2. The integrated system according to claim 1, wherein the second fluid is selected from the group consisting of water and brine.

3. The integrated system according to claim 1, further comprising at least one detection device capable of detecting infiltration of the second fluid within the reservoir.

4. The integrated system according to claim 1, wherein the reservoir is constructed of a material selected from the group consisting of steel and fiberglass.

5. The integrated system according to claim 1, wherein the void also includes pea gravel as a filling material.

6. The integrated system according to claim 1, wherein the enclosure is covered with a wrapping material selected from the group consisting of polyethylene and other plastic wraps, said wrapping material suitable for at least one of:

decreasing the accumulation of moisture outside the enclosure; and increasing the resistance of the second fluid from within the void from leaking into the ground.

7. The integrated system according to claim 1, wherein the system further comprises at least one support spacer disposed within the enclosure beneath the reservoir for supporting the reservoir within the enclosure.

8. The integrated system according to claim 1, wherein the enclosure is attached to the reservoir by a plurality of attachment devices selected from the group consisting of straps, belts and welded gussets.

9. The integrated system according to claim 1, wherein the enclosure is constructed of a material selected from the group consisting of steel, fiberglass and concrete.

10. The integrated system according to claim 1, wherein the enclosure is disposed in relation to the reservoir so as to surround the reservoir at least to the total height of the reservoir.

11. The integrated system according to claim 1, wherein the enclosure and the reservoir are positioned during on-site installation so that the enclosure substantially surrounds said reservoir to define the void, and wherein the void is subsequently filled on-site.

12. The integrated system according to claim 1, wherein the reservoir and enclosure are installed within a portion of an excavated pit beneath ground level, and wherein a remaining portion of the pit is filled with pea gravel.

13. The integrated system according to claim 1, wherein the reservoir and enclosure are installed within a portion of an excavated pit beneath ground level, and wherein the enclosure is constructed directly in contact with walls of the excavated pit.

14. The integrated system according to claim 1, further comprising an automatic supply system for keeping said void filled with said second fluid.

15. An integrated underground storage reservoir and above-ground canopy system having increased resistance to leakage of a first fluid into the ground, said system comprising:

a reservoir suitable for being buried beneath ground level, said reservoir having an inner wall surrounded by and spaced from an outer wall so as to define a void therebetween, said reservoir suitable being for containing a first fluid within the inner wall;

at least one support unit disposed within the reservoir and projecting outside the reservoir for attachment to an above-ground canopy;

an above-ground canopy attached to said at least one support unit, said canopy suitable for providing shelter from weather while accessing said reservoir, said at least one support unit being operable for supporting said canopy in an above-ground position;

a delivery system for delivery of said fluid from within said reservoir to above ground level; and an above-ground distribution system for distribution of fluid from said delivery system to at least one above-ground fluid dispensing unit, at least a portion of said distribution system being disposed within said canopy;

wherein the void between the inner and outer walls of the reservoir is filled with a second fluid capable of identifying a leaking condition of the inner wall of the reservoir by detected infiltration of the second fluid within the inner wall of the reservoir.

16. The integrated system according to claim 15, wherein the second fluid is selected from the group consisting of water and brine.

17. The integrated system according to claim 15, further comprising at least one detection device capable of detecting infiltration of the second fluid within the inner wall of the reservoir.

18. The integrated system according to claim 15, wherein the reservoir is constructed of a material selected from the group consisting of steel and fiberglass.

19. The integrated system according to claim 15, wherein the void also includes pea gravel as a filling material.

20. The integrated system according to claim 15 wherein the outer wall of the reservoir is covered with a wrapping material selected from the group consisting of polyethylene and other plastic wraps, said wrapping material suitable for at least one of:

decreasing the accumulation of moisture outside the reservoir; and increasing the resistance of the second fluid within the void from leaking into the ground.

21. The integrated system according to claim 15, wherein the reservoir is installed within a portion of an excavated pit beneath ground level, and wherein a remaining portion of the pit is filled with pea gravel.

22. The integrated system according to claim 15, further comprising an automatic supply system for keeping said void filled with said second fluid.

23. An integrated underground storage reservoir and above-ground canopy system having increased resistance to leakage of a first fluid into the ground, said system comprising:

a reservoir suitable for being buried beneath ground level and for containing a first fluid;

a support system disposed adjacent to the reservoir, said support system including at least one substantially horizontal support beam disposed beneath ground level and above the reservoir, and suitable for attachment to an above-ground canopy, each substantially horizontal support beam being supported above the reservoir by a plurality of support units selected from the group consisting of substantially vertical support posts, concrete footings and combinations thereof disposed adjacent to the reservoir;

an above-ground canopy attached to said support system, said canopy suitable for providing shelter from weather while accessing said reservoir, said support system being suitable for supporting the above-ground canopy external to the reservoir; and an enclosure suitable for at least partially surrounding the reservoir;

wherein the enclosure is spaced from the reservoir so as to define a void therebetween, and wherein the void is filled with a second fluid capable of identifying a leaking condition of the reservoir by detected infiltration of the second fluid into the reservoir.

24. The integrated system according to claim 23, wherein the second fluid is selected from the group consisting of water and brine.

25. The integrated system according to claim 23, further comprising at least one detection device capable of detecting infiltration of the second fluid within the reservoir.

26. The integrated system according to claim 23, wherein the reservoir is constructed of a material selected from the group consisting of steel and fiberglass.

27. The integrated system according to claim 23, wherein the void also includes pea gravel as a filling material.

28. The integrated system according to claim 23, wherein the enclosure is covered with a wrapping material selected from the group consisting of polyethylene and other plastic wraps, said wrapping material suitable for at least one of:

decreasing the accumulation of moisture outside the enclosure; and increasing the resistance of the second fluid from within the void from leaking into the ground.

29. The integrated system according to claim 23, wherein the system further comprises at least one support spacer disposed within the enclosure beneath the reservoir for supporting the reservoir within the enclosure.

30. The integrated system according to claim 23, wherein the enclosure is attached to the reservoir by a plurality of attachment devices selected from the group consisting of straps, belts and welded gussets.

31. The integrated system according to claim 23, wherein the enclosure is constructed of a material selected from the group consisting of steel, fiberglass and concrete.

32. The integrated system according to claim 23, wherein the enclosure is disposed in relation to the reservoir so as to surround the reservoir at least to the total height of the reservoir.

33. The integrated system according to claim 23, wherein the enclosure and the reservoir are positioned during on-site installation so that the enclosure substantially surrounds said reservoir to define the void, and wherein the void is subsequently filled on-site.

34. The integrated system according to claim 23, wherein the reservoir is installed within a portion of an excavated pit beneath ground level, and wherein a remaining portion of the pit is filled with pea gravel.

35. The integrated system according to claim 23, wherein the reservoir and enclosure are installed within a portion of an excavated pit beneath ground level, and wherein the enclosure is constructed directly in contact with watts of the excavated pit.

36. The integrated system according to claim 23, further comprising an automatic supply system for keeping said void filled with said second fluid.

37. The integrated system according to claim 23, further comprising:

a delivery system for delivery of said fluid from within said reservoir to above ground level; and an above-ground distribution system for distribution of fluid from said delivery system to at least one above-ground fluid dispensing unit, at least a portion of said distribution system being disposed within said canopy.

38. An integrated underground storage reservoir and above-ground canopy system having increased resistance to leakage of a first fluid into the ground, said system comprising:

a reservoir suitable for being buried beneath ground level, said reservoir having an inner wall surrounded by and spaced from an outer wall so as to define a void therebetween, said reservoir suitable being for containing a first fluid within the inner wall;

a support system disposed adjacent to the reservoir, said support system including at least one substantially horizontal support beam disposed beneath ground level and above the reservoir, and suitable for attachment to an above-ground canopy, each substantially horizontal support beam being supported above the reservoir by a plurality of support units selected from the group consisting of substantially vertical support posts, concrete footings and combinations thereof disposed adjacent to the reservoir; and an above-ground canopy attached to said support system, said canopy suitable for providing shelter from weather while accessing said reservoir, said support system being suitable for supporting the above-ground canopy external to the reservoir;

wherein the void between the inner and outer walls of the reservoir is filled with a second fluid capable of identifying a leaking condition of the inner wall of the reservoir by detected infiltration of the second fluid within the inner wall of the reservoir.

39. The integrated system according to claim 38, wherein the second fluid is selected from the group consisting of water and brine.

40. The integrated system according to claim 38, further comprising at least one detection device capable of detecting infiltration of the second fluid within the inner wall of the reservoir.

41. The integrated system according to claim 38, wherein the reservoir is constructed of a material selected from the group consisting of steel and fiberglass.

42. The integrated system according to claim 38, wherein the void also includes pea gravel as a filling material.

43. The integrated system according to claim 38, wherein the outer wall of the reservoir is covered with a wrapping material selected from the group consisting of polyethylene and other plastic wraps, said wrapping material suitable for at least one of:

decreasing the accumulation of moisture outside the reservoir; and increasing the resistance of the second fluid within the void from leaking into the ground.

44. The integrated system according to claim 38, wherein the reservoir is installed within a portion of an excavated pit beneath ground level, and wherein a remaining portion of the pit is filled with pea gravel.

45. The integrated system according to claim 38, further comprising an automatic supply system for keeping said void filled with said second fluid.

46. The integrated system according to claim 38, further comprising:

a delivery system for delivery of said fluid from within said reservoir to above ground level; and an above-ground distribution system for distribution of fluid from said delivery system to at least one above-ground fluid dispensing unit, at least a portion of said distribution system being disposed within said canopy.

47. An integrated underground storage reservoir and above-ground canopy system having increased resistance to leakage of fluid into the ground, the system comprising:

a reservoir suitable for being buried beneath ground level and for containing a fluid;

a support system disposed adjacent to the reservoir, said support system including at least one substantially horizontal support beam disposed beneath ground level and above the reservoir, and suitable for attachment to an above-ground canopy, each substantially horizontal support beam being independently supported above the reservoir by a plurality of support units selected from the group consisting of substantially vertical support posts, concrete footings and combinations thereof disposed adjacent to the reservoir; and an above-ground canopy attached to said support system, said canopy suitable for providing shelter from weather while accessing said reservoir, said support system being suitable for supporting the above-ground canopy external to the reservoir;

a delivery system for delivery of said fluid from within said reservoir to approximately ground level; and a distribution system for distribution of fluid from said delivery system to at least one above-ground fluid dispensing unit, at least a portion of said distribution system being disposed at a shallow underground depth.

48. An integrated underground storage reservoir and above-ground canopy system having increased resistance to leakage of fluid into the ground, the system comprising:

a reservoir suitable for being buried beneath ground level and for containing a fluid;

a support system disposed adjacent to the reservoir, said support system including at least one substantially horizontal support beam disposed beneath ground level and above the reservoir, and suitable for attachment to an above-ground canopy, each substantially horizontal support beam being independently supported above the reservoir by a plurality of support units selected from the group consisting of substantially vertical support posts, concrete footings and combinations thereof disposed adjacent to the reservoir; and an above-ground canopy attached to said support system, said canopy suitable for providing shelter from weather while accessing said reservoir, said support system being suitable for supporting the above-ground canopy external to the reservoir;

a delivery system for delivery of said fluid from within said reservoir to above ground level; and an above-ground distribution system for distribution of fluid from said delivery system to at least one above-ground fluid dispensing unit, at least a portion of said distribution system being disposed within said canopy.

* * * * *

UNITED STATES PATENT AND TRADEMARK OFFICE

CERTIFICATE OF CORRECTION

PATENT NO. : 6,939,080 B2
APPLICATION NO. : 10/742671
DATED : September 6, 2005
INVENTOR(S) : Albert L. Wokas It is certified that error appears in the above-identified patent and that said Letters Patent is hereby corrected as shown below:

Column 4, line 23, after "provide", "a" should be --an--.

Column 5, line 33, "an" should be --a--.

Column 9, line 2, after "of", "a" should be --an--.

Column 11, line 58, "tank" should be --reservoir--.

Column 23, line 25, "principal" should be --principle--.

Column 23, line 33, "principal" should be --principle--.

Column 25, line 23, after "includes", "a" should be --an--.

Column 33, line 58, "others" should be --other--.

Column 36, line 22, "are" should be --and--.

Column 39, line 4, Claim 15, after "suitable", delete "being".

Column 40, line 61, Claim 35, "watts" should be --walls--.

Column 41, line 14, Claim 38, after "suitable", delete "being".

Signed and Sealed this

Eighteenth Day of November, 2008

JON W. DUDAS
*Director of the United States Patent and Trademark Office*